US008584929B2

(12) United States Patent
Littlejohn et al.

(10) Patent No.: US 8,584,929 B2
(45) Date of Patent: Nov. 19, 2013

(54) PRESSED PAPERBOARD SERVINGWARE WITH IMPROVED RIGIDITY AND RIM STIFFNESS

(75) Inventors: Mark B. Littlejohn, Appleton, WI (US); Gerald J. Van Handel, Neenah, WI (US); Thomas W. Zelinksi, Menasha, WI (US); Michael A. Breining, Neenah, WI (US); Albert D. Johns, Saylorsburg, PA (US)

(73) Assignee: Dixie Consumer Products LLC, Atlanta, GA (US)

( * ) Notice: Subject to any disclaimer, the term of this patent is extended or adjusted under 35 U.S.C. 154(b) by 2392 days.

(21) Appl. No.: 10/963,686

(22) Filed: Oct. 13, 2004

(65) Prior Publication Data

US 2006/0208054 A1 Sep. 21, 2006

Related U.S. Application Data

(60) Provisional application No. 60/512,811, filed on Oct. 20, 2003.

(51) Int. Cl.
*B65D 1/00* (2006.01)

(52) U.S. Cl.
USPC ..... 229/406; 220/574

(58) Field of Classification Search
USPC ..... 229/406
See application file for complete search history.

(56) References Cited

U.S. PATENT DOCUMENTS

| | | | | |
|---|---|---|---|---|
| 1,748,911 | A | 2/1930 | Chaplin | |
| 1,866,035 | A | 7/1932 | Hart et al. | |
| 2,595,046 | A | 4/1952 | Amberg | 93/1.3 |
| 2,832,522 | A | 4/1958 | Schlanger et al. | 229/2.5 |
| 2,911,320 | A | 11/1959 | Phillips | 117/64 |
| 3,268,144 | A | 8/1966 | Gaunt | 229/2.5 |
| 3,305,434 | A | 2/1967 | Bernier et al. | 162/117 |
| 3,442,378 | A | 5/1969 | Wolfe | 206/72 |
| 3,963,843 | A | 6/1976 | Hitchmough et al. | 427/361 |
| 4,078,924 | A | 3/1978 | Keddie et al. | 91/1 |
| 4,238,533 | A | 12/1980 | Pujol et al. | 427/359 |
| 4,503,096 | A | 3/1985 | Specht | 427/359 |
| 4,567,099 | A | 1/1986 | Van Gilder et al. | 428/327 |
| 4,588,539 | A | 5/1986 | Rossi et al. | 264/40.5 |
| 4,606,496 | A | 8/1986 | Marx et al. | 229/2.5 R |
| 4,609,140 | A | 9/1986 | Van Handel et al. | 229/2.5 R |
| 4,609,704 | A | 9/1986 | Hausman et al. | 524/710 |
| 4,721,499 | A | 1/1988 | Marx et al. | 493/152 |
| 4,721,500 | A | 1/1988 | Van Handel et al. | 493/152 |
| 4,781,566 | A | 11/1988 | Rossi et al. | 425/400 |
| 4,832,676 | A | 5/1989 | Johns et al. | 493/152 |

(Continued)

OTHER PUBLICATIONS

Kirk-Othmer, Encyclopedia of Chemical Technology, Third Edition, vol. 17, pp. 798, 799, 815, 831-836, Published 1982.

*Primary Examiner* — Nathan J Newhouse
*Assistant Examiner* — Christopher Demeree
(74) *Attorney, Agent, or Firm* — Edmonds & Nolte, P.C.

(57) ABSTRACT

Products and methods of increasing the Rigidity and Rim Stiffness of disposable containers are provided. The containers have an outer flange portion extending outwardly with a brim portion sloping downwardly defining a declivity angle α with respect to a horizontal generally parallel to the bottom portion and generally include an outward turn at the periphery of the container. A preferred method of improving rigidity includes press-forming: (i) a brim transition portion adjoining the downwardly sloping brim portion of the container and (ii) an outwardly extending annular evert portion adjoining the brim transition portion extending outwardly at an eversion angle β of at least about 25 degrees with respect to the downwardly sloping brim portion of the flange.

41 Claims, 27 Drawing Sheets

(56) References Cited

U.S. PATENT DOCUMENTS

| | | | | |
|---|---|---|---|---|
| 4,898,752 | A | 2/1990 | Cavagna et al. | 427/265 |
| 4,948,635 | A | 8/1990 | Iwasaki | 427/345 |
| 4,997,682 | A | 3/1991 | Coco | 427/362 |
| 5,033,373 | A | 7/1991 | Brendel et al. | 100/38 |
| 5,049,420 | A | 9/1991 | Simons | 427/361 |
| 5,088,640 | A | 2/1992 | Littlejohn | 229/2.5 R |
| 5,169,715 | A | 12/1992 | Maubert et al. | 428/331 |
| 5,203,491 | A | 4/1993 | Marx et al. | 229/2.5 R |
| 5,230,939 | A | 7/1993 | Baum | |
| 5,249,946 | A | 10/1993 | Marx | 425/142 |
| 5,326,020 | A | 7/1994 | Cheshire et al. | 229/2.5 R |
| 5,334,449 | A | 8/1994 | Bergmann et al. | 428/327 |
| 5,340,611 | A | 8/1994 | Kustermann et al. | 427/361 |
| 5,603,996 | A | 2/1997 | Overcash et al. | 428/34.2 |
| 5,609,686 | A | 3/1997 | Jerry et al. | 118/123 |
| 5,770,303 | A | 6/1998 | Weinert et al. | 428/326 |
| 5,776,619 | A | 7/1998 | Shanton | 428/511 |
| 5,795,928 | A | 8/1998 | Janssen et al. | 524/48 |
| 5,830,548 | A | 11/1998 | Andersen et al. | 428/36.4 |
| 5,852,166 | A | 12/1998 | Gruber et al. | 528/354 |
| 5,869,567 | A | 2/1999 | Fujita et al. | 524/608 |
| 5,932,651 | A | 8/1999 | Liles et al. | 524/838 |
| 5,938,112 | A | 8/1999 | Sandstrom | 229/407 |
| 5,972,167 | A | 10/1999 | Hayasaka et al. | 162/135 |
| 5,981,011 | A | 11/1999 | Overcash et al. | 428/40.9 |
| 6,039,682 | A | 3/2000 | Dees et al. | 493/58 |
| 6,186,394 | B1 | 2/2001 | Dees et al. | 229/122.34 |
| 6,211,500 | B1 | 4/2001 | Cochran, II et al. | |
| 6,211,501 | B1 | 4/2001 | McCarthy et al. | |
| 6,255,636 | B1 | 7/2001 | Cochran, II et al. | |
| 6,287,247 | B1 | 9/2001 | Dees et al. | 493/58 |
| 6,401,962 | B1 | 6/2002 | Littlejohn et al. | |
| 6,403,936 | B2 | 6/2002 | Cochran, II et al. | |
| 6,420,689 | B1 | 7/2002 | Cochran, II et al. | |
| 6,440,509 | B1 | 8/2002 | Littlejohn et al. | |
| 6,459,075 | B1 | 10/2002 | McCarthy et al. | |
| 6,474,497 | B1 | 11/2002 | Littlejohn et al. | 220/574 |
| 6,527,687 | B1 | 3/2003 | Fortney et al. | 493/56 |
| 6,585,506 | B1 | 7/2003 | Johns et al. | 425/170 |
| 6,589,043 | B1 | 7/2003 | Johns et al. | 425/403.1 |
| 6,592,357 | B1 | 7/2003 | Johns et al. | 425/397 |
| 6,670,592 | B2 | 12/2003 | McCarthy et al. | |
| 6,700,106 | B2 | 3/2004 | Cochran, II et al. | |
| 6,715,630 | B2 | 4/2004 | Littlejohn et al. | 220/573 |
| 6,733,852 | B2 | 5/2004 | Littlejohn et al. | 428/35.7 |
| 2002/0113118 | A1 | 8/2002 | Littlejohn et al. | 229/407 |
| 2002/0119265 | A1 | 8/2002 | Swoboda et al. | 428/34.1 |
| 2004/0069788 | A1 | 4/2004 | Johns et al. | 220/575 |

INVENTION PROFILE 1

INVENTION PROFILE 2

INVENTION PROFILE 3

INVENTION PROFILE 4

INVENTION PROFILE 5

PRIOR ART PROFILE 1

PRIOR ART PROFILE 2

PRIOR ART PROFILE 3

PRESSED PAPERBOARD SERVINGWARE WITH IMPROVED RIGIDITY AND RIM STIFFNESS

CROSS REFERENCE TO RELATED APPLICATION

This non-provisional application is based upon U.S. Provisional Application Ser. No. 60/512,811 of the same title filed on Oct. 20, 2003, the disclosure of which is incorporated by reference.

TECHNICAL FIELD

The present invention relates generally to pressed paperboard disposable containers and more specifically to products and methods of increasing the rigidity of pressed paperboard disposable containers by providing brim features including a transition portion adjoining a downwardly sloping brim portion of the container and an outwardly extending annular evert portion adjoining the brim transition portion. The annular evert portion extends outwardly at an eversion angle β of at least about 25 degrees with respect to the downwardly sloping brim portion.

BACKGROUND

Disposable food containers such as plates and platters with outwardly extending portions at their outer edges are known in connection with plastic products. The following patents disclose plastic containers with outwardly projecting portions on their outer flanges: U.S. Pat. No. 3,442,378 to Wolfe, see FIGS. 2 and 3; U.S. Pat. No. 3,268,144 to Gaunt, see FIGS. 3 and 5. Outwardly extending flange features are also seen in pulp molded products. U.S. Pat. No. 1,866,035 to Hart et al. discloses a pulp-molded plate with a bottom portion, a sidewall, a horizontal portion, an upward portion, a horizontal flange, a downward portion and an outwardly directed edge. See page 2, Col. 1, as well as FIGS. 2 and 3 of the '035 patent; note also U.S. Pat. No. 1,748,911 to Chaplin which discloses a pulp-molded plate including a sidewall, a surround, a downturn and an outwardly directed edge of thickened material which acts as a reinforcing annulus. See second Col., page 1, lines 75-86, as well as FIGS. 2 and 3 of the '911 patent. Commercial pulp molded products sometimes utilize geometry including at least a partial horizontal outer annulus around the flange, presumably for ease of trimming the final product which may be trimmed on a horizontal surface after forming. A stiffening outer border as such with a sharp eversion is not an art-recognized method of increasing strength of plastic or pulp molded products and such geometry has not been suggested for pressed paperboard products, discussed below.

Pulp molded articles, after drying, are strong and rigid but generally have rough surface characteristics. They are not usually coated and are susceptible to penetration by water, oil and other liquids. Pressed paperboard containers, on the other hand, can be decorated and coated with a liquid-resistant coating before being pressed by the forming dies into the desired shape. Vast numbers of paper plates and similar products are produced by each of these methods every year at relatively low unit cost. These products come in many different shapes, oval, rectangular or polygonal as well as round, and in multi-compartment configurations.

Many paperboard containers tend to exhibit somewhat less strength and rigidity than do comparable containers made by the pulp molding processes. Much of the strength and resistance to bending of a plate-like container made by either process lies in the sidewall and rim areas surrounding the center or bottom portion of the container. When in use, such containers are often supported by the rim and sidewall while the weight held by the container is located on the bottom portion. Thus, the rim and sidewall generally are placed in tension and flexure when the container is being used.

In plate-like structures made by the pulp molding process, the sidewall and overturned rim of the plate are, cohesive fibrous structures which have sufficient resistance to bending as long as they are not damaged or split. Because the rim and sidewall of the pulp molded containers are of a cohesive, unitary structure, they may be placed under considerable tension and flexure without failing. Plates produced by the pulp molding process do not typically have a continuous functional coating to prevent strength loss during use with hot, moist foods. Internal chemicals can be used to retard moisture and grease absorption. For improved moisture resistance, a secondary film can be laminated to the plate in a separate, post formation, step resulting in a significantly higher cost.

In contrast, when a container is made by pressing a paperboard blank, the flat blank must be distorted and changed in shape and area in order to form the blank into the desired three dimensional shape. This necessary distortion results in seams or pleats in the sidewall and rim, the areas of the container which are drawn in toward the center in press-forming the container, resulting from the decrease in the circumference of the formed container as compared to the blank. Unless considerable care is employed during the process of pressing, these seams or pleats can constitute material lines of weakness in the sidewall and rim areas about which such containers tend to bend more readily than do containers having unpleated sidewalls and rims. Moreover, unless well formed, such seams or pleats will often have a tendency to open or unfold as if attempting to return to their original flat shape. The necessary location of these pleats in the sidewall and rim of pressed paperboard containers places the greatest weakness in the area requiring the greatest strength. Unless carefully formed, such containers typically have been unable to support loads comparable to pulp molded containers of equivalent fiber content. Under tension, flexure or torsion, pleats can exhibit a tendency to open and/or hinge. Accordingly, most known pressed paperboard containers typically have significantly less load carrying ability than do pulp molded containers unless particular care is employed to transform disrupted regions in the plates into substantially integrated fibrous structures during the pressing process. In contrast to pulp molded plates, the pressed containers can easily have a continuous functional coating applied to the paperboard prior to forming, resulting in enhanced performance with hot and moist foods.

More general background with respect to pressed paperboard containers is seen in U.S. Pat. No. 4,606,496 entitled "Rigid Paperboard Container" of R. P. Marx et al.; U.S. Pat. No. 4,609,140 entitled "Rigid Paperboard Container and Method and Apparatus for Producing Same" of G J. Van Handel et al.; U.S. Pat. No. 4,721,499 entitled "Method of Producing a Rigid Paperboard Container" of R. P. Marx et al.; U.S. Pat. No. 4,721,500 entitled "Method of Forming a Rigid Paper-Board Container" of G. J. Van Handel et al.; and U.S. Pat. No. 5,203,491 entitled "Bake-In Press-Formed Container" of R. P. Marx et al. Equipment and methods for making paperboard containers are also disclosed in U.S. Pat. No. 4,781,566 entitled "Apparatus and Related Method for Aligning Irregular Blanks Relative to a Die Half" of A. F. Rossi et al.; U.S. Pat. No. 4,832,676 entitled "Method and Apparatus for Forming Paperboard Containers" of A. D. Johns et al.; and U.S. Pat. No. 5,249,946 entitled "Plate Forming Die Set" of R. P. Marx et al. The forming section may typically include a plurality of reciprocating upper die halves opposing, in facing relationship, a plurality of lower die halves. The upper die halves are mounted for reciprocating movement in a direction that is oblique or inclined with respect to the vertical plane. The paperboard blanks, after cutting, are gravity fed to the inclined lower die halves in the forming section. The construction of the die halves and the equipment on which they are mounted may be substantially conventional; for example, as utilized on presses manufactured by the Peerless Manufacturing Company. Optionally included are hydraulic controls. See U.S. Pat. No. 4,588,539 to Rossi et al. For paperboard plate stock of conventional thicknesses i.e. in the range of from about 0.010 to about 0.040 inches, it is preferred that the spacing between the upper die surface and the lower die surface is as taught in U.S. Pat. Nos. 4,721,499 and 4,721,500.

As noted earlier, paperboard for disposable pressware typically includes polymer coatings. Illustrative in this regard are U.S. Pat. No. 5,776,619 to Shanton and U.S. Pat. No. 5,603,996 to Overcash et al. The '619 patent discloses plate stock provided with a base coat which includes a styrene-acrylic polymer as well as a clay filler as a base coat as well as a top coat including another styrene acrylic polymer and another clay filler. The use of fillers is common in the art as may be seen in the '996 patent to Overcash et al. In the '996 patent a polyvinyl alcohol polymer is used together with an acrylic emulsion as well as a clay to form a barrier coating for a paperboard oven container. See Column 12, lines 50 and following. Indeed, various coatings for paper form the subject matter of many patents including the following: U.S. Pat. No. 5,981,011 to Overcash et al.; U.S. Pat. No. 5,334,449 to Bergmann et al.; U.S. Pat. No. 5,169,715 to Maubert et al.; U.S. Pat. No. 5,972,167 to Hayasaka et al.; U.S. Pat. No. 5,932,651 to Liles et al.; U.S. Pat. No. 5,869,567 to Fujita et al.; U.S. Pat. No. 5,852,166 to Gruber et al.; U.S. Pat. No. 5,830,548 to Andersen et al.; U.S. Pat. No. 5,795,928 to Janssen et al.; U.S. Pat. No. 5,770,303 to Weinert et al.; U.S. Pat. No. 4,997,682 to Coco; U.S. Pat. No. 4,609,704 to Hausman et al.; U.S. Pat. No. 4,567,099 to Van Gilder et al.; and U.S. Pat. No. 3,963,843 to Hitchmough et al.

Various methods of applying aqueous polymer coatings and smoothing them are known in the art. See U.S. Pat. No. 2,911,320 to Phillips; U.S. Pat. No. 4,078,924 to Keddie et al.; U.S. Pat. No. 4,238,533 to Pujol et al.; U.S. Pat. No. 4,503,096 to Specht; U.S. Pat. No. 4,898,752 to Cavagna et al.; U.S. Pat. No. 5,033,373 to Brendel et al.; U.S. Pat. No. 5,049,420 to Simons; U.S. Pat. No. 5,340,611 to Kustermann et al.; U.S. Pat. No. 5,609,686 to Jerry et al.; and U.S. Pat. No. 4,948,635 to Iwasaki.

Note also the following patents of general interest with respect to forming paperboard containers: U.S. Pat. No. 6,527,687 to Fortney et al. which discloses a cut-in-place forming system with a draw ring and so forth. See Cols. 6-8; U.S. Pat. No. 3,305,434 to Bernier et al. which discloses a paperboard forming apparatus; U.S. Pat. No. 2,832,522 to Schlanger which discloses another paperboard forming apparatus; U.S. Pat. No. 2,595,046 to Amberg discloses still yet another paperboard forming apparatus.

Pressed paperboard containers such as plates, bowls and the like have been improved over the years in terms of strength and processing characteristics. In this respect, container design particularly the placement and configuration of transitions, sidewalls, and brims has been found to impact product performance and influence manufacturing characteristics. One configuration which has enjoyed substantial commercial success is shown in U.S. Pat. No. 5,088,640 to Littlejohn. The '640 patent discloses a disposable plate provided with a smooth outer profile which defines four (4) radii of curvature defined by arcs of the outer portions of the plate. The various radii are selected for enhancing rigidity of the pressed paper plate as compared to other conventional designs made from the same paperboard stock. The flowing arcuate design of the '640 patent offers additional advantages, notably with respect to manufacturing. It is possible to achieve high press speeds with design of the '640 patent, exercise pleating control and maintain product consistency, even when product is formed slightly off-center due to the forgiving tolerances inherent in the design.

Another configuration for pressed paperboard food containers which has also enjoyed substantial commercial success is taught in U.S. Pat. No. 5,326,020 to Cheshire et al. A pressed paper plate configured according to the '020 patent includes three frusto-conical or linear profiled regions about its sidewall and rim. The sidewall region includes a generally annular region flaring upwardly and outwardly from a periphery of a planar inner region and a first frusto-conical, linear profiled region adjoining the annular region with the frusto-conical region sloping outwardly and upwardly from the annular region. The rim region includes an outwardly flaring arcuate annular region adjoining an outer periphery of the first frusto-conical region, and a second frusto-conical region extending generally tangentially from the arcuate annular region. The second frusto-conical or linear profiled region extends outwardly and downwardly at an angle of about 6° to about 12° and preferably about 6° to 10.5° relative to the plane defined by the planar inner region. The rim of the container further includes an outwardly and downwardly flaring frusto-conical lip with a linear profile adjoining an outer periphery of the second frusto-conical region in order to aid in grasping of the paperboard container by the consumer. The downturn and lip provide considerable strength. Additionally, a plurality of radially extending mutually spaced pleats are also formed in the rim region and are internally bonded with portions of the rim region during formation of the paperboard container by a die press. Pressed paperboard containers configured in accordance with the '020 patent are capable of exhibiting very high flexural strength relative to other available containers; however the design is less forgiving in terms of manufacturing tolerances than that of the '640 patent design. In other words, added strength comes at the expense of processability. In still yet other cases, it is seen that an increase in rigidity is achieved by sacrificing Rim Stiffness. One attempt to improve pressware containers was to provide a bowl with a double brim; however, this attempt was not successful due to hinging of the product therebetween resulting in lower strength.

It has been unexpectedly found in accordance with the present invention that the Rigidity and/or Rim Stiffness of a paperboard serving container can be increased for a given configuration by adding pressed rim features including a transition and an outwardly extending evert as hereinafter described.

SUMMARY OF INVENTION

It has been discovered that the Rigidity and Rim Stiffness of paperboard containers with downwardly extending brims are greatly enhanced by adding a press-formed transition and an outwardly extending evert at the periphery of the rim. Without intending to be bound by any theory, it is believed that the inventive structure fortifies the rim and helps to lock the pleats in place around the periphery of the container so that they will not readily open under tension or flexure, when the containers are used. The improvement according to the invention is advantageously applied in connection with a wide variety of pressed paperboard designs, for example, those of the '640 and '020 patents noted above and other designs noted herein.

There is accordingly provided in a first aspect of the invention, a disposable servingware container press-formed from a generally planar paperboard blank wherein the container has a characteristic diameter, D, as well as an overall height and which includes a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular transition portion and an outer flange portion extending outwardly with respect to the second annular transition portion. The brim height, sometimes referred to herein as the brim vertical drop, is the height difference between the overall container height and the lower edge of the downwardly sloping brim portion thereof as is seen in the figures which follow. The outer flange portion has a downwardly sloping brim portion defining a declivity angle $\alpha$ at its terminus with respect to a horizontal substantially parallel to the bottom portion, that is, the angle $\alpha$ is the angle between a tangent to the lower part of the brim and the horizontal. The downwardly sloping brim portion transitions to a brim transition portion which, in turn, transitions to an annular evert portion extending outwardly with respect to the downwardly sloping brim portion at an eversion angle $\beta$ (hereinafter defined) of at least about 25 degrees. The height of any upward extension of the evert portion above the brim transition portion is no more than about 75% of the brim height.

Generally, the eversion angle $\beta$ is from about 30° to about 160°, more typically, from about 30° to about 120° or more preferably from about 30° to about 90° with from about 35° to about 65° or about 45° to about 55° in some particularly preferred cases. The evert portion preferably extends outwardly from the annular flange transition portion a length of at least about 0.005D, while typically the evert portion extends outwardly from the annular flange transition portion a length of at least about 0.007D. In many embodiments, the evert portion extends outwardly from the annular flange transition portion a length of from about 0.005D to about 0.06D, with a length of from about 0.007D to about 0.03D being a preferred range; for example, the evert portion may extend outwardly from the annular flange transition portion a length over its profile of from about 0.01D to about 0.025D. The evert portion may also extend upwardly, downwardly, or substantially horizontally from the brim transition portion and may have a linear profile or a curved profile and extend upwardly over a portion of its profile and downwardly over a portion of its profile. The length of the evert is measured along its profile, that is from the brim transition to the end of the evert. The height of any upward extension of the evert portion above the brim transition portion is preferably less than about 50 percent of the brim height, and is less than about 25 percent in most cases.

In a particularly preferred embodiment, the annular evert portion has a substantially linear profile and extends outwardly in a substantially horizontal direction.

The downwardly sloping brim of the container makes a declivity angle $\alpha$ at its terminus with respect to a horizontal substantially parallel to the bottom portion which is generally less than about 80° or so. Less than about 75° is somewhat typical, with less than about 70° or 65° preferred in most cases. Likewise, the declivity angle $\alpha$ is typically at least about 25° or so, with a declivity angle $\alpha$ of at least 30°, 40°, 50° or between about 50° and about 60° being suitable in many embodiments. Between the downwardly sloping brim portion and the evert, the transition portion typically has a fairly small radius of curvature. Generally, the radius of curvature of the transition is less than ½", typically less than about ¼" and preferably about 1/16" or so for plates having a diameter of 8-10" or so. In most cases, a radius of curvature of the brim transition portion will be less than about ⅛", such as 1/16" or less. The radius of curvature of the brim transition section will perhaps most preferably be between about ⅛" and 1/32". Without intending to be bound by theory, it is believed that a relatively small radius is beneficial in strengthening the rim.

Typically the disposable servingware container has a caliper of at least about 10 or 12 mils; suitably from about 10 to about 40 mils and typically from about 12 to about 22.5 mils. Preferred containers have a caliper of at least about 15 mils and are provided with a coating comprising a clay pigment.

Well-formed pleats including paperboard lamellae reformed into integrated fibrous structures enhance product characteristics such as SSI rigidity and Rim Stiffness, discussed herein. Typically, at least one of the second annular transition portion, or the outer flange portion is provided with a plurality of circumferentially spaced, radially extending pleats formed from a plurality of paperboard lamellae rebonded into substantially integrated fibrous structures generally inseparable into their constituent lamellae. Preferably at least one of the brim transition portion or the annular evert portion is provided with a plurality of circumferentially spaced, radially extending pleats formed from a plurality of paperboard lamellae rebonded into substantially integrated fibrous structures generally inseparable into their constituent lamellae over at least a portion of their profiles. Such is achieved by making the product in preferred cases from a radially scored paperboard blank wherein the pleats extend over a profile distance corresponding to at least a portion of the length of the scores of the paperboard blank from which the container is formed.

When the container has a sidewall portion, the plurality of circumferentially spaced, radially extending pleats formed from a plurality of paperboard lamellae rebonded into substantially integrated fibrous structures generally inseparable into their constituent lamellae preferably extend around an annular region corresponding to at least part of the profile of a sidewall portion of the container. Typically, the plurality of circumferentially spaced, radially extending pleats formed from a plurality of paperboard lamellae rebonded into substantially integrated fibrous structures generally inseparable into their constituent lamellae extend around an annular region corresponding to at least part of the profile of the second annular transition portion of the container. Likewise, the plurality of circumferentially spaced, radially extending pleats formed from a plurality of paperboard lamellae rebonded into substantially integrated fibrous structures generally inseparable into their constituent lamellae may extend around an annular region corresponding to at least part of the profile of the outer flange portion of the container. The optional sidewall portion may be present and the sidewall portion, the second annular transition portion and the outer flange portion (including the annular evert) may all include a plurality of circumferentially spaced, radially extending pleats formed from a plurality of paperboard lamellae rebonded into substantially integrated fibrous structures generally inseparable into their constituent lamellae extending around an annular region corresponding to at least a part of the respective profile of the sidewall portion, the second annular transition portion and the arcuate outer flange portion. So also, it is preferred to have a plurality of circumferentially spaced, radially extending pleats disposed in an annular arrangement which pleats include a substantially integrated fibrous structure formed from a plurality of rebonded paperboard lamellae generally extending over the length of the pleat.

The disposable servingware container may be provided with a plurality of circumferentially spaced, radially extending pleats, the majority of which include a substantially integrated fibrous structure formed from a plurality of rebonded paperboard lamellae extending over at least a portion of their length; such as where a plurality of substantially integrated fibrous structures formed from rebonded paperboard define an annular rebonded paperboard array extending radially in an annular region corresponding to at least a part of the profile of the optional sidewall portion, if present, the second annular transition portion or the outer arcuate flange portion including the brim transition portion and the evert portion. The circumferentially spaced, radially extending pleats formed from a plurality of paperboard lamellae rebonded into substantially integrated fibrous structures generally inseparable into their constituent layers are preferably of generally the same thickness as adjacent areas of the servingware container in some preferred cases.

The containers may have any suitable number of pleats, generally from about 25 to about 80 radially extending pleats; typically from about 30 to about 50 radially extending pleats and in some cases from about 35 to about 45 radially extending pleats.

The disposable servingware container may be in the form of a plate having a height to diameter ratio of from about 0.06 to about 0.12 or in the form of a bowl or deep dish container having a height to diameter ratio of from about 0.1 to about 0.3.

In one series of embodiments, the disposable servingware container press-formed from a unitary generally planar paperboard blank has a characteristic diameter, D, as well as an overall height and includes: a generally planar bottom portion; a first annular transition portion extending upwardly and outwardly from said generally planar bottom portion; a sidewall portion extending upwardly and outwardly from said first annular transition portion; a second annular transition portion extending outwardly from said sidewall portion; said sidewall portion defining a generally linear, inclined sidewall profile over a length between said first annular transition portion and said second annular transition portion and defining an angle of inclination with respect to the vertical from said generally planar bottom portion; an arcuate brim portion having a convex upper surface extending outwardly with respect to said second annular transition portion, the radius of curvature of said arcuate brim portion being between about 0.005 and about 0.1 times the characteristic diameter of said disposable servingware container, the arcuate brim portion extending downwardly at its outer part to define at its terminus defining a declivity angle $\alpha$ with respect to a horizontal substantially parallel to the bottom portion; an inner flange portion extending between said second annular transition portion and said arcuate brim portion having a ratio of radial span to the characteristic diameter of from about 0 to about 0.1; a brim transition portion at the lower edge of the downwardly sloping arcuate brim portion, there being thus defined a brim vertical drop which is the difference between the overall height of the container and a height at which the downwardly sloping brim portion transitions to the brim transition portion, wherein the ratio of the brim vertical drop to the characteristic diameter of the of the container is greater than about 0.01, the brim transition portion, in turn, transitions to an annular evert portion extending outwardly with respect to the downwardly sloping arcuate brim portion at an eversion angle $\beta$ of at least about 25 degrees. The height of any upward extension of the evert portion above the brim transition portion is no more than about 75% of the brim vertical drop.

Typically in such cases, the inclined sidewall profile has an angle of inclination with respect to the vertical from said generally planar bottom portion of from about 10° to about 50° with from about 20° to about 30° being preferred. So also, the ratio of the flange outer vertical drop to the characteristic diameter of the container is generally greater than about 0.013, typically greater than about 0.015. The ratio of radius of curvature of the arcuate outer brim portion to the characteristic diameter of said servingware container is suitably from about 0.0175 to about 0.1 and is generally greater than about 0.025, typically from about 0.035 to about 0.07 or from about 0.035 to about 0.06. The outer brim may be characterized by having a single radius of curvature.

The ratio of the length of the generally linear inclined sidewall profile to the characteristic diameter of the disposable servingware container is also generally greater than about 0.025 and typically greater than about 0.03.

The convex upper surface of the arcuate outer flange portion may be configured so that it defines its radius of curvature over an included angle of from about 30° to about 80°.

When the disposable servingware container is a bowl, the ratio of the length of the generally linear inclined sidewall profile to the characteristic diameter of the bowl may be from about 0.1 to about 0.3, with from about 0.15 to about 0.25 being suitable.

The disposable servingware container may include an inner flange portion extending between said second annular transition portion and said arcuate outer brim portion over a radial span, wherein the ratio of the radial span of the inner flange portion to the characteristic diameter of said servingware container is from about 0.01 to about 0.09.

In still yet another series of embodiments there is provided disposable paper plates press-formed from a paperboard blank, the plate having a substantially planar center section as well as an overall height; a first rim portion extending outward from and joined to said substantially planar center section, the first rim portion defining an upwardly facing arc A12, having a radius of curvature of R12; a second rim portion outward from and joined to said first rim portion, said second rim portion defining a downwardly facing arc A22, having a radius of curvature of R22; a third rim portion outward from and joined to said second rim portion, said third rim portion defining a downwardly facing arc A32, having a radius of curvature of R32, and having a tangent at its outer edge which is substantially parallel to the plane of said substantially planar center section; a fourth rim portion outward from and joined to said third rim portion, said fourth rim portion defining a downwardly facing arc A42, having a radius of curvature of R42; wherein the length of the arc S2 of said second rim portion is substantially less than the length of the arc S4 of said fourth rim portion which in turn is less than the length of arc S1 of said first rim portion and wherein the radius of curvature R42 of said fourth rim portion is less than the radius of curvature R32 of said third rim portion which is less than the radius of curvature R22 of said second rim portion; and wherein the included angle defined by arc A12 exceeds 55 degrees and the included angle defined by arc A32 exceeds 45 degrees, the fourth rim portion also including an outer portion sloping downwardly at its terminus defining a declivity angle α with respect to a horizontal generally parallel to the center section; a brim transition portion joined to the fourth rim portion, a brim height being thereby defined as the difference between the overall height of the container and a height at which the downwardly sloping fourth brim portion transitions to the brim transition portion, which transition portion transitions to an annular evert portion extending outwardly with respect to the downwardly sloping fourth rim outer portion at an eversion angle β of at least about 25 degrees; the height of any upward extension of the evert portion above the brim transition portion being no more than about 75% of the brim height.

In these embodiments, it is typical that the angle of the fourth arc is generally less than about 75 degrees and the length of the first arc is substantially equivalent to the length of said third arc and the first radius of curvature of said first arc is substantially equivalent to said third radius of curvature of said third arc and that the height of the center of curvature of said first rim portion above the plane of said bottom portion is substantially less than the distance by which the center of curvature of said second rim portion is below the plane of said bottom portion. Likewise it is common to configure the plates such that the horizontal displacement of the center of curvature of said second rim portion from the center of curvature of said first rim portion is at least about twice said first radius of curvature of said first rim portion and wherein said height of the center of curvature of said third rim portion above the plane of said bottom portion is less than the height of the center of curvature of said fourth rim portion above the plane of said bottom portion. Particular embodiments include those where the center of curvature of said second rim portion is located outwardly from the center of curvature of both said third and fourth rim portions as well as those wherein the height of the center of curvature of said third rim portion above the plane of said bottom portion is less than about 0.3 times the radius of curvature of said fourth rim portion and the height of the center of curvature of said fourth rim portion above the plane of said bottom portion is at least about 0.4 times said first radius of curvature of said first rim portion. It is also preferred that the ratio of the fourth radius of curvature to the diameter of said plate is at least about 0.03 and that the ratio of the third radius of curvature to the diameter of said plate is at least about 0.050. Still further preferred features are those where the ratio of the second radius of curvature to the diameter of said plate is at least about 0.2; the ratio of the first radius of curvature to the diameter of the plate is at least about 0.045; the length of said first arc is substantially equivalent to the length of said third arc; and the radius of curvature of said first arc is substantially equivalent to the radius of curvature of the third arc.

Another embodiment is directed to disposable servingware containers press formed from a paperboard blank, the container having a finished diameter, D, as well as an overall height and comprising: a generally planar inner portion; an upwardly extending sidewall portion adjoining said generally planar inner portion; an outwardly flaring rim portion adjoining said sidewall portion; and an outwardly and downwardly extending annular outer lip portion adjoining said rim portion; said lip portion extending downwardly at a declivity angle α from horizontal of greater than about 45 degrees; and a brim transition portion transitioning outwardly from the lip portion, a brim height, H', being thereby defined as the difference between the overall height of the container and a height at which the outwardly and downwardly sloping outer annular lip portion transitions to the brim transition portion, said brim transition portion transitioning to an annular evert portion extending outwardly with respect to the downwardly sloping lip portion at an eversion angle β of at least about 25 degrees, the height of any upward extension of the evert portion above the brim transition portion being no more than about 75% of the brim height, H'.

In still yet another series of embodiments, there is provided servingware containers, press-formed from a paperboard blank, the container having a finished diameter, D, as well as an overall height and comprising: a substantially planar inner portion; a sidewall portion including; a generally annular portion flaring upwardly and outwardly from a periphery of said planar inner portion and a first frusto-conical portion adjoining said annular portion, said first frusto-conical portion sloping outwardly and upwardly from said annular portion; and a rim portion including an outwardly flaring arcuate annular portion adjoining an outer periphery of said first frusto-conical portion having a first portion thereof extending generally upwardly from said first frusto-conical portion and a second portion thereof flaring generally downwardly at an angle between about 6 degrees to about 12 degrees relative to a plane defined by said planar inner portion, a second frusto-conical portion extending downwardly and outwardly from said second portion of said arcuate annular portion at an angle of about 6 degrees to about 12 degrees relative to a plane defined by said planar inner portion and a lip portion extending outwardly and downwardly from said second frusto-conical portion at a declivity angle α from horizontal of greater than 45 degrees; and a brim transition portion transitioning outwardly from the lip, a brim height being thereby defined as the difference between the overall height of the container and a height at which the outwardly and downwardly extending lip portion transitions to the brim transition portion. The brim transition portion transitions to an annular evert portion extending outwardly with respect to the outwardly and downwardly sloping lip portion at an eversion angle β of at least about 25 degrees. The height of any upward extension of the evert portion above the brim transition portion is no more than about 75% of the brim height. These containers may further include the attributes wherein: the first frusto-conical portion extends at an angle from about 55° to about 70° relative to the plane defined by said substantially planar inner portion; the first frusto-conical portion has a length greater than about 0.015D; the outwardly flaring arcuate annular portion includes a radius of curvature between about 0.015D and about 0.040D; the second portion of said outwardly flaring arcuate annular portion optionally flares generally downwardly at an angle of approximately 6°-12°; the second frusto-conical portion optionally extends downwardly at an angle of approximately 6°-12°; the lip portion includes an outwardly and downwardly flaring frusto-conical portion adjoining an outer-periphery of said second frusto-conical portion, said lip having a length of at least 0.005D; the lip portion extends downwardly at an angle between about 15° to about 30° relative to a central axis of said planar inner portion; in one preferred embodiment, the lip portion extends downwardly at an angle of approximately 22.5° relative to the central axis of said planar inner portion.

Improved methods of increasing the Rigidity and/or Rim Stiffness of a disposable container having a characteristic diameter, D, as well as an overall height prepared from a generally planar paperboard blank, wherein the container has a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular transition portion; a flange portion extending outwardly with respect to the second annular transition portion; the outer flange portion including a brim portion sloping downwardly at its terminus defining a declivity angle α with respect to a horizontal generally parallel to the bottom portion, include press-forming a brim transition portion adjoining the downwardly sloping brim portion, a brim height being thereby defined as the difference between the overall height of the container and a height at which the outwardly and downwardly extending brim portion transitions to the brim transition portion, and press forming an annular evert portion extending outwardly with respect to the downwardly sloping brim portion at an eversion angle β of at least about 25 degrees. The height of any upward extension of the evert portion above the brim transition portion is no more than about 75% of the brim height.

The methods are generally effective to increase the Rigidity of the container by at least about 10% with respect to a container of like design which terminates with the downwardly sloping brim portion; with increases of at least about 15%; at least about 20%; or at least about 25% being readily achievable. Preferably, the improved method concurrently increases the Rim Stiffness of the container; increases of 10%, 25%; 50%; 75% and more in Rim Stiffness are readily achieved as is seen in the examples which follow.

In still yet a further aspect of the invention, there is provided a method of making a disposable servingware container from a, generally planar paperboard blank which includes: positioning the paperboard blank in a heated pressware die set; and press forming the containers of the invention. Optionally, the brim transition portion and at least a part of the downwardly sloping brim portion is provided with shading operative to cloak the geometry of the brim transition portion and the outwardly extending annular evert such that these features visually blend with the downwardly sloping brim portion of the container.

In preferred embodiments, stacking features are provided including spacer and stabilizing ridges to facilitate accumulation, stacking, packaging and distribution of product. There is provided in one preferred embodiment, a flange stabilizing ring illustrated as a projection disposed on the downwardly sloping brim portion sized to engage an adjacent container in a stack of like containers to promote stack stability. The stabilizing ring typically includes a plurality of stabilizing nodules formed by way of a forming contour provided with an annular groove which has a depth of from about 3 to about 10 mils such that the plurality of stabilizing nodules are formed on pleats of the container. The groove may be continuous or there may be provided a plurality of discrete groove segments. There are generally from about 25 to about 80 circumferentially spaced stabilizing nodules; typically from about 30 to about 60 circumferentially spaced stabilizing nodules; and in some cases from about 35 to about 50 circumferentially spaced stabilizing nodules. The groove may be in the die forming contour and have an inner wall which is substantially vertical or slopes outwardly so that the stabilizing ring is formed on the underside of the container. In a particularly preferred case there is further provided a spacer ring illustrated as a projection between the first and second annular transition portions sized to engage an adjacent like container in a stack so as to abate taper lock.

In some preferred constructions, the annular evert portion extends outwardly with respect to the downwardly sloping brim portion at an eversion angle β of at least about 25 degrees over a distance of at least about 75 mils from the brim transition portion around the perimeter of the container, optionally having otherwise any of the attributes noted herein. Typically, the annular evert portion extends outwardly from the brim transition portion a greater distance, such as at least about 90, 100, 110 or 120 mils and more around the perimeter of the container. In most cases, the annular evert portion is no thicker than the downwardly sloping brim portion of the container and has a caliper between about 10 and 40 mils over its entire profile.

BRIEF DESCRIPTION OF DRAWINGS

The invention is described in detail below in connection with the various Figures wherein like numbers designate similar parts and wherein.

DETAILED DESCRIPTION

Figure 1A:
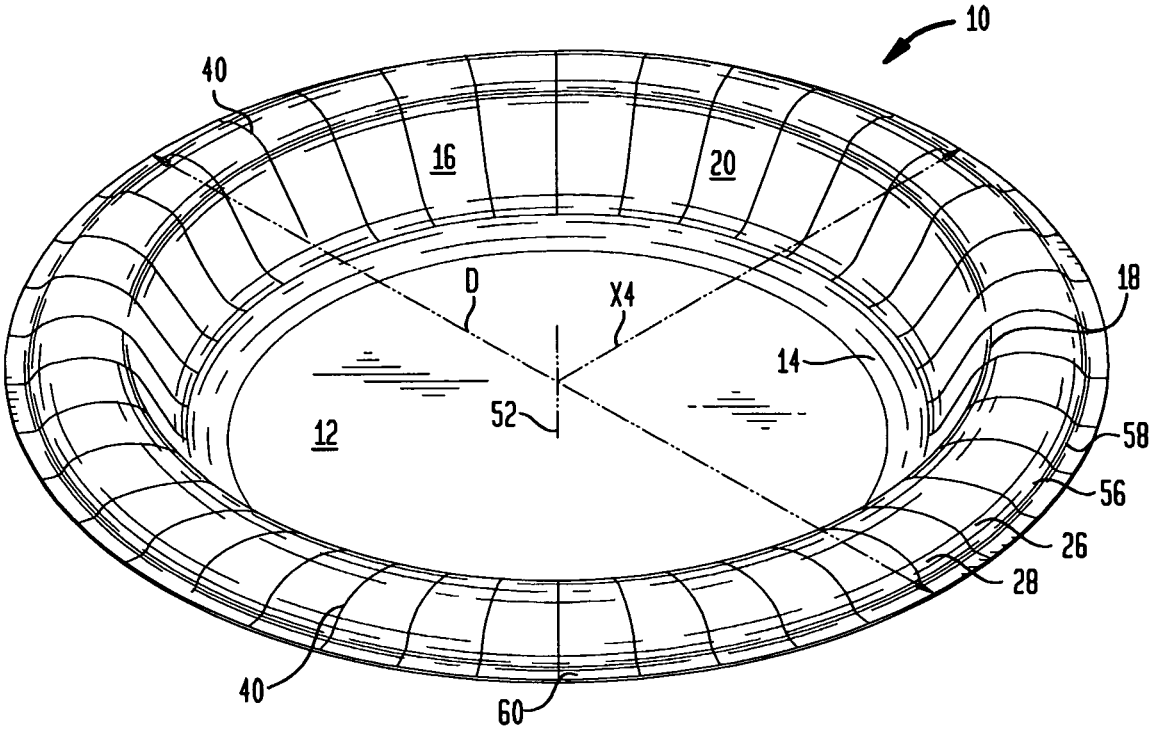
FIG. 1A is a view in perspective of a plate configured in accordance with the present invention.
Figure 1B:
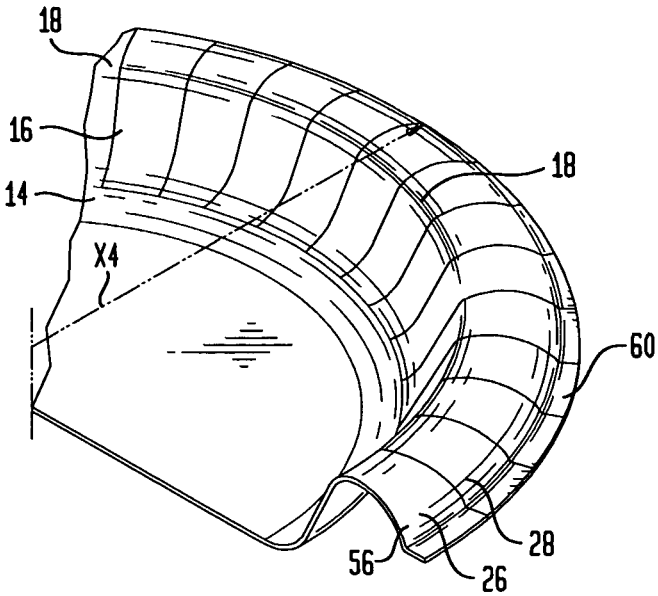
FIG. 1B is a partial view in perspective and section illustrating the geometry of the plate of FIG. 1A.
Figure 1C:
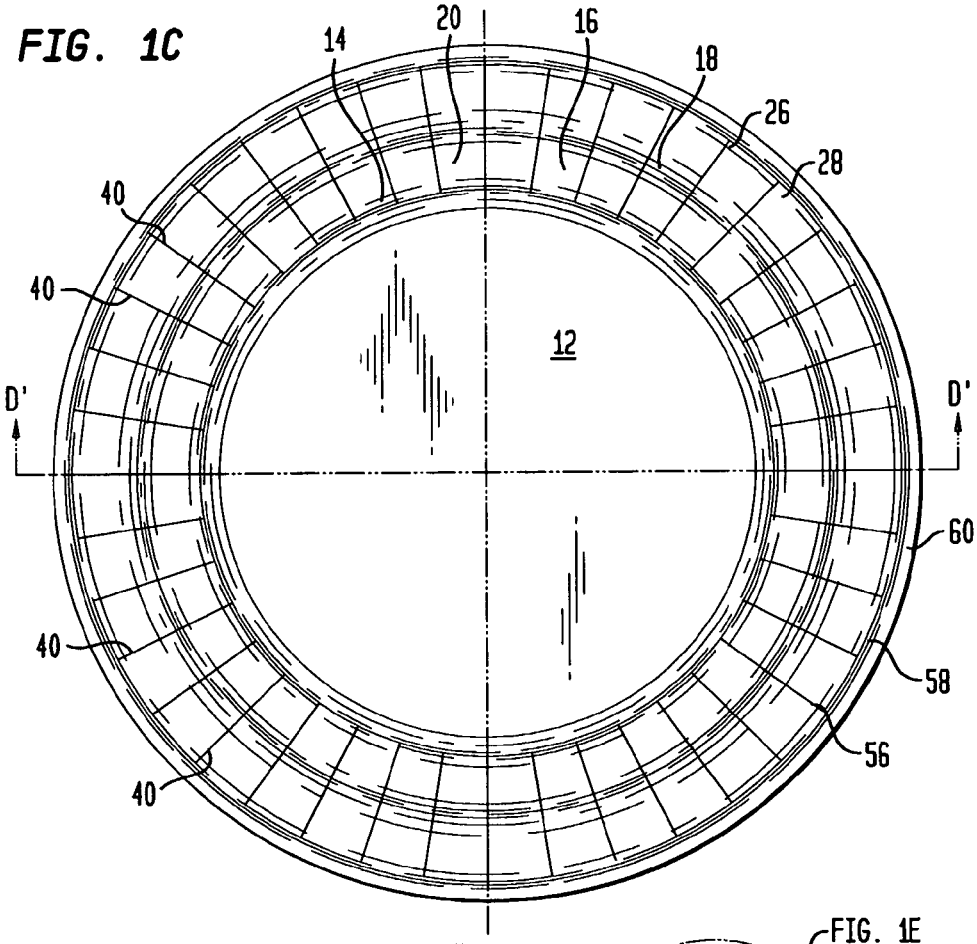
FIG. 1C is a plan view showing the plate of FIGS. 1A and 1B.
Figure 1D:
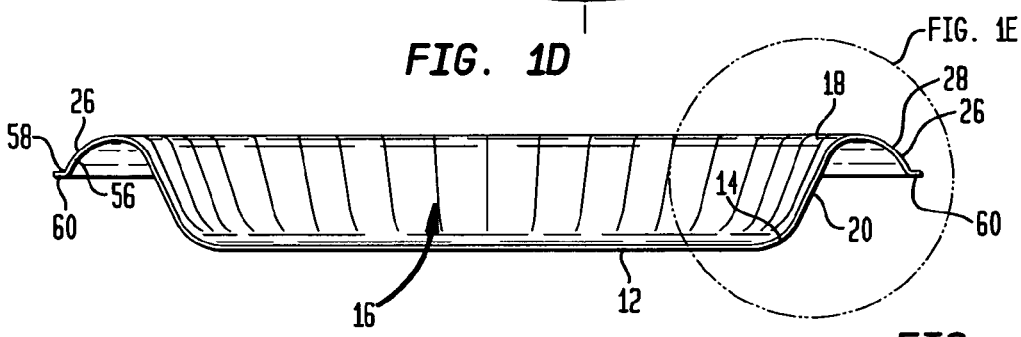
FIG. 1D is a view in section and elevation of the plate of FIGS. 1A-1C along line D'-D' of FIG. 1C.
Figure 1E:
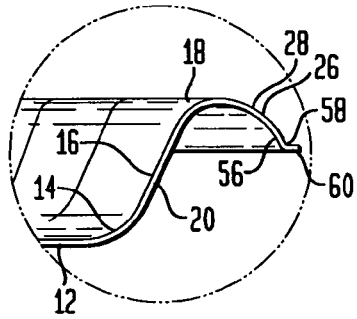
FIG. 1E is an enlarged detail illustrating the geometry of the disposable plate of FIGS. 1A-1D.

The invention is described in detail below with reference to numerous embodiments for purposes of exemplification and illustration only. Modifications to particular embodiments within the spirit and scope of the present invention, set forth in the appended claims, will be readily apparent to those of skill in the art.

As used herein, terminology is given its ordinary meaning unless a more specific definition is given or the context indicates otherwise. Disposable containers of the present invention generally have a characteristic diameter. For circular bowls, plates, platters and the like, the characteristic diameter is simply the outer diameter of the product. For other shapes, an average diameter can be used; for example, the arithmetic average of the major and minor axes could be used for elliptical shapes, whereas the average length of the sides of a rectangular shape is used as the characteristic diameter and so forth. Sheet stock refers to both a web or roll of material and to material that is cut into sheet form for processing. Unless otherwise indicated, "mil", "mils" and like terminology refers to thousandths of an inch and dimensions appear in inches. Likewise, caliper is the thickness of material and is expressed in mils unless otherwise specified. The arcuate outer flange of containers of the present invention is sometimes characterized by a smooth, flowing outer profile as described and illustrated herein. That outer profile may define a single radius of curvature such as in FIG. 3 for arcuate outer profiles of constant curvature. In embodiments where the arcuate outer profile has a plurality of characteristic radii, for example, if the profile is somewhat in the nature of spiral or elliptical in shape, a weighted mean curvature may be used, the radius of curvature being the reciprocal of curvature. Such geometry may arise, for example, when the container is formed in a die set having a contour corresponding to the outer arcuate flange of the container with a single radius of curvature in that region and the product, after forming, relaxes slightly in some areas more than others. In cases where a somewhat segmented arcuate outer flange is employed, one may simply approximate the corresponding arcuate shape to determine the mean curvature (which may be a weighted mean curvature as noted above). There tends to be some variation between paperboard products formed in the same die set as well as some variance in distances and angles around the container due to off center forming, springback and so forth. As used herein, dimensions and angles specified refer to average values which are conveniently measured on the die side of the product in some cases but may likewise be measured on the punch side of the product. Measurements are taken at four or more equally spaced circumferential locations and averaged, unless otherwise specified.

"Rigidity" refers to SSI rigidity in grams at 0.5" deflection as hereinafter described.

"Rim Stiffness" refers to the Rim Stiffness in grams at 0.1" deflection as further discussed below.

"Evert", "annular evert", "evert portion" and like terminology refers to an outwardly extending part of the inventive containers, the evert typically occurring at the outer flange of a container adjoining a transition from a downwardly sloping brim portion of the container.

The eversion angle, β, is an outward change in downward slope at the outer flange of the container and is calculated as the angle between a tangent to the brim portion at its lower terminus and a tangent to the evert portion at its junction with the brim transition to the evert. As used throughout this specification and in the claims, "slope" refers to inclination as one moves outwardly from the center of the product. Thus, a sidewall is typically referred to as upwardly sloping and a brim has a downwardly sloping outer portion. A container with a brim sloping downwardly at 60 degrees from horizontal transitioning to a horizontal ring (0 slope) has an eversion angle of 60 degrees, while a container with a brim sloping downwardly at 45 degrees transitioning to a ring sloping upwardly 5 degrees has an eversion angle of 50 degrees. Alternatively, the eversion angle can be conveniently determined by measuring the angle, γ, between the downwardly sloping brim and the outwardly extending evert and subtracting γ from 180 degrees because γ and β are supplementary angles as is seen in FIGS. 2A-2D. In the above examples, one calculates the eversion angle in the first case by first measuring the angle (which is 120 degrees) and subtracting it from 180 degrees. In the second case, the measured angle between the downwardly extending brim and the evert would be 130 degrees and the eversion angle 50 degrees.

Disposable servingware containers such as pressware paperboard containers typically are in the form of plates, both compartmented and non-compartmented, as well as bowls, trays, and platters. The products are typically round or oval in shape but can also be multi-sided, for example, hexagonal or octagonal.

There are shown in FIGS. 1A through 3 various illustrations of a disposable container in accordance with the present invention having the shape designated herein as Invention Profile 1 for purposes of convenience. Another preferred embodiment has a very similar geometry and is referred to as Profile 1A in Tables 1 and 2 below.

Figure 2:
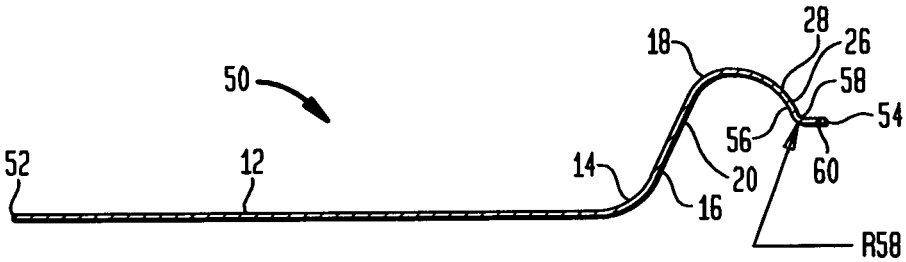
FIG. 2 is a diagram showing the profile from center of the plate of FIGS. (1A-1E)
Figure 3:
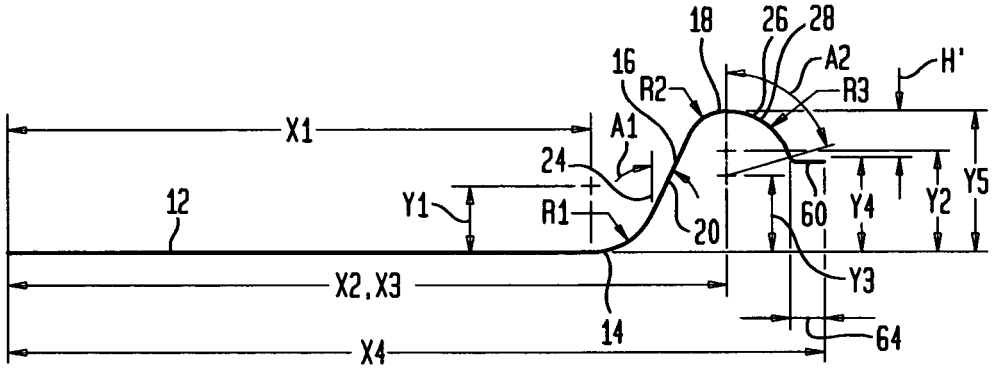
FIG. 3 is a schematic diagram illustrating various dimensions of the plate of FIGS. 1A-2.

A disposable food container in the form of a plate 10 has a characteristic diameter, D, which simply corresponds to the diameter of the plate since the plate is generally circular. The plate has a generally planar bottom portion 12, a first annular transition portion 14 and a sidewall portion 16. A second annular transition portion 18 extends between sidewall portion 16 and an arcuate outer flange 26. The sidewall defines a generally linear profile 20 between first annular transition portion 14 and second annular transition portion 18. The inclined generally linear profile portion 20 defines an angle of inclination A1 with a vertical 24. Outer arcuate flange portion 26 has a convex upper surface 28 and defines an outer radius of curvature, R3. Outer radius of curvature, R3, is defined by portion 26 over an included angle A2. There is likewise typically defined an intermediate radius of curvature, R2, as well as an inner radius of curvature, R1, as shown in FIG. 3. Note that the profile 50 extends from the center 52 to the outermost portion 54 as can be appreciated from FIGS. 1A, 2 and 3.

Note that the outer flange portion 26 extends outwardly from second annular transition 18 and includes a downwardly sloping brim portion 56 with a brim transition portion 58 at its bottom, extending annularly as shown. Transition portion 58 defines a profile direction change and is attached to an outwardly extending annular evert portion 60 as shown, a salient feature of the invention.

Portion 58 defines a radius of curvature, R58. As measured from the die side of the product, R58 is suitably 1/16" in many cases, but may be smaller or larger depending on caliper and product design.

The height of the brim, "brim height", "brim vertical drop" and like terminology refers to the difference between the overall height of the container (Y5, FIG. 3) and the height, Y4, FIG. 3 of the lower edge of downwardly sloping brim portion 56 of flange 26. That is, the brim vertical drop or brim height for a given container is as shown in FIG. 3 as Y5–Y4, which may also be referred to as the outer flange vertical drop, discussed below.

Figure 2A:
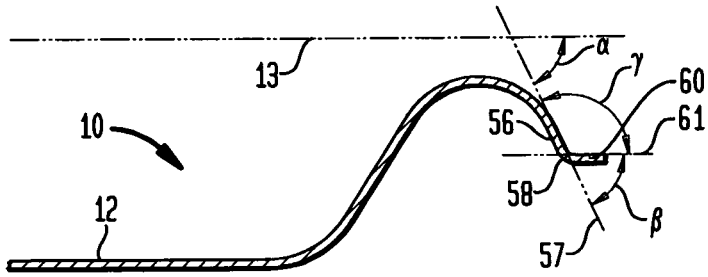
FIGS. 2A, 2B, 2C and 2D are diagrams illustrating various angles.
Figure 2B:
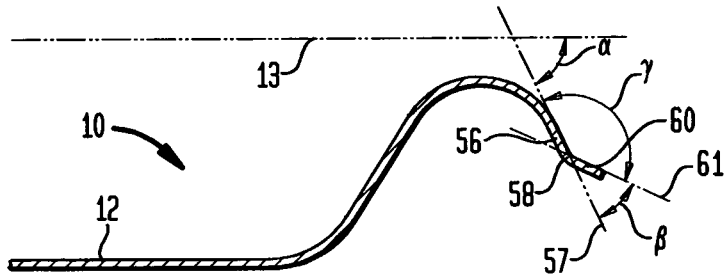
Figure 2C:
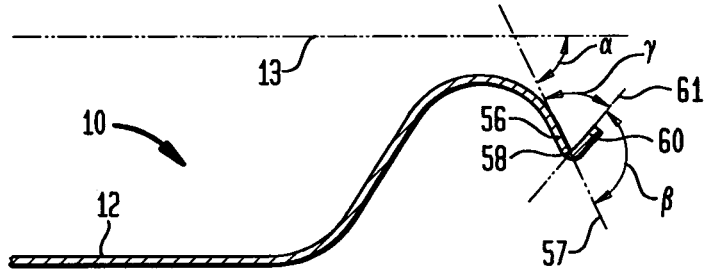
Figure 2D:
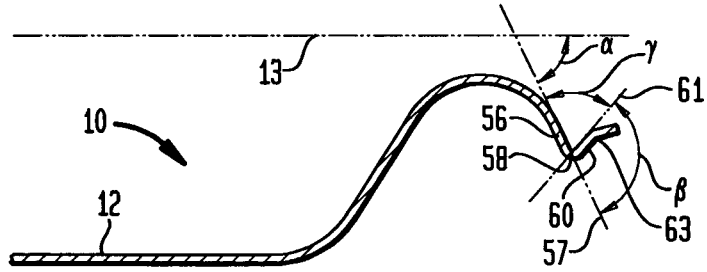

FIGS. 2A, 2B, 2C and 2D illustrate the various angles α, β and γ of various embodiments of the present invention. In each case there is illustrated a profile of a plate 10 having a substantially planar bottom portion 12 as well as a downwardly sloping brim portion 56, a brim transition 58 and an evert portion 60. Angle α is the angle between a tangent 57 at the terminus of downwardly sloping brim portion 56 and a line 13 generally parallel to bottom portion 12. The eversion angle β is the angle between a tangent 61 to evert 60 adjacent its junction with transition portion 58 and tangent line 57 which is tangent to the terminus of portion 56 as shown. β is an outward change in downward slope of the outer portion of the article and may be measured directly or may be alternatively be calculated as 180°−β where the angle, γ, is the angle between tangent line 57 to portion 56 and tangent line 61 to evert portion 60. Angle β may be anywhere from 25° to 160° on an absolute basis. Portion 60 may have an upward slope, a downward slope or have 0 slope as is shown in FIG. 2A where evert 60 is horizontal, generally in a parallel direction to the plane of bottom 12. In FIG. 2B it is seen portion 60 has a downward slope, while in FIG. 2C it is seen portion 60 has an upward slope. In FIG. 2D it is seen that evert portion 60 may be provided with an additional inflection 63 if so desired. It is not necessary that the length of the evert be uniform around the plate, nor is it required that the evert have a linear profile or a profile that is a combination of linear segments. The profile may be arcuate, for example, or comprise a combination of arcuate and linear segments.

As will be appreciated from the various diagrams, X4 corresponds generally to the radius from center to the outer periphery of the plate, X1 corresponds to the radius of the bottom of the plate, that is the radius of the serving or cutting area of the container, Y1 corresponds to the height of the origin of an inner radius of curvature, R1, above the bottom of the plate, X2 is the radius from the center of the plate to the origin of R2, X3 is the radius from the center of the plate to the origin of R3, R1 is the radius of curvature of the first annular transition portion 14, A1 is the sidewall angle defined between the linear portion 20 of the sidewall and a vertical 24, R2 is an intermediate radius of curvature, the origin of which is a height Y2 above the bottom of the container, R3 is the radius of curvature of arcuate outer flange portion 26. Y3 is the height above the bottom of the container of the origin of the radius R3. A2 is the included angle of the arc defined by the outer arcuate flange portion 26 having radius of curvature, R3, Y4 is the height above the bottom of the container of the outer and lower periphery of brim portion 56 and Y5 is the overall height of the product. Typical ratios or shape factors are conveniently based on the characteristic diameter, D, of the product, that is, twice the radius, X4, for a circular product.

The ratio of the flange outer vertical drop or brim height (H', FIG. 3 and FIGS. 7A-7H) to the characteristic diameter, D, is generally greater than about 0.01. This quantity may be calculated by taking the difference between Y5, the overall height, and Y4, the height above the container bottom of the of bottom brim portion 56 of outer arcuate flange portion 26 and dividing by the characteristic diameter, D, of the container. This quantity is determined by measuring Y4 and Y5 at four or more equally spaced locations for averaging purposes as noted above.

Evert portion 60 extends outwardly a length 64 at least about 40 mils or so from transition portion 58, most preferably in a horizontal direction as is shown. The evert may extend upwardly, but no more than about 75% of brim height H' and may extend outwardly or outwardly and downwardly as well. In preferred embodiments, the periphery of the container terminates with the outwardly extending evert.

The containers of the invention generally include a plurality of radially extending, circumferentially spaced pleats 40, as are shown preferably formed of rebonded paperboard lamellae as described in connection with fabrication of inventive containers. Invention Profile 1A is quite similar to the profile illustrated as will be appreciated from the dimensions and relative dimensions in Tables 1 and 2 provided below.

Referring now to FIGS. 4A through 6, the present invention is illustrated in connection with another design for disposable paper plates made from paperboard blanks and pressed in a heated die set as described hereinafter. This embodiment is referred to for convenience as Invention Profile 2.

Figure 5:
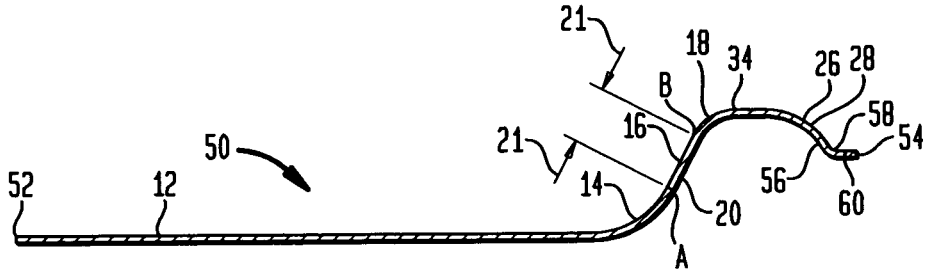
FIGS. 5 and 6 are schematic diagrams illustrating the profile of the plate of FIGS. 4A-4D.
Figure 6:
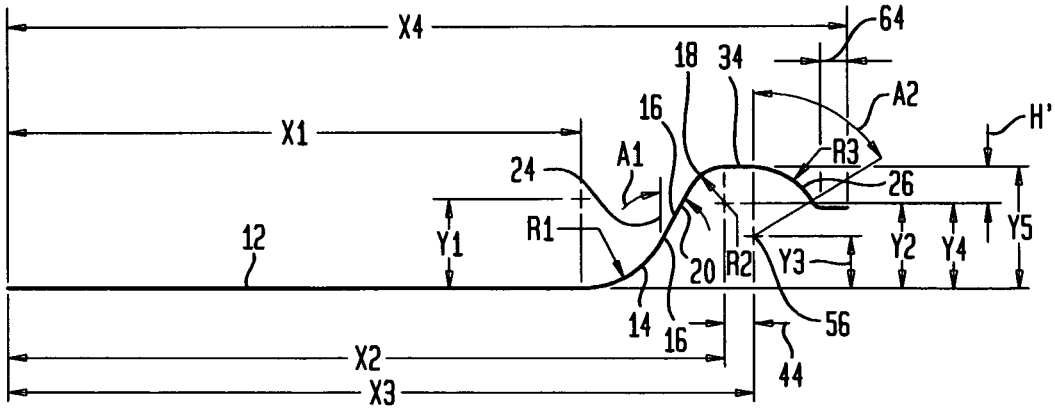
Figure 7A:
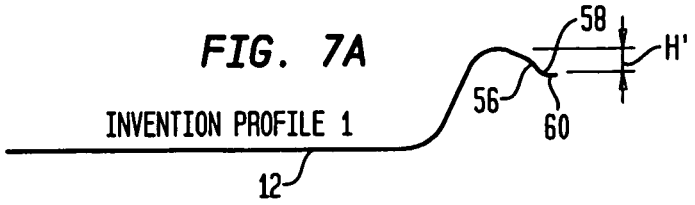
FIGS. 7A-7H are schematic diagrams showing profiles of plates of the invention and various other comparative plates.
Figure 7B:
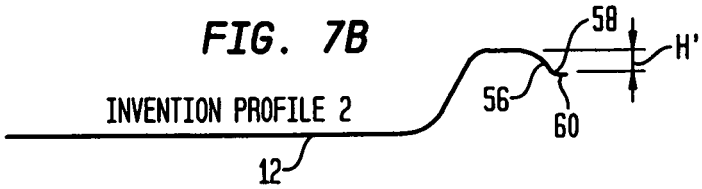
Figure 7C:
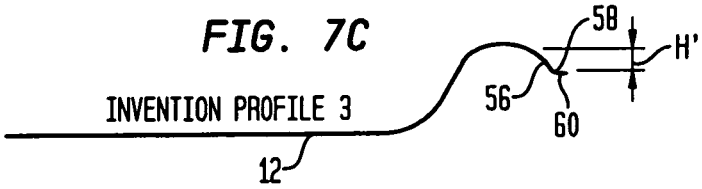
Figure 7D:
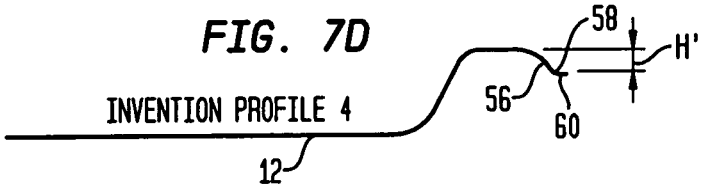
Figure 7E:
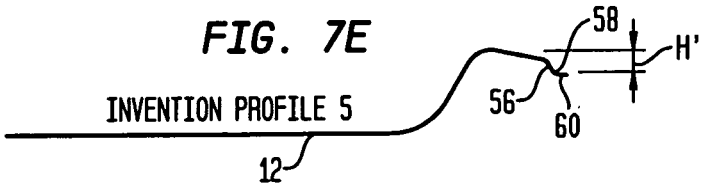
Figure 7F:
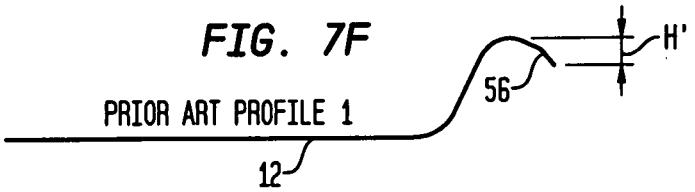
Figure 7G:
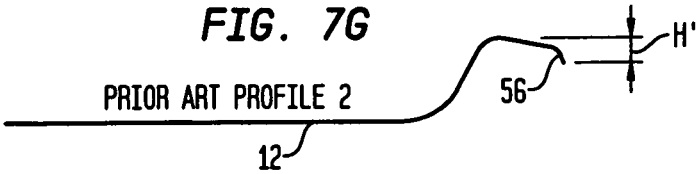
Figure 7H:
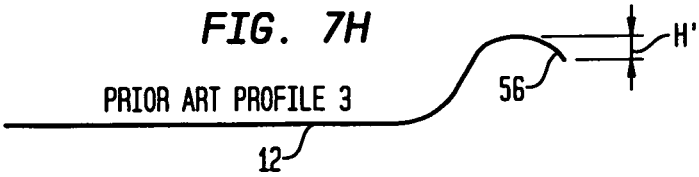

A disposable paper plate 10 having a characteristic diameter, D, generally includes a generally planar bottom portion 12, a first annular transition portion 14, a sidewall portion 16 as well as a second annular transition portion 18. The sidewall has a generally linear profile 20 between the first annular transition portion 14 and the second annular transition portion 18. Generally speaking, the inclined profile defines an angle of inclination, A1, with respect to a vertical 24 of from about 10 to about 40°. An outer arcuate flange portion 26 has an upper convex surface 28 and defines an outer radius of curvature, R3. There is optionally included an inner flange transition portion 34 linking outer arcuate flange portion 26 with second annular transition portion 18. The ratio of the outer radius of curvature, R3, of the outer arcuate flange portion to the characteristic diameter of the plate is generally from about 0.0175 to about 0.1. The angle of inclination, A1, of sidewall portion 16 about its linear portion 20 with respect to a vertical 24 is typically from about 10 to about 40° and preferably from about 25 to about 30°. Linear portion 20 of sidewall portion 16 extends over a length 21 from point A to point B along the sidewall portion as shown on FIG. 5 between the outermost part of transition portion 14 and the innermost portion of transition portion 18. Outer arcuate flange portion 26 typically extends downwardly with respect to the second annular transition portion 18. In typical embodiments, the outer arcuate flange portion terminates well below the height of the uppermost portions of second annular transition portion 18 as can be seen in FIGS. 5 and 6 in particular and defines a flange outer vertical drop or brim height as discussed hereafter.

The container shown is configured so that the outer radius of curvature, R3, is defined by an outer arcuate flange portion 26 over an included angle, A2, of from about 30° to about 80°. Typically included angle, A2, is from about 500 to about 75° or so.

In a typical embodiment where the containers are configured in accordance with the invention, first annular transition portion 14 defines a concave upper surface 36 defining an inner radius of curvature, R1. The ratio of the inner radius of curvature to the characteristic diameter of the disposable container is generally from about 0.014 to about 0.14. So also, the second annular transition portion typically defines a convex upper surface defining an intermediate radius of curvature, R2. The ratio of the intermediate radius of curvature to the characteristic diameter of the disposable food container is generally from about 0.014 to about 0.07.

The containers of the invention are pleated paperboard containers, being provided with a plurality of pleats such as pleats 40 about their entire periphery, extending from slightly above bottom portion 12 to the outer periphery of arcuate flange portion 26 preferably including evert portion 60 as is shown in the various Figures. In preferred embodiments, pressed paperboard containers of the invention are prepared from scored paperboard blanks.

The containers of the invention may be plates, bowls, platters, deep dish containers and so forth. When the containers of the present invention are disposable plates, the ratio of the height of the container, Y5, to the diameter of the plate, D, is from about 0.06 to about 0.12. As noted above plates of the invention may or may not include an inner flange portion 34. When an inner flange portion connecting the outer arcuate flange to the second annular transition portion of the container is provided, it characteristically defines a radial span 44 therebetween. The radial span of the inner flange portion is the horizontal distance between the end of the second annular transition portion and the beginning of the outer arcuate flange portion. This distance is shown as X3–X2 in FIG. 6. Typically the ratio of the radial span to the characteristic diameter of the container is from 0 to about 0.1. The inner flange portion may be horizontal over its radial span or may be inclined upwardly or downwardly, typically by +/−10 degrees or less with respect to a horizontal line parallel to the bottom of the container.

Figure 4A:
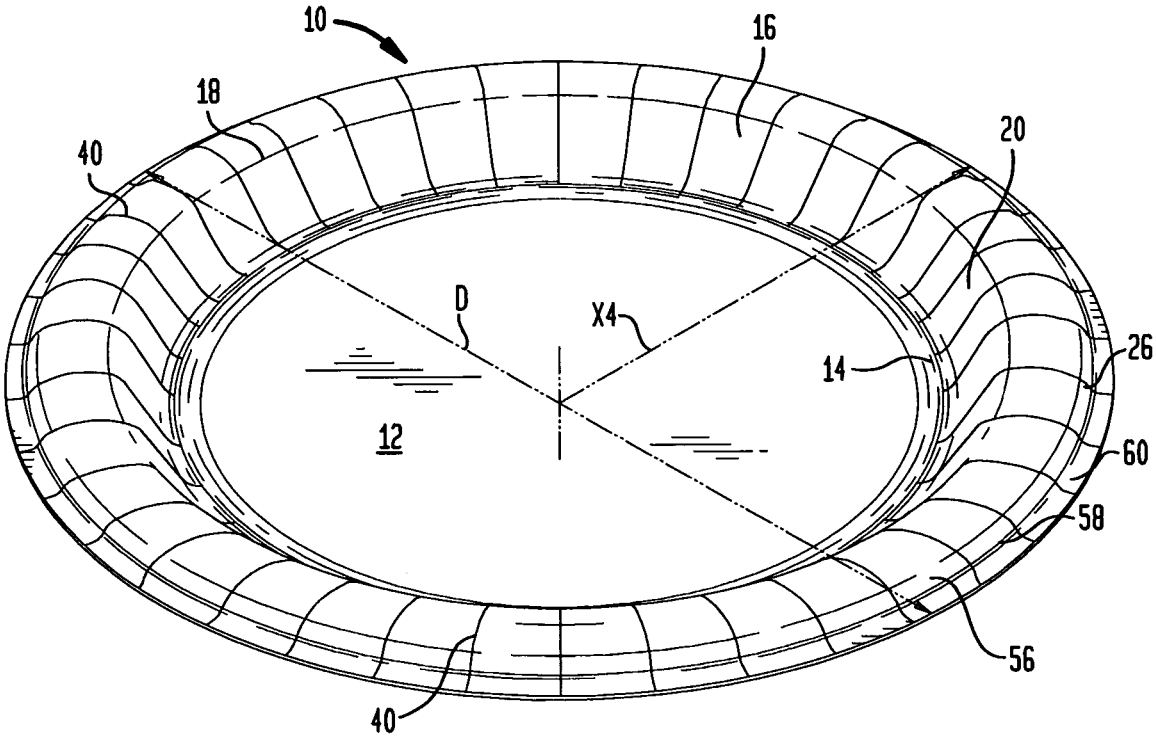
FIG. 4A is a view in perspective of another disposable plate configured in accordance with the present invention.
Figure 4B:
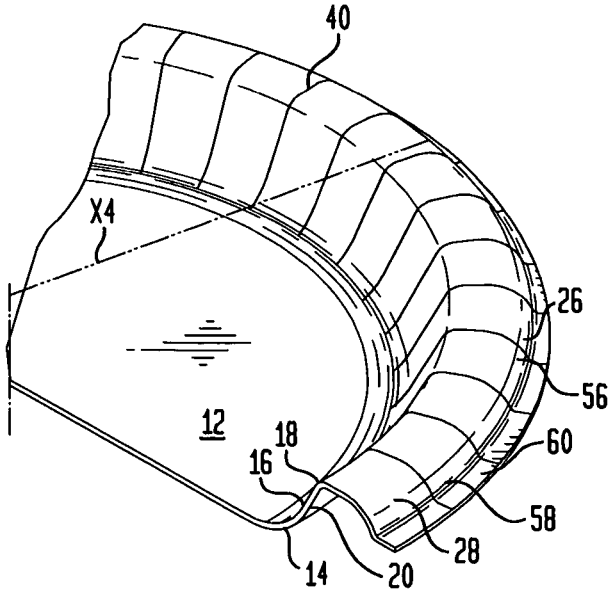
FIG. 4B is detail of the plate of FIG. 4A, partially in section, showing the profile from the center of the article.
Figure 4C:
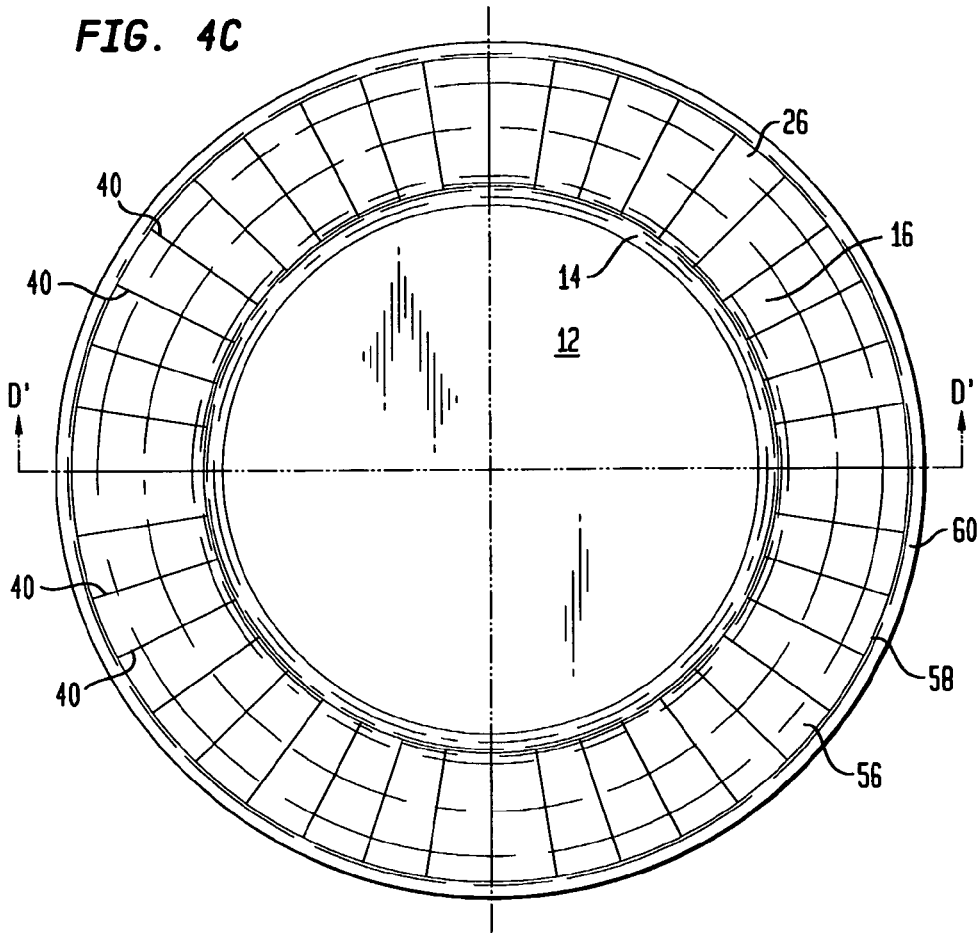
FIG. 4C is a top plan view of the plate of FIG. 4A.
Figure 4D:
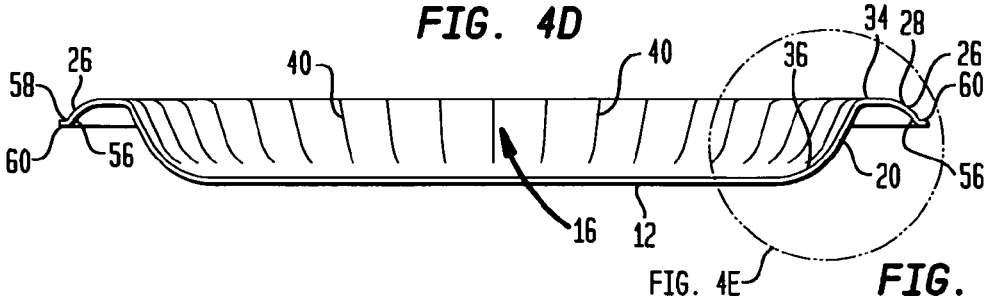
FIG. 4D is a view in elevation and section of the plate of FIGS. 4A, 4C along line D'-D' of FIG. 4C.
Figure 4E:
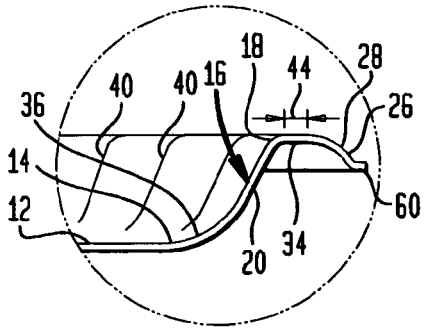
FIG. 4E is an enlarged detail illustrating the rim profile of the plate of FIGS. 4A-4D.

In FIGS. 5 and 6 there is shown in more detail the profile of the inventive container of FIG. 4A and following. In FIG. 5 there is shown in schematic cross section a portion 50 of a plate extending outwardly from its center 52 to its outermost periphery 54. The plate includes generally planar bottom portion 12, sidewall portion 16 with its inclined generally linear profile 20 over length 21 between the annular transition portions 14 and 18 as has been described hereinabove. There is further provided an inner horizontal flange portion 34 extending between second annular transition portion 18 and outer arcuate flange portion 26. The profile of FIG. 5 is shown schematically in FIG. 6 wherein the various parts and dimensions are labeled. Here again dimensions are generally given for the "die side" or lower surface of a plate manufactured in a press. While bottom portion 12 is generally planar, it may have a step contour ("gravy ring") or a crown of a few degrees or so. As is known in the art, such features help prevent the container from "rocking" when placed on a surface.

Here again, significant improvements include a brim transition portion 58 adjacent downwardly sloping brim portion 56 which transitions to an outwardly extending evert portion 60. The eversion angle β is as described above in connection with FIG. 2A and following and is suitably between about 35° and 70° or so.

There is shown in FIGS. 7A-7H profiles from center of plates of the invention as well as comparative profiles of other containers which are labeled as "Prior Art". In each instance, the brim height, H', the downwardly sloping portion 56 of the brim is labeled. For plates of the invention, brim transition 58 and outwardly extending evert 60 are also labeled. Invention Profile 4 is similar in many respects to Invention Profile 2 described above. Invention Profiles 3 and 5 are further detailed below.

Figure 8:
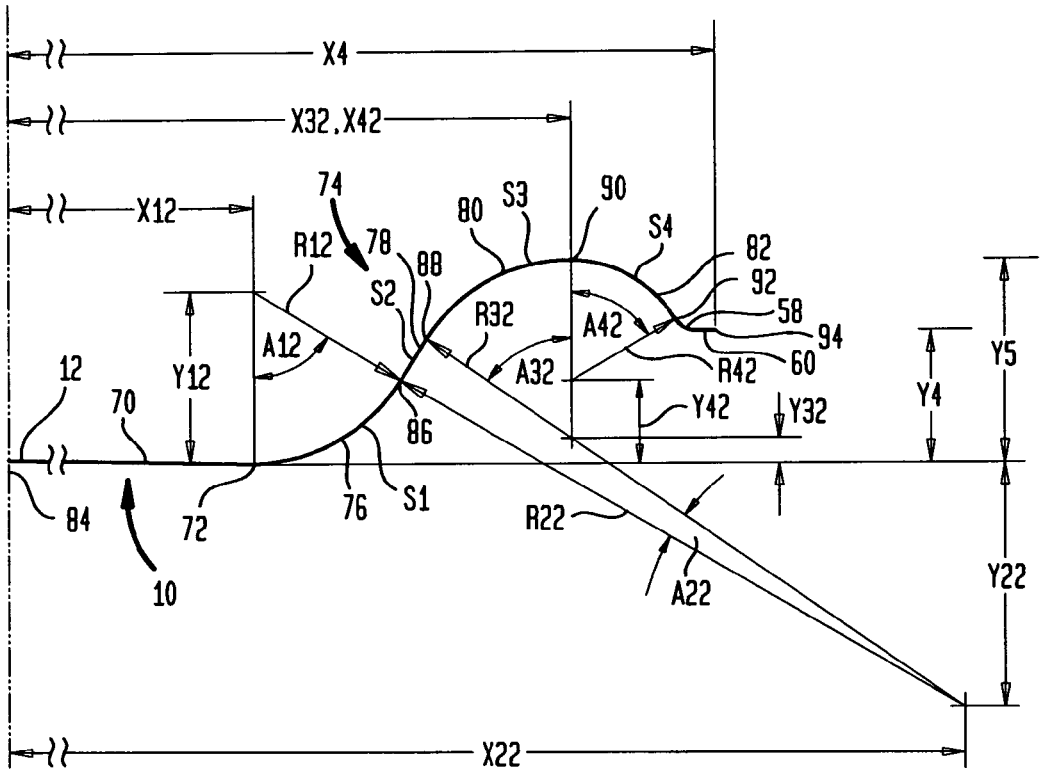
FIGS. 8 and 9 are schematic diagrams further illustrating profiles of plates of the invention.

Illustrated schematically in FIG. 8, there is a plate 10 having Invention Profile 3 which includes a planar center section 70 which, in turn, includes an outer peripheral surface 72. This center region 70 is generally planar, forming a bottom for plate 10. An outwardly projecting sidewall 74 includes a first rim portion 76 which is joined to the outer peripheral surface 72 of the planar center 70. A second rim portion 78 is joined to the first rim portion 76. The first rim portion 76 and the second rim portion 78 form, in part, the outwardly projecting sidewall 74 which forms the sidewall of the plate 10. Plate 10 includes a third rim portion 80 which is joined to the second rim portion 78 of the outwardly projecting sidewall 74. A fourth rim portion 82 is joined to the third rim portion 80. The fourth rim portion 82 forms the outer edge of the plate 10. The plate 10 defines a center line 84. The base or bottom-forming portion 12 extends from the center line 84 to outer peripheral surface 72.

From the center line 84 a predetermined distance, X12, extends toward the outer peripheral surface forming portion 72. A distance, Y12, extends a predetermined distance from the base or bottom-forming portion 12 upwardly therefrom. A radius, R12, extends from the intersection point of the distance, X12 and Y12 to form first rim portion 76 of the outwardly projecting sidewall 74. The first rim portion 76 is defined by an arc, A12, which extends from a substantially vertical line defined at the outer peripheral surface 72 to a fixed point 86. The arc, A12, may be approximately 60°.

A distance, X22, extends from the center line 84 to a predetermined point. A distance, Y22, extends from the base or bottom-forming portion 12 of the plate 10 downwardly a predetermined distance. A radius, R22, extends from the intersection of the lines X22 and Y22 to form a second rim portion 78 of the sidewall 74. The radius, R22, sweeps from the first fixed point 86 to a second fixed point 88 through an arc, A22. The arc, A22, may be approximately 4°.

A distance, X32, extends from the center line 84 to a predetermined distance. A distance, Y32, extends from the base or bottom-forming portion 12 of the plate 10 upwardly a predetermined distance. A radius, R32, extends from the intersection of the lines X32 and Y32 to form the third rim portion 80. The radius, R32, sweeps from the second fixed point 88 to a third fixed point 90. An arc, A32, is formed between the second fixed point 88 and the third fixed point 90 so that the arc extends a predetermined distance. The arc, A32, may be approximately 55°.

A distance, X42, extends a predetermined distance from the center line 84. Similarly, a distance, Y42, extends from the base or bottom-forming section 12 of the plate 10 upwardly a predetermined distance. A radius, R42, extends from the intersection of the lines X42 and Y42 to form a fourth rim portion 82 of the plate 10. An arc, A42, is formed between the third fixed point 90 and a fourth fixed point 92. The arc, A42, may be approximately 50°-60°. A perimeter 94 defines the outer edge of the plate.

Transition portion 58 is also located at 92 and evert 60 extends outwardly therefrom in a substantially horizontal direction as shown.

Salient features of the plate illustrated in FIG. 8 generally include a substantially planar center portion with four adjacent rim portions extending outwardly therefrom, each rim portion defining a radius of curvature as set forth above and further noted below. The first rim portion extends outwardly from the planar center portion and is convex upwardly as shown. There is defined by the plate a first arc, A12, with a first radius of curvature, R12, wherein the arc has a length, S1. A second rim portion is joined to the first rim portion and is downwardly convex, defining a second arc, A22, with a radius of curvature, R22, and a length, S2. A third, downwardly convex, rim portion is joined to the second rim portion and defines an arc, A32. There is thus defined a third radius of curvature, R32, and a third arc length, S3. A tangent to the third arc at the upper portion thereof (its outer edge) is substantially parallel to the planer center portion. A fourth rim portion is joined to the third rim portion, which is also downwardly convex. The fourth rim portion defines a fourth arc, A42, with a length, S4, with a radius of curvature, R42. Transition 58 adjoins the fourth rim portion and extends outwardly to evert 60.

The length of the second arc, S2, is generally less than the length of the fourth arc, S4, which, in turn, is less than the length, S1, of the first arc, A12. The radius of curvature, R42 of the fourth arc is less than the radius of curvature, R32, of the third rim portion, which in turn, is less than radius of curvature, R22, of the second rim portion. The angle of the first arc, A12, is generally greater than about 55 degrees, while, the angle of the third arc, A32, is generally greater than about 45 degrees. The angle of the fourth arc, A42, is generally less than about 75 degrees and more preferably is about 50-60 degrees.

Typically, the length, S1, of arc, A12, is equivalent to the length, S3, of arc, A32 and R12 of the first rim portion is equivalent in length to the radius of curvature, R32, of the third rim portion.

Generally speaking, the height of the center of curvature of the first arc (that is the origin of ray, R12) above the central planar portion is substantially less than, perhaps twenty five percent or so less than, the distance that the center of curvature of the second rim portion (the origin of ray, R22) is below the central planar portion. In other words, the length, Y12, is about 0.75 times or less the length, Y22.

So also, the horizontal displacement of the center of curvature of the second rim portion from the center of curvature of the first rim portion is at least about twice the length of the first radius of curvature, R12. The height of the center of curvature of the third rim portion above the central planar portion is generally less than the height of the center of curvature of the fourth rim portion above the plane of the central planar portion. The center of curvature of the second rim portion is generally outwardly disposed from the center of curvature of the third and fourth rim portions.

A further noteworthy feature of the plate of FIG. 8 is that the height of the center of curvature of the third rim portion above the planar central portion is less than about 0.3 times the radius of curvature, R42, of the fourth rim portion; while the height of the center of curvature of the fourth rim portion above the plane of the central portion is at least about 0.4 times the first radius of curvature, R12.

The ratio of the fourth radius of curvature to the diameter of the plate is preferably at least about 0.03, while the ratio of the third radius of curvature to the diameter of the plate is preferably at least about 0.050. The ratio of the second radius of curvature to the diameter of the plate is preferably at least about 0.2 and the ratio of the length of the first radius of curvature to the diameter of the plate is preferably at least about 0.045.

Figure 9:
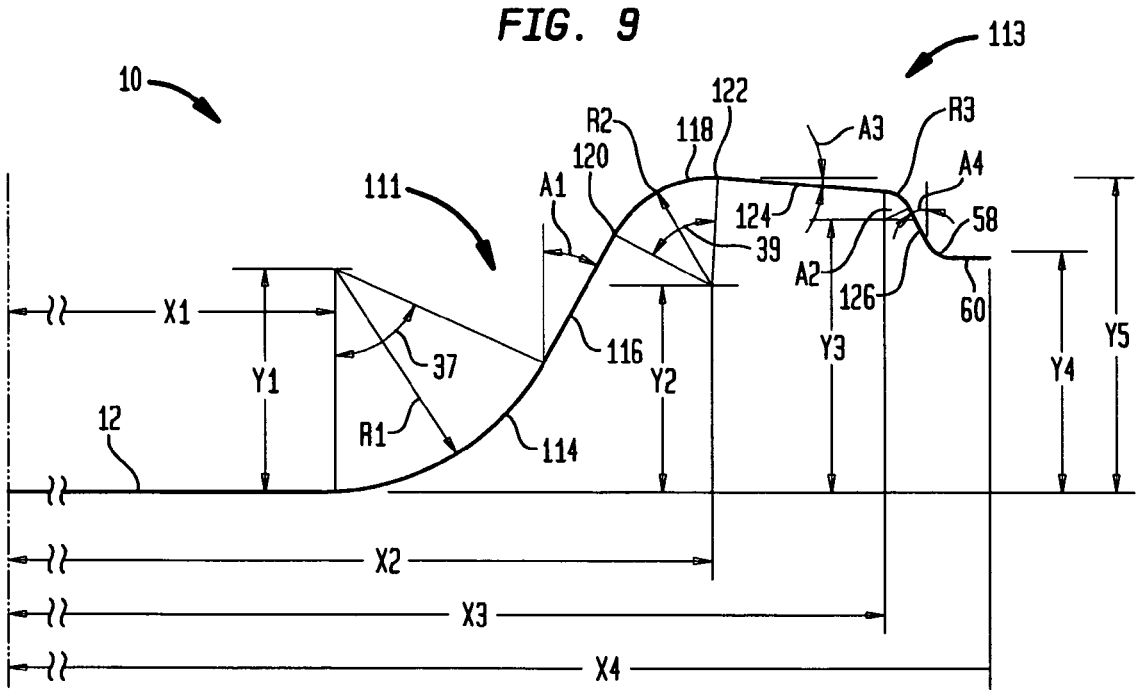

FIG. 9 is a diagrammatic view of the cross-section of the rigid paperboard container 10 having Invention Profile 5 beginning from the center line of the container. Throughout the following description, each of the dimensions are referenced with respect to a given diameter, D (twice X4), which in accordance with the present invention as illustrated in FIG. 9 is approximately 9 inches, e.g. 8⅝".

The planar inner region 12 in accordance with the illustrated embodiment has a radius X1 which is equal to approximately 0.3D-0.4D and preferably 0.342D. Adjoining an outer periphery of the planar inner region 12 is a sidewall portion 111 including annular region 114 having a radius of curvature equal to approximately 0.05D to 0.06D and preferably 0.0580D with the center point thereof being positioned a distance, Y1 from the planar inner region 12. Included angle 37 of the annular region 114 is from about 40° to about 70° and preferably about 60°-65° or approximately 62°. Adjoining the periphery of the annular region 114 is the first frusto-conical region 116 which slopes upwardly at an angle A1 with respect to the vertical from about 20° to about 35° and preferably about 25°-30° or approximately 27.5°. Additionally, the frusto-conical region 116 is of a length greater than about 0.015D, preferably from about 0.025D to 0.05D and more preferably approximately 0.037D. Further, adjoining the first frusto-conical region 116 is the arcuate annular region 118 which includes a radius of curvature in the range of 0.015D to 0.03D and preferably approximately 0.024D with the center point thereof being positioned a distance Y2' from the planar inner region 12. The included angle 39 of the arcuate annular region 118 may range from about 61° to about 82° and is preferably 66°-77° or about 73°. The second portion 122 of the arcuate annular region 118, that is, the distal portion of the arcuate annular region 118, is positioned such that a line tangent to the curvature of the arcuate annular region 118 at the second portion 122 slopes downwardly and outwardly at an angle of approximately 6° to 12° and preferably approximately 10.5° relative to horizontal. Alternatively, a tangent could be horizontal at 122.

With the embodiment of FIG. 9, it is critical that the combination of the annular region 114 and arcuate annular region 118 combine to position the second portion 122 of the arcuate annular region 118 in the manner set forth hereinabove. That is, the included angle 37 of the annular region 114 when combined with the included angle 39 of the arcuate annular region 118 with the first frusto-conical region 116 spanning therebetween, positions the second portion 122 of the arcuate annular region 118 in a manner such that second frusto-conical region 124, which extends substantially tangentially from the distal end of the second portion 122 of the arcuate annular region 118 extends outwardly and downwardly at an angle of about 6° to 12° and preferably about 10.5° relative to horizontal. The second frusto-conical region 124 is of a length in a range from about 0.03D to about 0.05D and is preferably 0.04D. Because the second frusto-conical region 124 extends substantially tangentially from the second portion 122 of the arcuate annular region 118, the second frusto-conical region 124 extends outwardly and downwardly at an angle in the range from approximately 6° to 12° and preferably extends at an angle A3 of approximately 10.5° with respect to a horizontal plane formed by the planar inner region 12.

Adjoining an outer periphery of the second frusto-conical region 124 is the lip 126 which is in the form of yet another frusto-conical region which extends outwardly and downwardly from the second frusto-conical region 124. The lip 126 is of a length of at least 0.003D and is preferably approximately 0.005D. Further, the lip 126 extends at an angle A4 of no more than 45° from vertical, preferably approximately 15° to 30° with respect to the vertical plane and more preferably approximately 22.5°.

At the transition between the second frusto-conical region 124 and the lip 126 is a transition region The transition region includes a radius of curvature, R2, which is in the range of about 0.008D and 0.01D and is preferably approximately 0.009D with the center point thereof being positioned a distance, Y3, from the planar inner region 12. Additionally, the transition region has an included angle, A2, of approximately 48° to 70° and preferably approximately 57°. Transition 58 adjoins lip 126 and extends outwardly therefrom in a substantially horizontal direction to evert portion 60.

Dimensions, ratios thereof, angles and ranges thereof for selected plates of the invention are given in Tables 1 and 2 below.

TABLE 1

| Characteristic Dimensions and Angles (Die Side Dimensions) | | | | | | | |
|---|---|---|---|---|---|---|---|
| Ratio or Angle | Typical Value Invention Profile 1 | Typical Value Invention Profile 1A | Typical Value Invention Profile 2 | Typical Value Invention Profile 4 | Typical Value Invention Profile 5 | Preferred Range | General Range |
| R3/D | 0.046 | 0.046 | 0.043 | 0.043 | 0.009 | 0.008 to 0.07 | 0.005 to 0.1 |
| A1, Degrees | 24.2 | 27.5 | 27.5 | 27.5 | 27.5 | 20 to 30 | 10 to 50 |
| A2, Degrees | 55 | 55 | 55 | 55 | 57 | 45 to 75 | 30 to 80 |
| R2/D | 0.026 | 0.026 | 0.022 | 0.022 | 0.024 | 0.020 to 0.035 | 0.014 to 0.07 |
| Y5/D | 0.091 | 0.091 | 0.077 | 0.077 | 0.077 | — | — |
| (Y5 – Y4)/D | 0.02 | 0.02 | .02 | 0.02 | 0.02 | 0.015 to 0.035 | 0.01 to 0.050 |

TABLE 2

| Typical Die Side Dimensions and Angles for 9" Plates | | | | | | | |
|---|---|---|---|---|---|---|---|
| Dimension or Angle (Inches or Degrees) | Typical Val. Invention Profile 1 | Typical Val. Invention Profile 1A | Typical Value Invention Profile 2 | Typical Value Invention Profile 4 | Typical Value Invention Profile 5 | Preferred Range | General Range |
| A1 | 24.2 | 27.5 | 27.5 | 27.5 | 27.5 | 20 to 30 | 10 to 50 |
| A2 | 55 | 55 | 55 | 55 | 57 | 45 to 75 | 30 to 80 |
| R1 | 0.3657 | 0.3657 | 0.3750 | 0.3750 | 0.5006 | 0.25 to 0.75 | 0.12 to 1.20 |
| R2 | 0.2200 | 0.2200 | 0.1875 | 0.1875 | 0.2075 | 0.17 to 0.30 | 0.12 to 0.60 |
| R3 | 0.3950 | 0.3950 | 0.3741 | 0.3741 | 0.0805 | 0.07 to 0.60 | 0.04 to 0.86 |
| X1 | 3.0403 | 3.0265 | 3.0235 | 2.9529 | 2.9513 | 2.90 to 3.20 | 2.80 to 3.30 |
| X2 | 3.7661 | 3.7837 | 3.7104 | 3.6398 | 3.7266 | 3.70 to 4.10 | 3.50 to 4.30 |
| X3 | 3.7661 | 3.7837 | 3.8679 | 3.8679 | 4.0880 | 3.70 to 4.10 | 3.50 to 4.30 |
| Y1 | 0.3657 | 0.3657 | 0.3750 | 0.3750 | 0.5006 | 0.25 to 0.75 | 0.12 to 1.20 |
| Y2 | 0.5518 | 0.5518 | 0.4763 | 0.4763 | 0.4563 | 0.35 to 0.60 | 0.07 to 0.88 |
| Y3 | 0.3768 | 0.3768 | 0.2897 | 0.2897 | 0.5185 | 0.00 to 0.60 | −0.36 to 0.85 |
| Y4 | 0.6014 | 0.6013 | 0.5036 | 0.5036 | 0.5091 | 0.20 to 0.80 | 0.10 to 0.95 |
| Y5 | 0.7718 | 0.7718 | 0.6638 | 0.6638 | 0.6638 | 0.60 to 0.80 | 0.50 to 1.00 |

Consumer Perception

Various plates of the invention having profiles shown in FIGS. 7A-7H were compared with plates having corresponding Comparative Profiles for consumer perception. A panel was asked at a first station to examine the plates visually only and rank the plates on a scale of 0 to 5 as to how they believed the plates would meet their needs. In this scale, a zero indicates a rating that least meets needs and a 5 indicates a product rating that best meets needs. At a second station, the panel was asked to examine the plates visually only and rank the plates on perceived strength. At a third station, the panel was asked to physically examine the plates and rate them for strength; at this station no load was on the plate. At a fourth station, the plates were provided with a 430 gram (simulated food) load, examined physically and again evaluated for strength; and finally the panel evaluated the plates for overall preference at a fifth station where the plates were visually and physically examined while provided with a 430 gram load.

Figure 10:
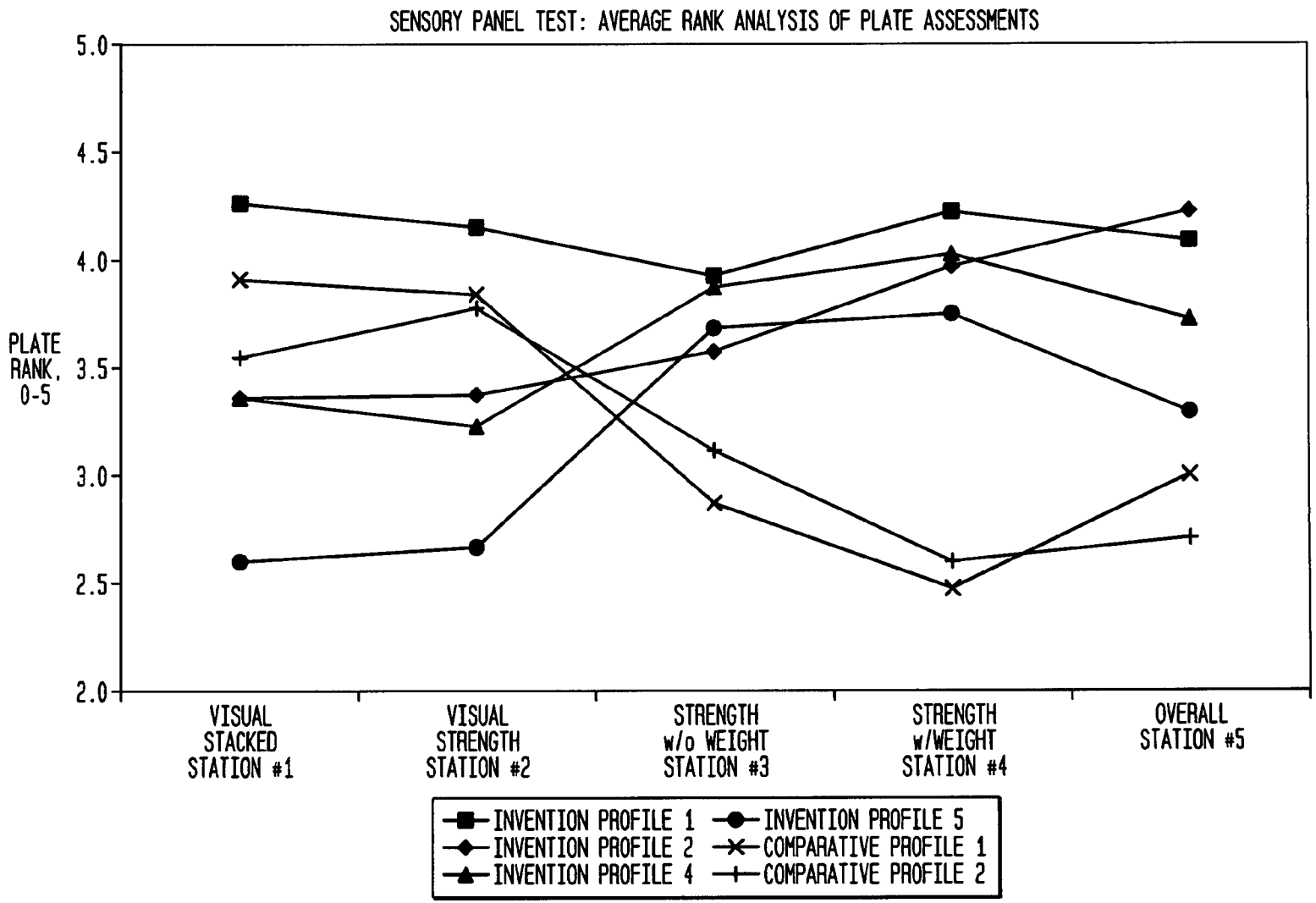
FIG. 10 is a plot of sensory panel test data relating to plates of the invention and various other plates.

Results appear in FIG. 10.

It is noteworthy that plates of Invention Profile 1 were consistently rated as highest or nearly highest at all stations. Perhaps even more significant is that while the plates having Comparative Profiles 1 and 2 were rated among the highest when examined visually only, the plates of the invention were rated consistently much higher than comparative plates when physically examined. The results of FIG. 10 demonstrate the improved Rigidity and Rim Stiffness of the inventive plates and are consistent with the observed physical testing, described below.

Rigidity and Rim Stiffness

Plates of the invention and plates of like design with and without an outer evert portion were tested for SSI Rigidity and Rim Stiffness. Rigidity is expressed in grams/0.5 inches and is measured with the Single Service Institute Plate Rigidity Tester of the type originally available through Single Service Institute, 1025 Connecticut Ave., N.W., Washington, D.C. The SSI rigidity test apparatus has been manufactured and sold through Sherwood Tool, Inc., Kensington, Conn. This test is designed to measure the rigidity (i.e., resistance to buckling and bending) of paper and plastic plates, bowls, dishes, and trays by measuring the force required to deflect the rim of these products a distance of 0.5 inch while the product is supported at its geometric center. Specifically, the plate specimen is restrained by an adjustable bar on one side and is center supported. The rim or flange side opposite to the restrained side is subjected to 0.5 inch deflection by means of a motorized cam assembly equipped with a load cell, and the force (grams) is recorded. The test simulates in many respects the performance of a container as it is held in the hand of a consumer, supporting the weight of the container's contents. SSI rigidity is expressed as grams per 0.5 inch deflection. A higher SSI value is desirable since this indicates a more rigid product. All measurements were done at standard TAPPI conditions for paperboard testing, 72° F. and 50% relative humidity. Geometric mean averages (square root of the MD/CD product) values are reported herein.

The particular apparatus employed for SSI rigidity measurements was a Model No. ML-4431-2 SSI rigidity tester as modified by Georgia-Pacific Corporation, National Quality Assurance Lab, Lehigh Valley Plant, Easton, Pa. 18040 using a Chatillon gauge available from Chatillon, Force Measurements Division, P.O. Box 35668, Greensboro, N.C. 27425-5668.

Rim Stiffness is a measure of the local rim strength about the periphery of the container as opposed to overall or SSI rigidity. This test has been noted to correlate well with actual consumers' perception of product sturdiness. SSI rigidity is one measure of the load carrying capability of the plate, whereas Rim Stiffness often relates to what a consumer feels when flexing a plate to gauge its strength. (Plates with higher Rim Stiffness have also demonstrated greatly improved weight carrying capabilities under simulated use testing, described hereinafter.) Preferably, specimens are conditioned and testing performed at standard conditions for paperboard testing when a paper container is tested, 72° F. and 50% relative humidity.

Figure 11:
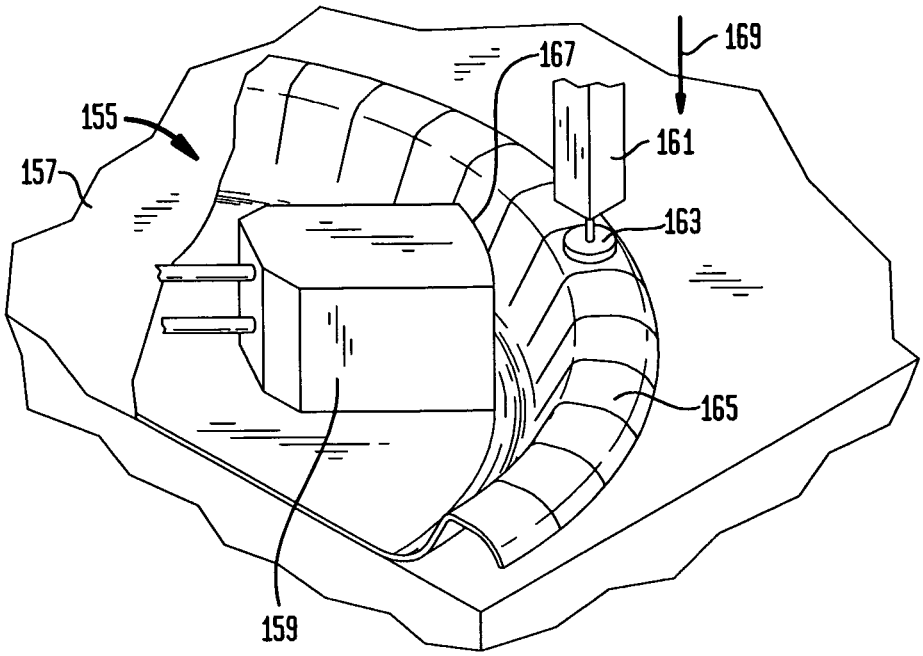
FIG. 11 is a schematic diagram illustrating a portion of an apparatus for determining Rim Stiffness.

The particular apparatus employed is referred to as a Rim Stiffness instrument, developed by Georgia-Pacific Corporation, Neenah Technical Center, 1915 Marathon Avenue, Neenah, Wis. 54956. This instrument includes a micrometer which reads to 0.001 inch available from Standard Gage Co., Inc., 70 Parker Avenue, Poughkeepsie, N.Y. 12601, as well as a load gauge available from Chatillon, Force Measurements Division, P.O. Box 35668, Greensboro, N.C. 27425-5688. The test procedure measures the force to deflect the rim downwardly 0.1 inch as the specimen is restrained about its bottom between a platen and a restraining member as will be further appreciated by reference to FIG. 11.

Rim Stiffness instrument 155 includes generally a platen 157, a plurality of restraining members, preferably four equally spaced restraining members such as member 159 and a gauge 161 provided with a probe 163. A specimen such as plate 165 is positioned as shown and clamped tightly about its planar bottom portion to platen 157 by way of restraining members, such as member 159. The specimen is clamped over an area of several square inches or so such that the bottom of the specimen is fully restrained inwardly from the first transition portion. Note that restraining member 159 is disposed such that its outer edge 167 is positioned at the periphery of the serving area of the container, that is, at X1 in FIG. 3, the radius of the bottom of the container.

Probe 163 is then advanced downwardly in the direction of arrow 169 a distance of 0.1 inch while the force is measured and recorded by gauge 161. Only the maximum force is recorded, typically occurring at the maximum deflection of 0.1 inch. Probe 163 is preferably positioned in the center of the flange of plate 165 or on a high point of the flange as appropriate. The end of the probe may be disk-shaped or of other suitable shape and is preferably mounted on a universal-type joint so that contact with the rim is maintained during testing. Probe 163 is generally radially aligned with restraining clamp member 159.

Results comparing Rigidity and Rim Stiffness of plates of the invention with comparative plates of like design in some cases appear in Table 3 below. Comparative Profile 2 is used as a reference for Invention Profile 2 as well as a reference for the plates of Invention Profiles 4 and 5. Comparative Profile 1 is used as a reference for Invention Profile 1. In Table 3, 206#, 180# and 163# refer to the basis weight, in lbs per 3000 square foot ream, of the paperboard from which the containers were formed. In all cases, a 9.375" diameter paperboard blank was used.

It is seen in the tables that adding an outer evert in accordance with the invention concurrently increases the Rigidity and Rim Stiffness of a plate design. That is, a "like" plate of substantially the same shape, blank diameter and caliper has surprisingly higher Rigidity and Rim Stiffness when an outer evert is added thereto.

TABLE 3

Comparison of Nominal 9" Pressed Paperboard Plates

| Description | Plate SSI Rigidity (grams) | Plates SSI Rigidity % Change vs. Ref. | Rim Stiffness (grams) | Rim Stiffness % Change vs. Ref. | Plate Diameter (inches) | Plate Height (Inches) | Stack Height 25 ct (inches) | Stack Height 125 ct (inches) |
|---|---|---|---|---|---|---|---|---|
| Comparative Profile 1 - 206# plates | 373 | 206# Ref. 1 | 1852 | 206# Ref. 1 | 8.500 | 0.776 | 1.889 | 6.346 |
| Invention Profile 1 - 206# plates | 459 | +23% | 2348 | +27% | 8.521 | 0.770 | 1.885 | 6.370 |
| Comparative Profile 2 - 206# plates | 450 | 206# Ref. 2 | 1223 | 206# Ref. 2 | 8.671 | 0.655 | 1.701 | 5.578 |
| Invention Profile 2 - 206# plates | 521 | +16% | 2132 | +74% | 8.669 | 0.665 | 1.623 | 5.585 |
| Invention Profile 4 - 206# plates | 557 | +24% | 1404 | +15% | 8.678 | 0.667 | 1.685 | 5.700 |
| Invention Profile 5 - 206# plates | 550 | +22% | 1280 | +5% | 8.728 | 0.656 | 1.633 | 5.578 |
| Comparative Profile 1 - 180# plates | 250 | 180# Ref. 1 | 1326 | 180# Ref. 1 | 8.479 | 0.759 | 1.798 | 5.913 |
| Invention Profile 1 - 180# plates | 318 | +27% | 1614 | +22% | 8.508 | 0.767 | 1.841 | 5.986 |
| Comparative Profile 2 - 180# plates | 300 | 180# Ref. 2 | 1018 | 180# Ref. 2 | 8.658 | 0.652 | 1.569 | 5.395 |
| Invention Profile 2 - 180# plates | 381 | +27% | 1412 | +39% | 8.674 | 0.667 | 1.629 | 5.296 |
| Invention Profile 4 - 180# plates | 349 | +16% | 1311 | +29% | 8.676 | 0.668 | 1.596 | 5.177 |
| Invention Profile 5 - 180# plates | 352 | +17% | 904 | −11% | 8.728 | 0.656 | 1.568 | 5.204 |
| Comparative Profile 1 - 163# plates | 232 | 163# Ref. 1 | 1261 | 163# Ref. 1 | 8.471 | 0.749 | 1.704 | 5.534 |
| Invention Profile 1 - 163# plates | 295 | +27% | 1600 | +27% | 8.506 | 0.767 | 1.715 | 5.536 |
| Comparative Profile 2 - 163# plates | 288 | 163# Ref. 2 | 774 | 163# Ref. 2 | 8.659 | 0.652 | 1.562 | 5.044 |
| Invention Profile 2 - 163# plates | 341 | +18% | 1354 | +75% | 8.663 | 0.665 | 1.495 | 4.738 |

TABLE 3-continued

| Comparison of Nominal 9" Pressed Paperboard Plates | | | | | | | | |
|---|---|---|---|---|---|---|---|---|
| Description | Plate SSI Rigidity (grams) | Plates SSI Rigidity % Change vs. Ref. | Rim Stiffness (grams) | Rim Stiffness % Change vs. Ref. | Plate Diameter (inches) | Plate Height (Inches) | Stack Height 25 ct (inches) | Stack Height 125 ct (inches) |
| Invention Profile 4 - 163# plates | 364 | +26% | 1252 | +62% | 8.669 | 0.670 | 1.543 | 5.051 |
| Invention Profile 5 - 163# plates | 340 | +18% | 873 | +13% | 8.710 | 0.658 | 1.506 | 5.062 |

Load to Failure Testing

Plates of the present invention having the Invention Profile 1A were tested for their ability to support a simulated food load and compared with plates having shapes disclosed in U.S. Pat. No. 5,326,020 to Cheshire et al. (Comparative Profile 2). Load to failure testing involved holding the plate at one side (1 hand test) or on two sides (two hand test) and loading the plate with simulated plastic food (1 hand test) or bean bags (two hand test) until failure occurred. The load causing failure is reported as the maximum load; "failure" being determined as the point at which the plate buckled or otherwise could not support the load. Details and results appear in Table 4 below.

While this test is somewhat more qualitative than those noted above for Rigidity and Rim Stiffness, results again show that the plates of the invention are significantly stronger than plates of like basis weight of the prior art.

TABLE 4

| Load to Failure Testing | |
|---|---|
| | Maximum Load (lbs) |
| A. One Hand Testing/Plate Description | |
| 9" Nominal Comparative Profile 2, 206 lb/ream basis weight | 1.9-2.2 |
| 9" Nominal Invention Profile 1A, 206 lb/ream basis weight | 2.5-2.75 |
| 10" Nominal Comparative Profile 2, 220 lb/ream basis weight | 2.0-2.4 |
| 10" Nominal Invention Profile 1A, 220 lb/ream basis weight | 2.8-3.1 |
| B. Two Hand Testing/Plate Description | |
| 9" Nominal Comparative Profile 2, 206 lb/ream basis weight | 5.25-5.75 |
| 9" Nominal Invention Profile 1A, 206 lb/ream basis weight | 8.5 |
| 10" Nominal Comparative Profile 2, 220 lb/ream basis weight | 5.75 |
| 10" Nominal Invention Profile 1A, 220 lb/ream basis weight | 9.5 |

Fabrication

The present invention typically employs segmented dies generally as is known and further discussed herein. Manufacture from coated paperboard is preferred. Clay coated paperboard is typically printed, coated with a functional grease/water resistant barrier and moistened prior to blanking and forming. The printed, coated and moistened paperboard roll is then transferred to a web fed press where the blanks are cut in a straight across, staggered, or nested pattern (to minimize scrap). The blanks are transferred to the multi-up forming tool via individual transfer chutes. The blanks will commonly hit against blank stops (rigid or pin stops that can rotate) for final positioning prior to forming. The stop heights and locations are chosen to accurately locate the blank and allow the formed product to be removed from the tooling without interference. Typically the inner portions of the blank stops or inner blank stops are lower in height since the formed product must pass over them.

Instead of web forming, blanks could be rotary cut or reciprocally cut off-line in a separate operation. The blanks could be transferred to the forming tooling via transfer chutes using a blank feed style press. The overall productivity of a blank feed style press is typically lower than a web feed style press since the stacks of blanks must be continually inserted into the feed section, the presses are commonly narrow in width with fewer forming positions available; and the forming speeds are commonly less since fluid hydraulics are typically used versus mechanical cams and gears.

As noted, the blank is positioned by rigid or rotating pin stops as well as by side edge guides that contact the blank diameter. The punch pressure ring contacts the blank, clamping it against the lower draw ring and optional relief area to provide initial pleating control. The upper punch and lower die knock-outs (that may have compartment ribs machined into them) then contact the paperboard holding the blank on center. The upper knock-out is sometimes an articulated style having 0.030 inch to 0.120 inch articulation stroke during the operation. The pressure ring may have the outer product profile machined into it and provides further pleating control by clamping the blank between its profile area and die outer profile during the formation. The draw ring and pressure ring springs typically are chosen in a manner to allow full movement of the draw ring prior to pressure ring movement (i.e., full spring force of draw ring is less than or equal to the pre-load of the pressure ring springs).

The following co-pending patent applications contain further information as to materials, processing techniques and equipment and are also incorporated by reference: U.S. Pat. No. 6,715,630, entitled "Disposable Food Container With A Linear Sidewall Profile and an Arcuate Outer Flange"; U.S. Pat. No. 6,733,852, entitled "Disposable Serving Plate With Sidewall-Engaged Sealing Cover"; U.S. Pat. No. 6,474,497, entitled "Smooth Profiled Food Service Article"; U.S. application Ser. No. 10/004,874, entitled "High Gloss Disposable Pressware", now U.S. Pat. No. 6,893,693; U.S. application Ser. No. 09/978,484, entitled "Deep Dish Disposable Pressed Paperboard Container", now U.S. Pat. No. 7,048,176; U.S. Pat. No. 6,585,506, entitled "Side Mounted Temperature Probe for Pressware Die Set"; U.S. Pat. No. 6,592,357, entitled "Rotating Inertial Pin Blank Stops for Pressware Die Set"; U.S. Pat. No. 6,589,043, entitled "Punch Stripper Ring Knock-Out for Pressware Die Sets"; and U.S. application Ser. No. 10/600,814, entitled "Disposable Servingware Containers with Flange Tabs", now U.S. Pat. No. 7,337,943. See also, U.S. Pat. No. 5,249,946; U.S. Pat. No. 4,832,676; U.S. Pat. No. 4,721,500; and U.S. Pat. No. 4,609,140, which are particularly pertinent.

The product of the invention is advantageously formed with a heated matched pressware die set utilizing inertial rotating pin blank stops as described in co-pending application U.S. Ser. No. 09/653,577, filed Aug. 31, 2000. For paperboard plate stock of conventional thicknesses in the range of from about 0.010 to about 0.040 inches, the springs upon which the lower die half is mounted are typically constructed such that the full stroke of the upper die results in a force applied between the dies of from about 6000 to 14,000 pounds or higher. Similar forming pressures and control thereof may likewise be accomplished using hydraulics as will be appreciated by one of skill in the art. The paperboard which is formed into the blanks is conventionally produced by a wet laid paper making process and is typically available in the form of a continuous web on a roll. The paperboard stock is preferred to have a basis weight in the range of from about 100 pounds to about 400 pounds per 3000 square foot ream and a thickness or caliper in the range of from about 0.010 to about 0.040 inches as noted above. Lower basis weight paperboard is preferred for ease of forming and to save on feedstock costs. Paperboard stock utilized for forming paper plates is typically formed from bleached pulp fiber and is usually double clay coated on one side. Such paperboard stock commonly has a moisture (water content) varying from about 4.0 to about 8.0 percent by weight.

The effect of the compressive forces at the rim is greatest when the proper moisture conditions are maintained within the paperboard: at least 8% and less than 12% water by weight, and preferably 9.0 to 10.5%. Paperboard having moisture in this range has sufficient moisture to deform under pressure, but not such excessive moisture that water vapor interferes with the forming operation or that the paperboard is too weak to withstand the forces applied. To achieve the desired moisture levels within the paperboard stock as it comes off the roll, the paperboard is treated by spraying or rolling on a moistening solution, primarily water, although other components such as lubricants may be added. The moisture content may be monitored with a hand held capacitive type moisture meter to verify that the desired moisture conditions are being maintained or the moisture is monitored by other suitable means, such as an infra-red system. It is preferred that the plate stock not be formed for at least six hours after moistening to allow the moisture within the paperboard to reach equilibrium.

Because of the intended end use of the products, the paperboard stock is typically impregnated with starch and coated on one side with a liquid proof layer or layers comprising a press-applied, water-based coating applied over the inorganic pigment typically applied to the board during manufacturing. Carboxylated styrene-butadiene resins may be used with or without filler if so desired. In addition, for esthetic reasons, the paperboard stock is often initially printed before being coated with an overcoat layer. As an example of typical coating material, a first layer of latex coating may be applied over the printed paperboard with a second layer of acrylic coating applied over the first layer. These coatings may be applied either using the conventional printing press used to apply the decorative printing or may be applied using some other form of a conventional press coater. Preferred coatings utilized in connection with the invention may include 2 pigment (clay) containing layers, with a binder, of about 6 lbs/3000 $ft^2$ ream or so followed by 2 acrylic layers of about 0.5-1 lbs/3000 $ft^2$ ream. The clay containing layers are provided first during board manufacture and the acrylic layers are then applied by press coating methods, i.e., gravure, coil coating, flexographic methods and so forth as opposed to extrusion or film laminating methods which are expensive and may require off-line processing as well as large amounts of coating material. An extruded film, for example, may require 25 lbs/3000 $ft^2$ ream.

A layer comprising a latex may contain any suitable latex known to the art. By way of example, suitable latexes include styrene-acrylic copolymer, acrylonitrile styrene-acrylic copolymer, polyvinyl alcohol polymer, acrylic acid polymer, ethylene vinyl alcohol copolymer, ethylene-vinyl chloride copolymer, ethylene vinyl acetate copolymer, vinyl acetate acrylic copolymer, styrene-butadiene copolymer and acetate ethylene copolymer. Preferably, the layer comprising a latex contains styrene-acrylic copolymer, styrene-butadiene copolymer, or vinyl acetate-acrylic copolymer. More preferably, the layer comprising a latex contains vinyl acetate ethylene copolymer. A commercially available vinyl acetate ethylene copolymer is "AIRFLEX® 100 HS" latex. ("AIRFLEX® 100 HS" is a registered trademark of Air Products and Chemicals, Inc.) Preferably, the layer comprising a latex contains a latex that is pigmented. Pigmenting the latex increases the coat weight of the layer comprising a latex thus reducing runnability problems when using blade cutters to coat the substrate. Pigmenting the latex also improves the resulting quality of print that may be applied to the coated paperboard. Suitable pigments or fillers include kaolin clay, delaminated clays, structured clays, calcined clays, alumina, silica, aluminosilicates, talc, calcium sulfate, ground calcium carbonates, and precipitated calcium carbonates. Other suitable pigments are disclosed, for example, in Kirk-Othmer, Encyclopedia of Chemical Technology, Third Edition, Vol. 17, pp. 798, 799, 815, 831-836. Preferably the pigment is selected from the group consisting of kaolin clay and conventional delaminated coating clay. An available delaminated coating clay is "HYDRAPRINT" slurry, supplied as a dispersion with a slurry solids content of about 68%. "HYDRAPRINT" slurry is a trademark of Huber. The layer comprising a latex may also contain other additives that are well known in the art to enhance the properties of coated paperboard. By way of example, suitable additives include dispersants, lubricants, defoamers, film-formers, antifoamers and crosslinkers. By way of example, "DISPEX N-4" is one suitable organic dispersant and comprises a 40% solids dispersion of sodium polycarboxylate. "DISPEX N-40" is a trademark of Allied Colloids. By way of example, "BERCHEM 4095" is one suitable lubricant and comprises 100% active coating lubricant based on modified glycerides. "BERCHEM 4095" is a trademark of Bercen. By way of example, "Foamaster DF-177NS" is one suitable defoamer. "Foamaster DF-122 NS" is a trademark of Henkel. In a preferred embodiment, the coating comprises multiple layers that each comprise a latex.

Typically paperboard for containers contains up to about 6% starch; however, the rigidity can be considerably enhanced by using paperboard with from about 9 to about 12 weight percent starch. See U.S. Pat. Nos. 5,938,112 and 5,326,020, the disclosures of which are incorporated herein by reference.

The stock is moistened on the uncoated side after all of the printing and coating steps have been completed. In a typical forming operation the web of paperboard stock is fed continuously from a roll through a scoring and cutting die to form the blanks which are scored and cut before being fed into position between the upper and lower die halves. The die halves are heated as described above, to aid in the forming process. It has been found that best results are obtained if the upper die half and lower die half—particularly the surfaces thereof—are maintained at a temperature in the range of from about 250° F. to about 400° F., and most preferably at about 325° F.±25° F. These die temperatures have been found to facilitate the plastic deformation of paperboard in the rim areas if the paperboard has the preferred moisture levels. At these preferred die temperatures, the amount of heat applied to the blank is sufficient to liberate the moisture within the blank and thereby facilitate the deformation of the fibers without overheating the blank and causing blisters from liberation of steam or scorching the blank material. It is apparent that the amount of heat applied to the paperboard will vary with the amount of time that the dies dwell in a position pressing the paperboard together. The preferred die temperatures are based on the usual dwell times encountered for normal plate production speeds of 40 to 60 pressings a minute, and commensurately higher or lower temperatures in the dies would generally be required for higher or lower production speeds, respectively.

Without intending to be bound by theory, it is believed that increased moisture, temperature, and pressure in the region of the pleat during pleat formation facilitates rebonding of lamellae in the pleats; accordingly, if insufficient rebonding is experienced, it can generally be addressed by increasing one or more of temperature, pressure or moisture.

A die set wherein the upper assembly includes a segmented punch member and is also provided with a contoured upper pressure ring is advantageously employed in carrying out the present invention. Pleating control is preferably achieved in some embodiments by lightly clamping the paperboard blank about a substantial portion of its outer portion as the blank is pulled into the die set and the pleats are formed. For some shapes the sequence may differ somewhat as will be appreciated by one of skill in the art. Paperboard containers configured in accordance with the present invention are perhaps most preferably formed from scored paperboard blanks.

Figure 12:
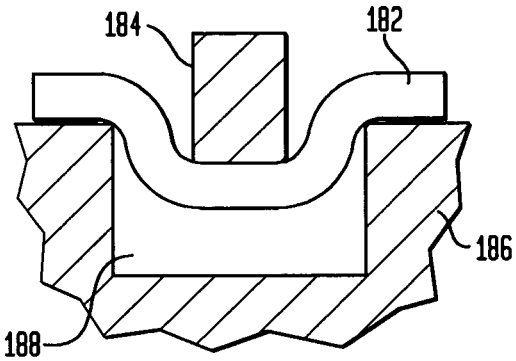
FIGS. 12 through 14 are schematic diagrams illustrating scoring and pleating paperboard.
Figure 13:
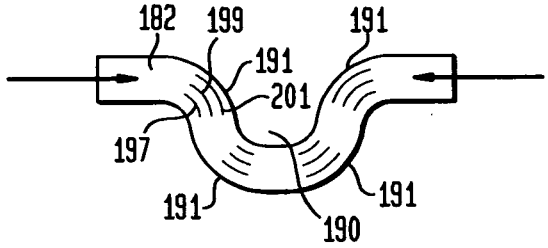
Figure 14:
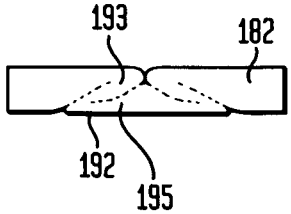

In FIG. 12 there is shown a portion of paperboard stock 182 positioned between a score rule 184 and a scoring counter 186 provided with a channel 188 as would be the case in a scoring press or scoring portion of a pressware forming press. The geometry is such that when the press proceeds reciprocally downwardly and scores blank 182, U-shaped score 190 results. At least incipient delamination of the paperboard into lamellae indicated at 197, 199, 201 is believed to occur in the sharp corner regions indicated at 191 in FIG. 13. The same reciprocal scoring operation could be performed in a separate press operation to create blanks that are fed and formed subsequently. Alternatively, a rotary scoring and blanking operation may be utilized as is known in the art. When the product is formed in a heated matched die set, preferably a generally U-shaped pleat 192 with a plurality of rebonded paperboard lamellae along the pleat is formed such that pleats 192 (or 40 as shown in FIG. 1A and following) have the configuration shown schematically in FIG. 14. While the pleats will often have this structure, in other cases a Z or S shaped pleat may be formed, corresponding in essence to ½ of a U-shaped pleat.

During the forming process described hereinafter, internal delamination of the paperboard into a plurality of lamellae as a pleat is formed occurs, followed by rebonding of the lamellae under heat and pressure into a substantially integrated fibrous structure generally inseparable into its constituent lamellae. Preferably, the pleat has a thickness generally equal to the circumferentially adjacent areas of the rim and most preferably is more dense than adjacent areas. Integrated structures of rebonded lamellae are indicated schematically at 193, 195 in FIG. 14 on either side of paperboard fold lines in the pleat indicated in dashed lines.

The substantially rebonded portion or portions of the pleats 192 in the finished product preferably extend generally over the entire length (75% or more) of the score which was present in the blank from which the product was made. The rebonded portion of the pleats may extend only over portions of the pleats in an annular region of the periphery of the article in order to impart strength. Such an annular region or regions may extend, for example, around the container extending approximately from the transition of the bottom of the container to the sidewall outwardly to the outer edge of the container, that is, generally along the entire length of the pleats shown in the Figures above. The rebonded structures may extend over an annular region which is less than the entire profile from the bottom of the container to its outer edge. Referring to FIG. 2, for example, an annular region of rebonded structures oriented in a radial direction may extend around the container from inner transition 14 to outermost edge 54. Alternatively, an annular region or regions of such rebonded structures may extend over all or only a portion of the length of sidewall 16; over all or part of second annular transition portion 18; over all or part of outer arcuate flange portion 26; all or a portion of the evert or combinations thereof. It is preferable that the substantially integrated rebonded fibrous structures formed extend over at least a portion of the length of the pleat, more preferably over at least 50% of the length of the pleat and most preferably over at least 75% of the length of the pleat. Substantially equivalent rebonding can also occur when pleats are formed from unscored paperboard.

At least one of the optional sidewall portion, the second annular transition portion, and the outer flange portion is provided with a plurality of circumferentially spaced, radially extending regions formed from a plurality of paperboard lamellae rebonded into substantially integrated fibrous structures generally inseparable into their constituent lamellae. The rebonded structures extend around an annular region corresponding to a part of the profile of the optional sidewall, second annular transition portion or the outer flange portion of the container. More preferably, the integrated structures extend over at least part of all of the aforesaid profile regions about the periphery of the container. Still more preferably, the integrated rebonded structures extend generally over the length of the pleats, over at least 75% of their length, for instance; however, so long as a majority of the pleats, more than about 50% for example, include the rebonded structures described herein over at least a portion of their length, a substantial benefit is realized. In some preferred embodiments, the rebonded structures define an annular rebonded array of integrated rebonded structures along the same part of the profile of the container around an annular region of the container. For example, the rebonded structures could extend along the optional sidewall portion of all of pleats 40 shown in FIGS. 1A and 4A along a length to define an annular array around the optional sidewall portion of the container.

Figure 15:
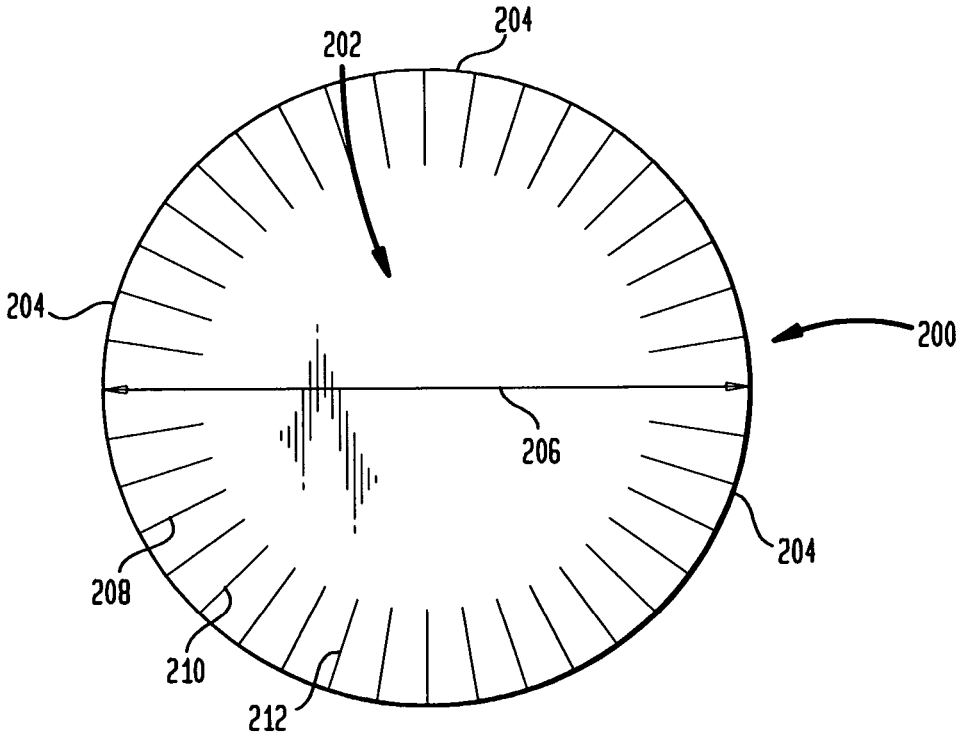
FIG. 15 is a schematic diagram of a paperboard blank which is scored with 40 scores of uniform spacing.

A suitable paperboard blank to make the inventive containers is shown in plan view in FIG. 15. In FIG. 15 a paperboard blank 200 is generally planar and includes a central portion 202 defining generally thereabout a perimeter 204 having a diameter 206. There is provided about the perimeter 204 of blank 200 a plurality of scores such as scores 208, 210 and 212. The scores are preferably evenly spaced and facilitate formation of evenly spaced pleats 40 as noted above.

Referring to FIGS. 16 through 20 there is shown schematically from center a segmented die set 230 for making plates having the shape of Invention Profile 1. Die set 230 includes a punch base 232, a punch knock-out 234 and a pressure ring 236. Pressure ring 236 is typically spring-biased as is well known in the art. The die set also includes a die base 238, as well as a die knock-out 240 and a draw ring 242. Draw-ring 242 is likewise spring biased.

Preferably, the die base 238 defines a continuous forming contour 239 as shown, while the punch forming contour may be a split contour having portions 232*a*, 232*b* as shown. Punch knock-out 234 is preferably an articulated knock-out as is seen in FIGS. 16-20.

Figure 16:
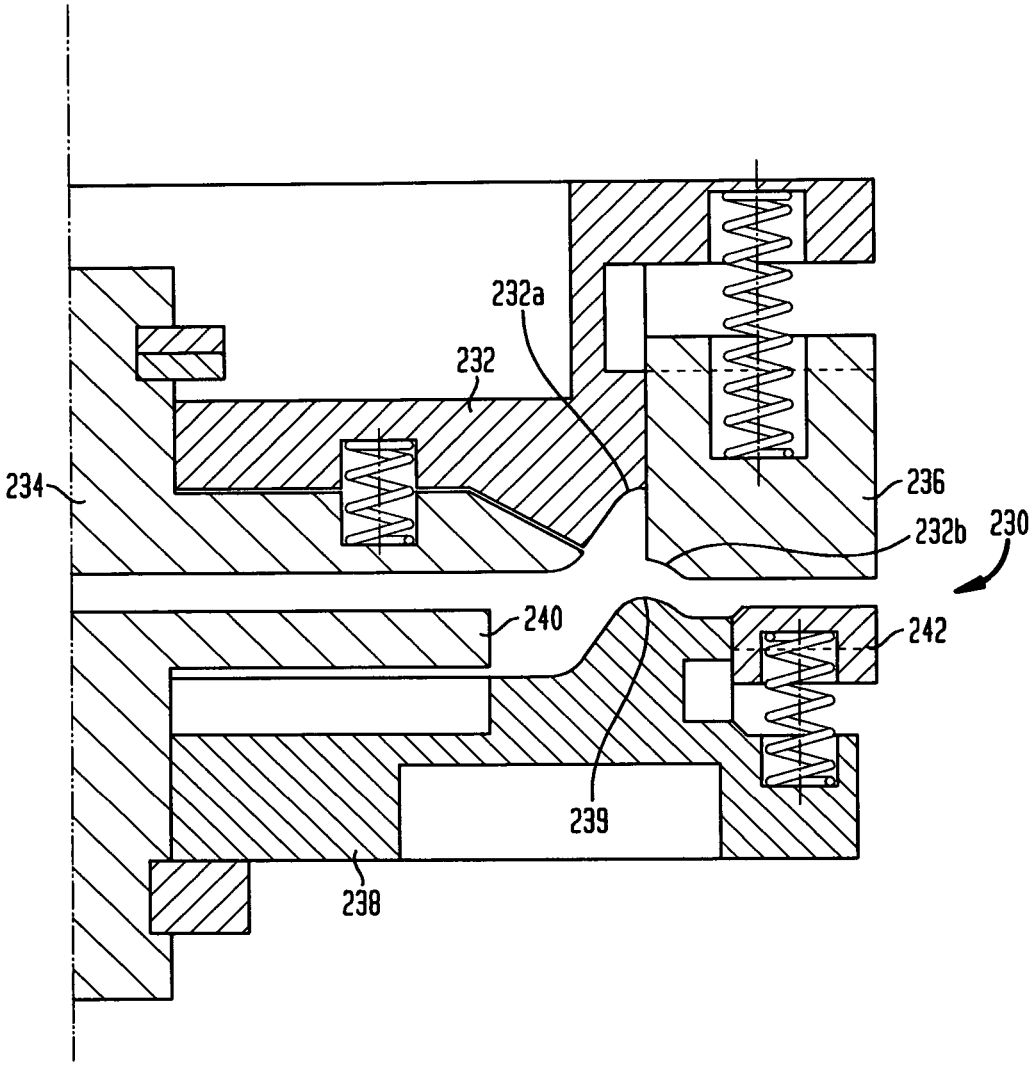
FIGS. 16 through 25 are schematic diagrams illustrating manufacture of the inventive containers.
Figure 17:
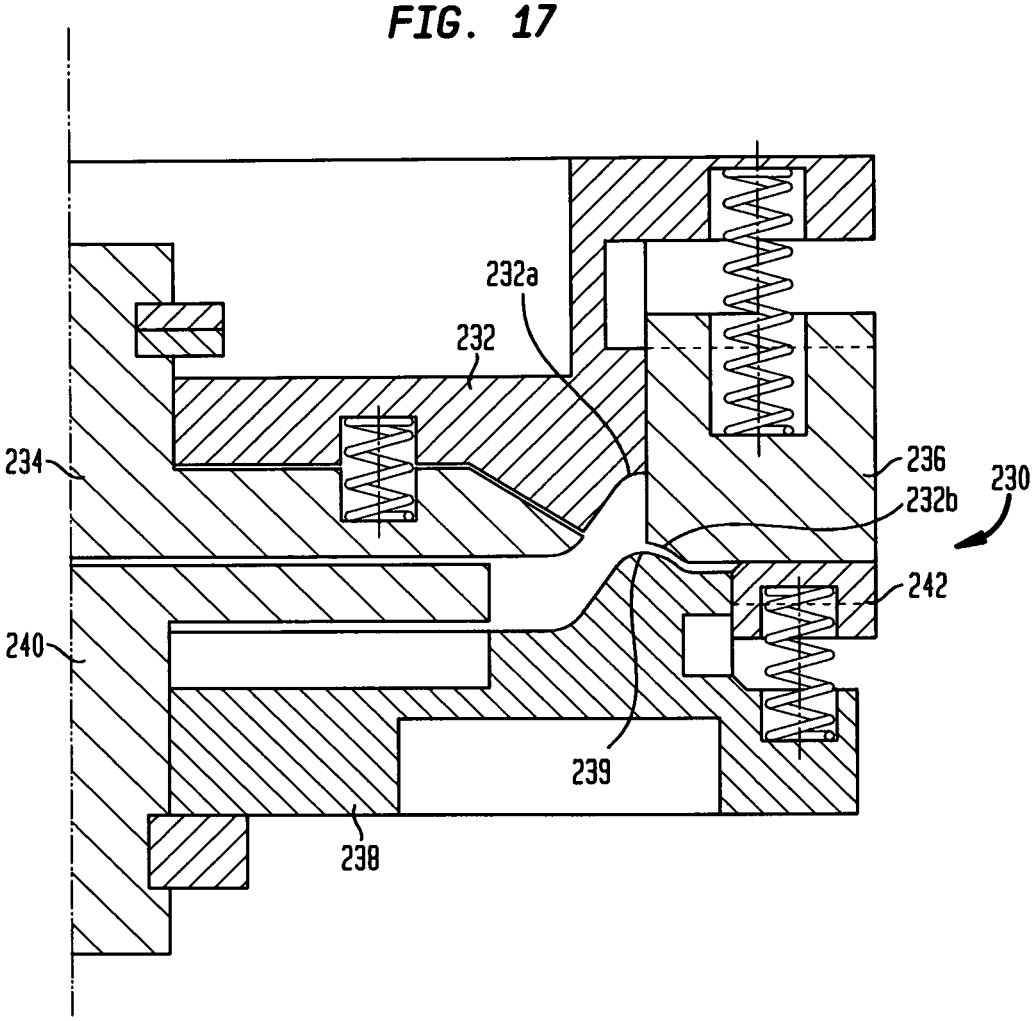

FIGS. 16-20 illustrate the sequential operation of the forming die as the product 10 of FIG. 1A is formed. In FIG. 16, the die set is fully open and receives a planar paperboard blank such as blank 200. In FIG. 17 the punch is seen to have advanced toward the die such that pressure ring 236 and draw ring 242 have advanced toward the blank and will contact the blank at its outermost portions. It is noted with respect to FIG. 17 that the forming contours of the bases will have only begun to engage the blank, but have not yet closed fully thereupon.

Figure 18:
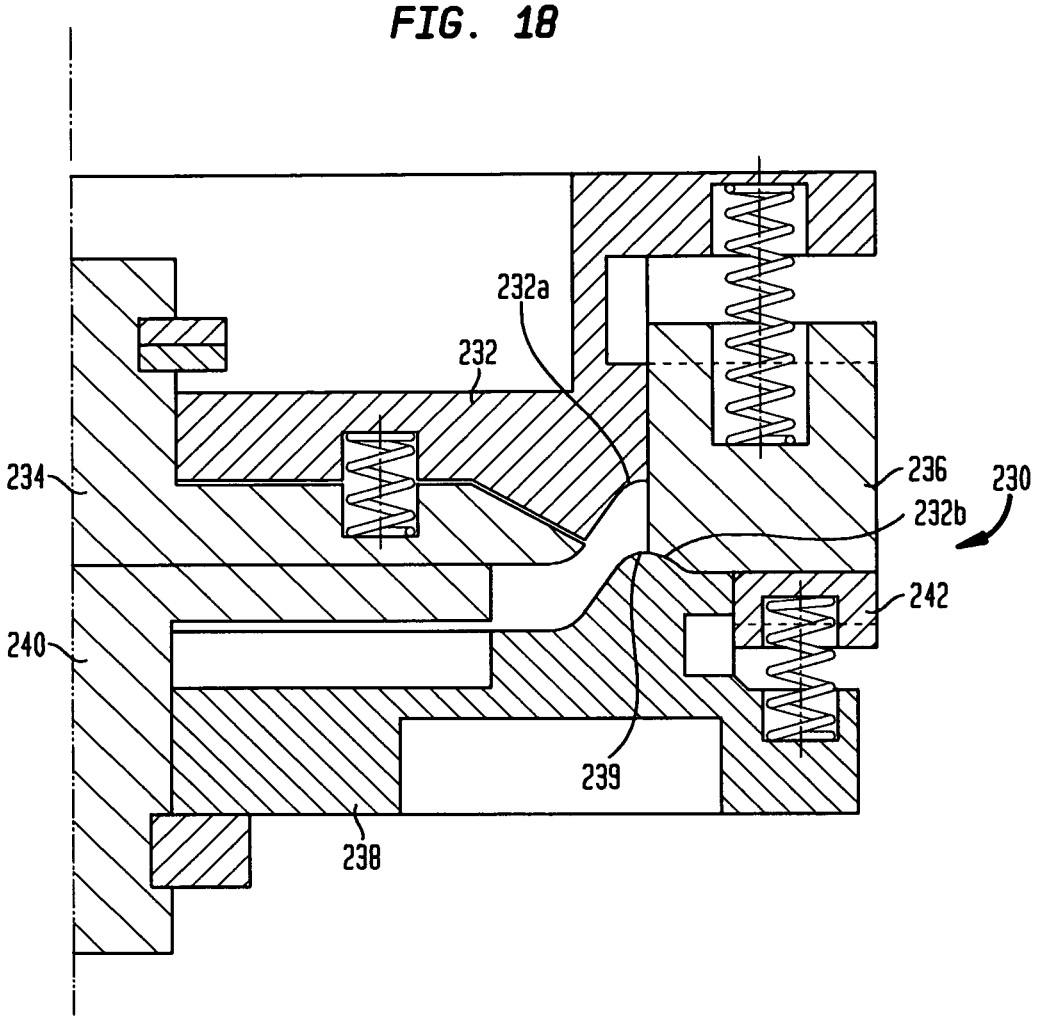
Figure 19:
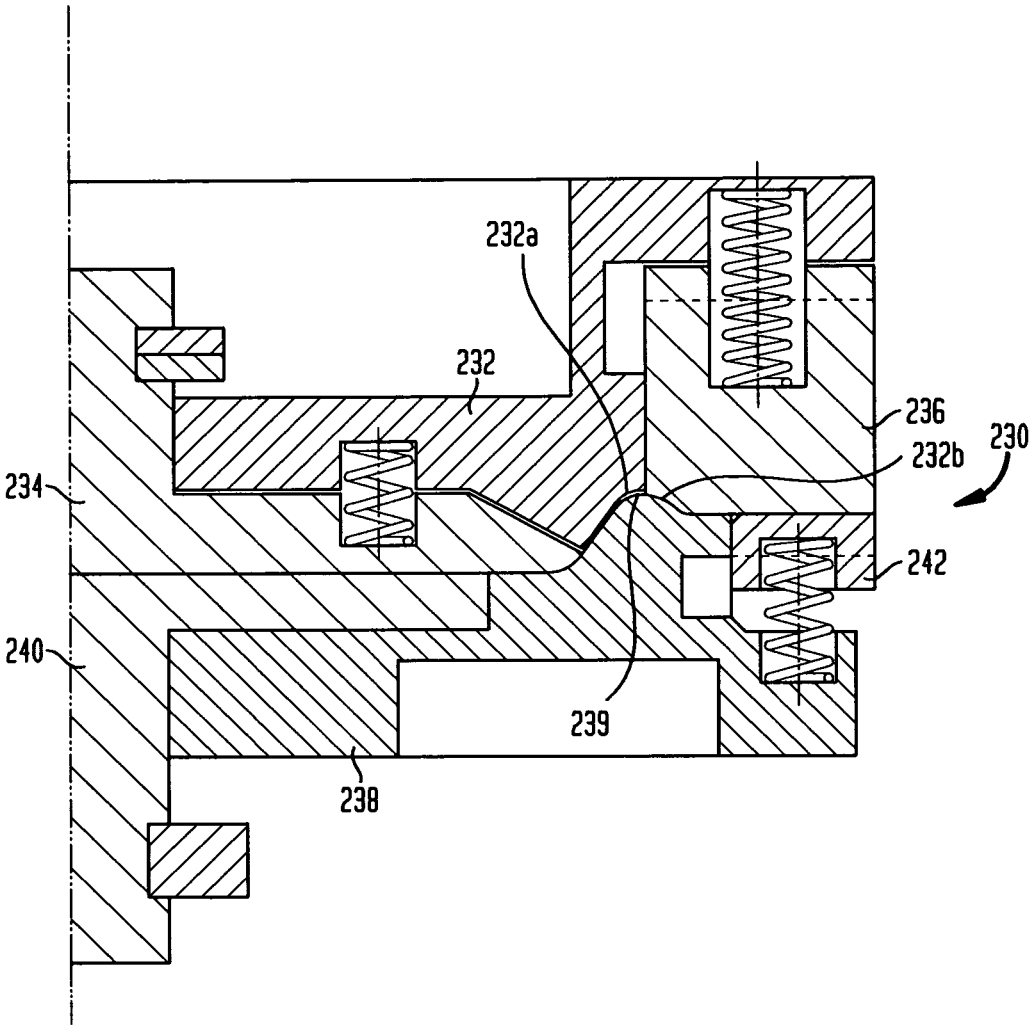
Figure 20:
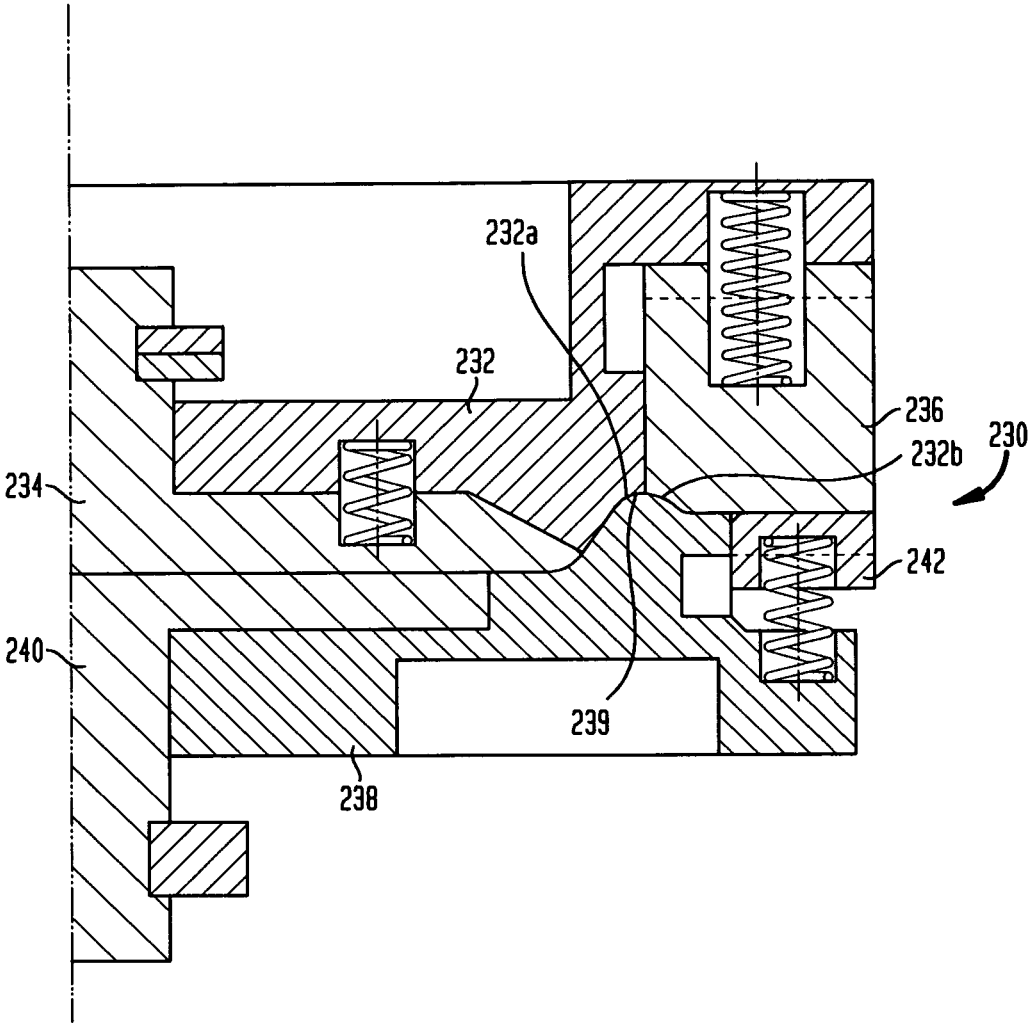

In FIG. 18, the die set continues to close, with punch base 232 continuing to advance towards die base 238, wherein the knock-outs 234, 240, forming contour 239, and forming contour portion 232*b* are contacting the blank. In FIG. 19, a more advanced stage, the die set is forming the container. In FIG. 20, the die set is fully closed and the contour portion of the punch base applies pressure to the flange area.

The die opens by reversed staging and a fully formed product is removed from the die set.

Referring to FIGS. 21 through 25, there is shown schematically another die set 330 for making plates having the shape of Invention Profile 5. Die set 330 includes a punch base 332, a punch knock-out 334 and a pressure ring 336. Pressure ring 336 is typically spring-biased as is well known in the art. The die set also includes a die base 338, as well as a die knock-out 340 and a draw ring 342. Draw-ring 342 is likewise spring biased. Here the punch and base each define a continuous forming contour.

Figure 21:
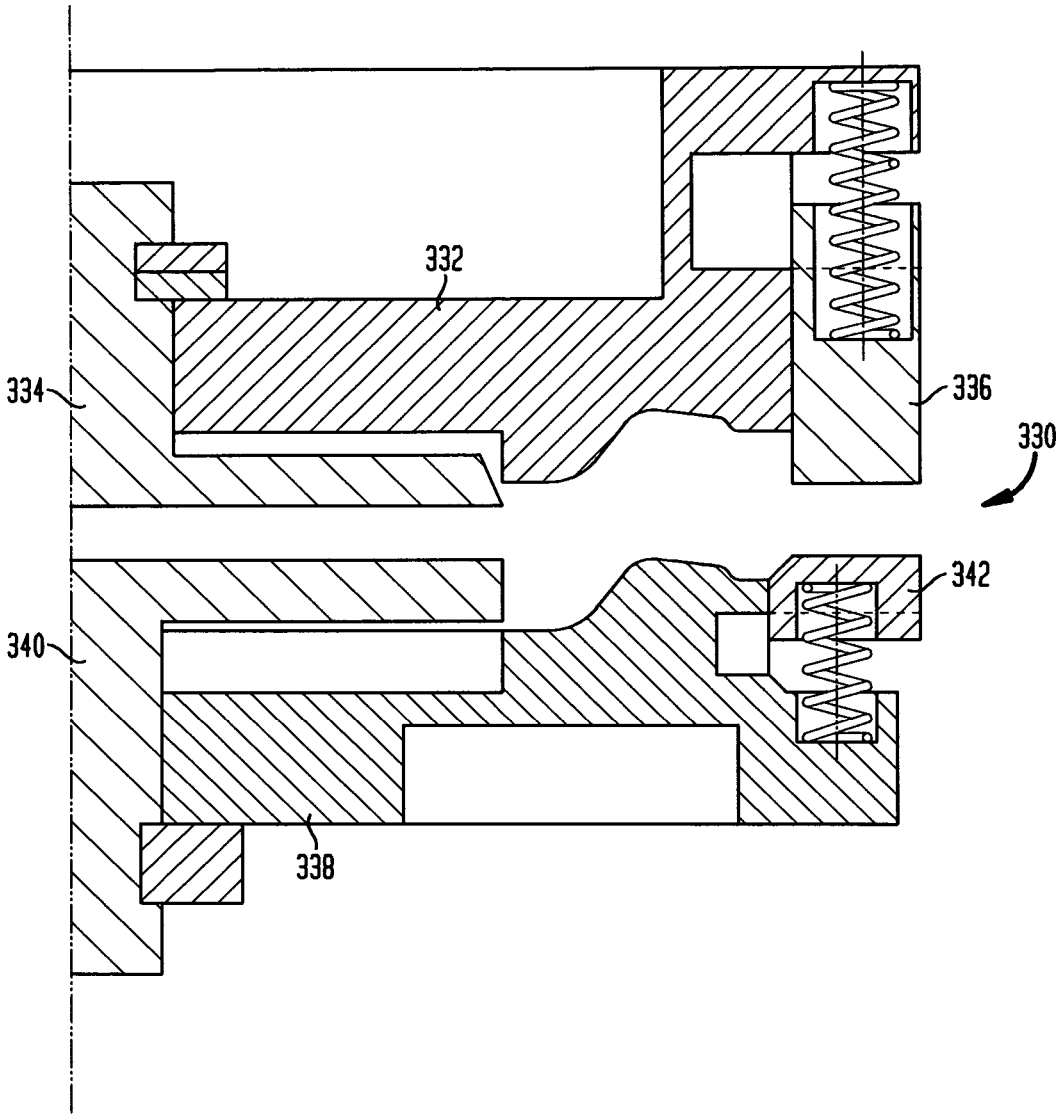
Figure 22:
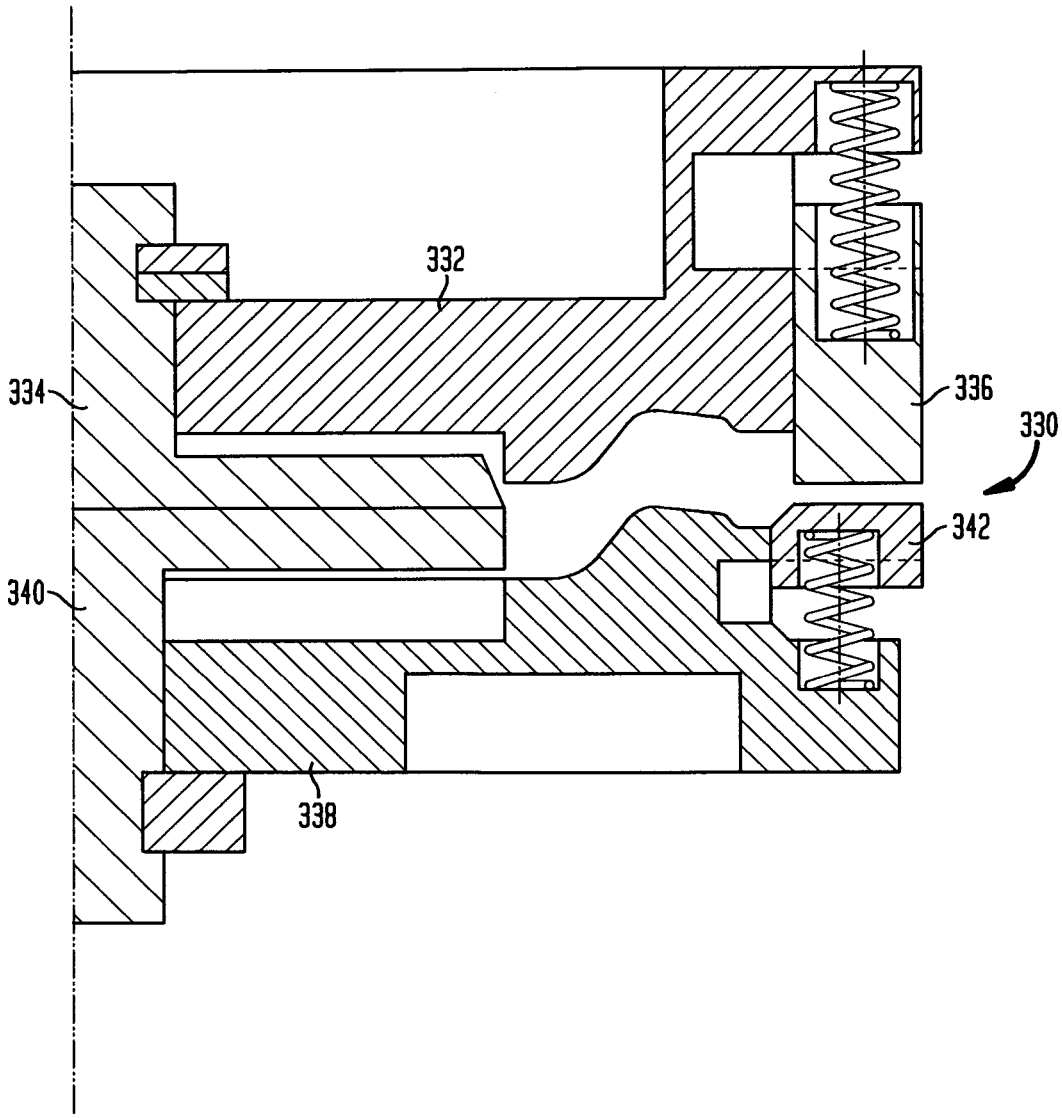
Figure 23:
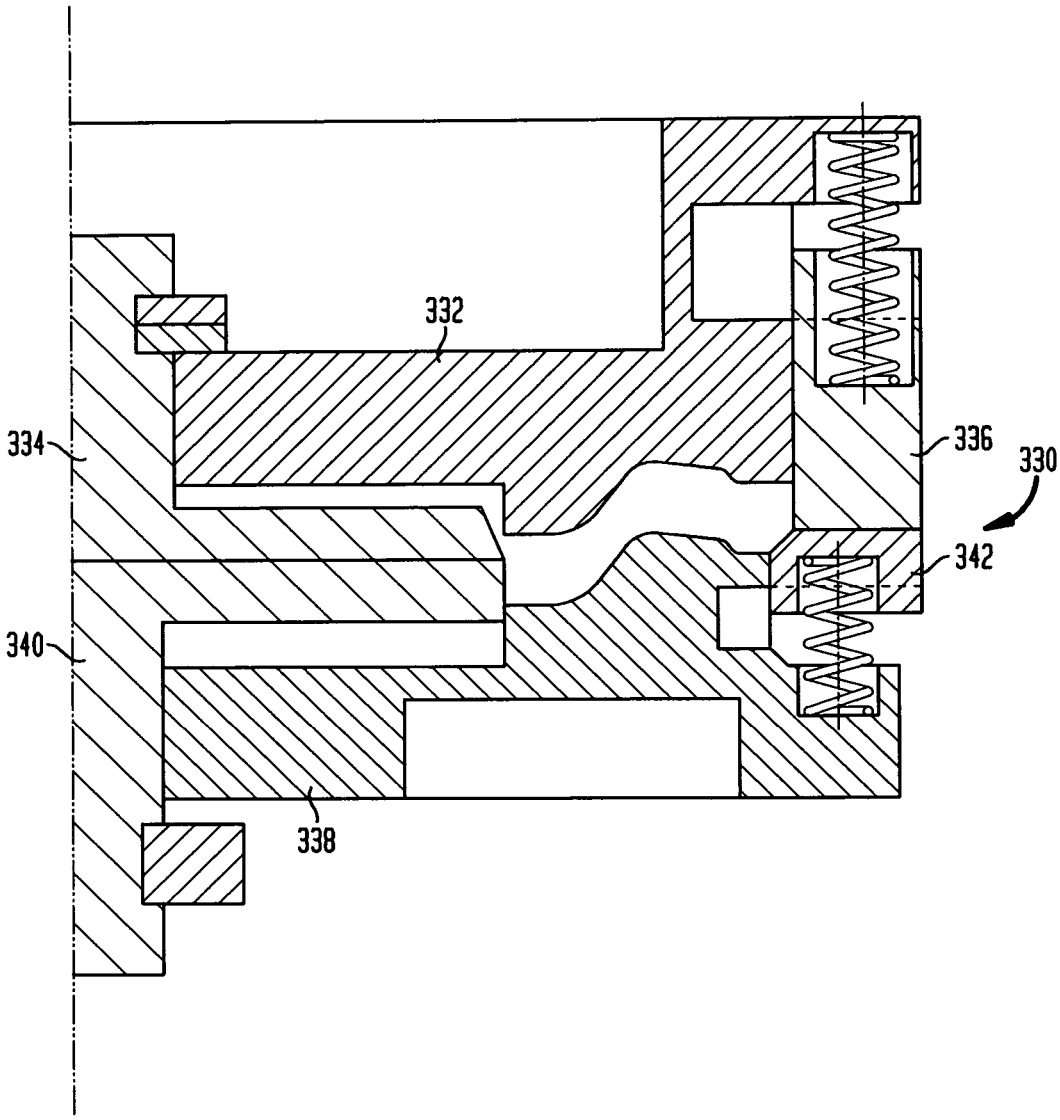
Figure 24:
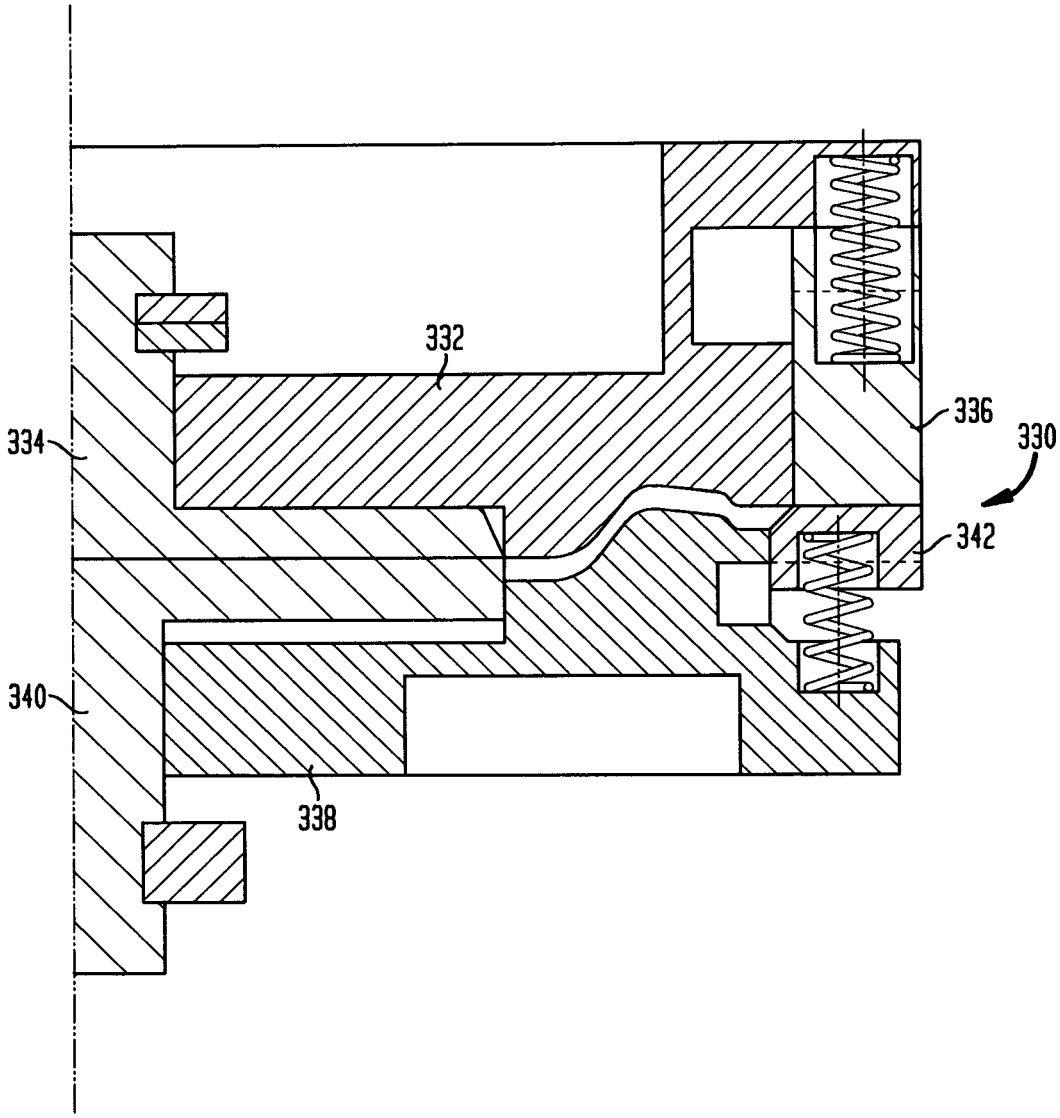
Figure 25:
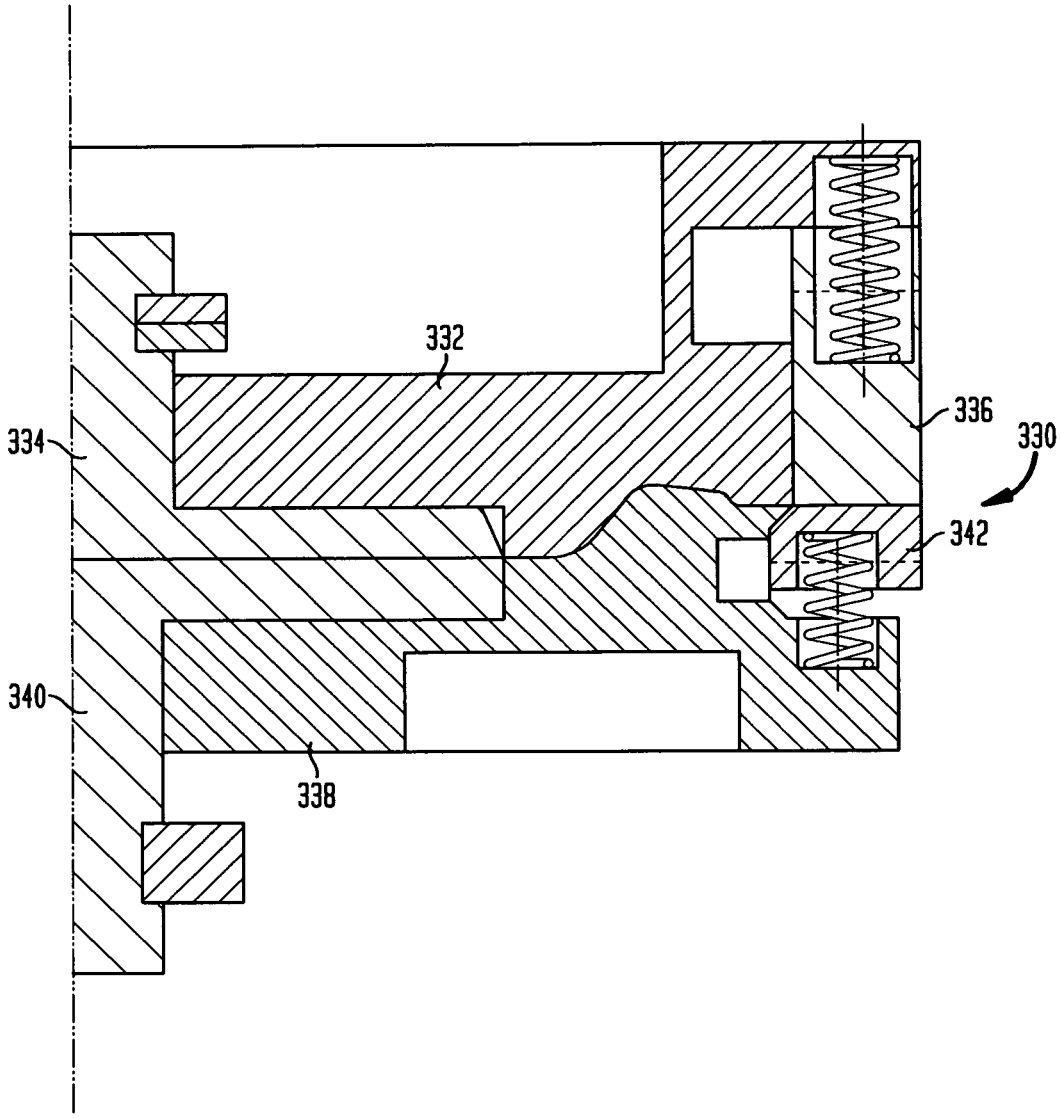

FIGS. 21-25 illustrate the sequential operation of the forming die as the product (Invention Profile 5) is formed. In FIG. 21, the die set is fully open and receives a planar paperboard blank such as blank 200. In FIG. 22 the punch is seen to have advanced toward the die such that the knock outs 334, 340 will contact the blank. In FIG. 23, the die set continues to close, with punch base 332 continuing to advance towards die base 338, wherein the pressure and draw rings 336, 342 will contact the blank. In FIG. 24, a more advanced stage, the container is beginning to be formed. In FIG. 25, the die set is fully closed and the contour portion of the punch base applies pressure to the flange area to complete pressing of the product.

The die opens by reversed staging and a fully formed product is removed from the die set.

Draw and/or pressure rings may include one or more of the features: circular or other shape designed to match product shape; external location with respect to the forming die or punch base and die or base contour; stops (rigid or rotating) connected thereto to locate blank prior to formation; cut-out "relief" area that is approximately the same depth as the paperboard caliper and slightly larger than the blank diameter to provide a reduced clamp force before pleating starts to occur, this provides initial pleating control and also final pleating control; 3 to 4 L-shaped brackets each (stops) are bolted into both the draw and pressure rings around their perimeters and contact milled-out areas in the respective die and punch forming bases or contours to provide the springs with preload distances and forces; typical metal for the draw ring is steel, preferably AISI 1018, typical surface finishes of 125 rms are standard for the draw ring, 63 rms are desired for the horizontal top surface, and inner diameter, a 32 rms finish is desired on the horizontal relief surface; pins and bushings are optionally added to the draw and pressure rings and die and punch bases to minimize rotation of the rings; inner diameter of the pressure ring may be located relatively inwardly at a position generally corresponding to the outer part of the second annular transition of the container or relatively outwardly at a position generally corresponding to the inner part of the arcuate outer flange or at a suitable location therebetween; the draw and pressure ring inner diameters should be slightly larger than the matching bases/contours such as to provide for free movement, but not to allow significant misalignments due to loose tolerencing; 0.005" to 0.010" clearance per side (0.010" to 0.020" across the diameter) is typical; 4 to 8 compression springs each per draw ring and pressure ring typically are used to provide a preload and full load force under pre and full deflections; machined clearance holes for the springs should be chamfered to ensure no binding of the springs during the deflection; the spring diameters, free lengths, manufacturer and spring style can be chosen as desired to obtain the desired draw ring and pressure ring preloads, full load and resulting movements and clamping action; to obtain the desired clamping action the preload of the pressure ring springs (total force) should be slightly greater that the fully compressed load of the draw ring springs (total force); the preload of the draw ring springs should be chosen to provide adequate pleating control while not clamping excessively hard on the blank while in the draw ring relief; for example, for a typical 9" plate selections might include (6) draw ring compression springs LC-059G-11 SS (0.48" outside diameter, 0.059" wire diameter, 2.25" free length, spring rate 18 lb/in×0.833 (for stainless steel)=14.99 lb/in, and a solid height of 0.915"); a 0.473" preload on each spring provides a total preload force of (6)×14.99 lb/in×0.473"=42.5 lbs; an additional deflection of the springs of 0.183" or (0.656" total spring deflection) results in a total full load force of (6)×14.99 lb/in×0.656"=59.0 lbs; (6) pressure ring compression springs LC-080J-10 SS (0.75" outside diameter), 0.080" wire diameter, 3.00" free length, spring rate of 20.23 lb/in×0.833 (for stainless steel)=16.85 lb/in, and a solid height of 0.915"; a 0.692" preload on each spring provides a total preload force of (6)×16.85 lb/in×0.692"=70 lbs (greater than draw ring full deflection spring load total force); an additional deflection of the springs of 0.758" (1.450" total spring deflection) results in a total full load force of (6)×16.85 lb/in×1.450"=146.6 lbs; or for example, selections for a 10" plate might include, (6) draw ring compression springs LC-059G-11 SS (0.48" outside diameter, 0.059" wire diameter, 2.25" free length, spring rate 18 lb/in×0.833 (for stainless steel)=14.99 lb/in, and a solid height of 0.915"); a 0.621" preload on each spring provides a total preload force of (6)×14.99 lb/in×0.621"=55.9 lbs; an additional deflection of the springs of 0.216" or (0.837" total spring deflection) results in a total full load force of (6)×14.99 lb/in×0.837"=75.3 lbs; (6) pressure ring compression springs LC-080J-10 SS (0.75" outside diameter), 0.080" wire diameter, 3.00" free length, spring rate of 20.23 lbs/in×0.833 (for stainless steel)=16.85 lb/in, and a solid height of 1.095"; a 0.878" preload on each spring provides a total preload force of (6)×16.85 lb/in×0.878"=88.8 lbs (greater than draw ring full deflection spring load total force); an additional deflection of the springs of 0.861" (1.739" total spring deflection) results in a total full load force of (6)×16.85 lb/in×1.739"=175.8 lbs. The springs referred to above are available from Lee Spring Co. Many other suitable components may of course be employed when making the inventive containers from paperboard.

Figure 26:
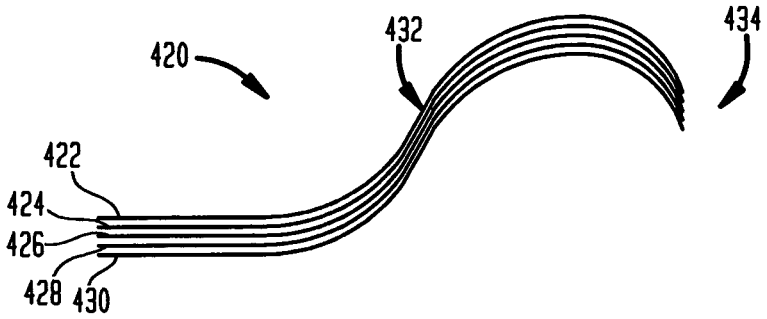
FIG. 26 is a schematic view illustrating a nested stack of conventional plates.

The annular evert portions of the containers of the present invention may extend outwardly generally in a horizontal direction±20° to parallel with respect to the container bottom. This feature is particularly useful for separating containers in a nested stack when the containers are provided with a flange which has a significant outer vertical drop since the containers nest or contact at their steep angle portions. In FIG. 26 there is shown schematically a portion of nested stack 420 plates 422, 424, 426, 428, 430 of the type described in U.S. Pat. No. 5,088,640 to Littlejohn. It can be seen that in the areas of sidewalls, indicated generally at 432, the plates are in surface-to-surface contact with each other such that there is little, if any, gap between adjacent plates in this region. Likewise, at an outer edge 434 of the stack where the brims turn downwardly at a steep angle, there is little, if any, gap between adjacent plates.

Figure 27:
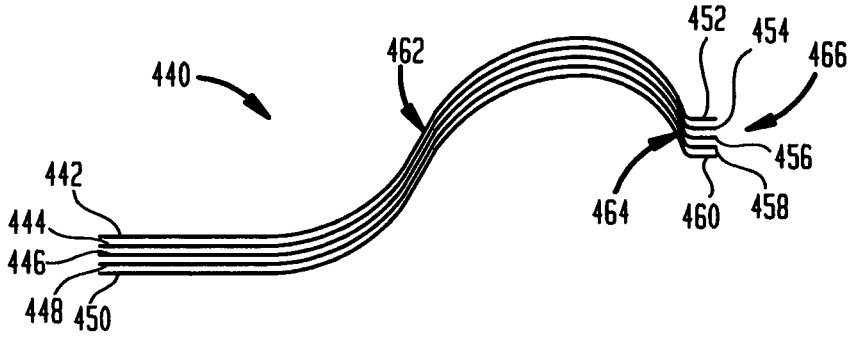
FIG. 27 is a schematic view illustrating a nested stack of plates of the invention.

In FIG. 27 there is shown schematically a portion of a nested stack 440 of plates 442, 444, 446, 448, and 450 having a profile shape similar to the plates in FIG. 26 except that they have evert portions 452, 454, 456, 458 and 460 extending outwardly from their downwardly sloping brims. Here, there is again very little, if any, gap between products in the steep areas indicated at 462 and 464; however, the everts are separated by significant gaps at outer region 466 because they are generally horizontal in region 466. Plates or bowls may be readily separated by utilizing the outer annular everts, even if there is some "taper lock", vacuum or coating tack between adjacent containers.

Figure 28:
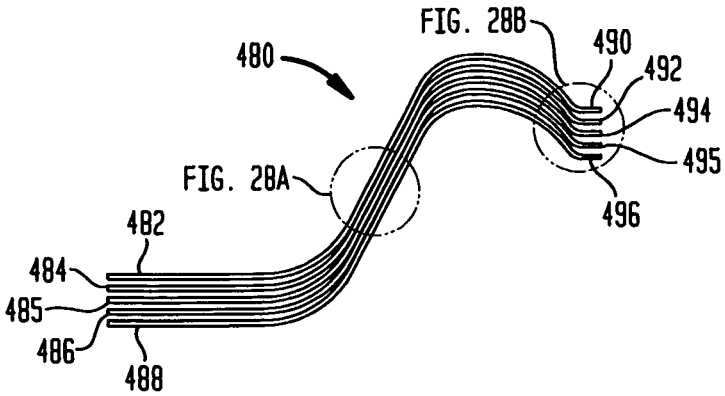
FIGS. 28-28B are schematic diagrams illustrating another nested stack of plates of the invention provided with stack spacer rings with nodules along the pleats.
Figure 28A:
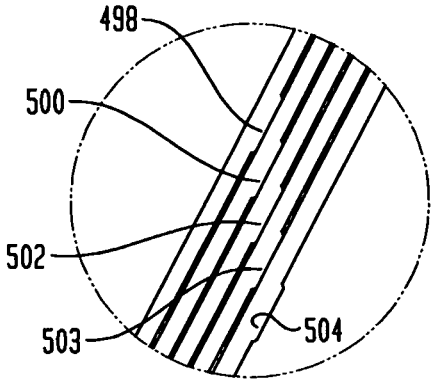

Referring to FIGS. 28, 28A, 28B, 29, 29A, 29B and 29C, there are illustrated additional features useful in accordance with the present invention. In FIGS. 28 and 28A there is shown in partial profile a stack 480 of plates including plates 482, 484, 485, 486 and 488. Each plate is provided with an annular evert portion 490, 492, 494, 495 and 496 at its outer periphery as well as a spacer ring illustrated as a projection with nodules 498, 500, 502, 503 and 504 on its underside as shown. These plates generally have the shape of Invention Profile 1A noted above. The spacer ring nodules abate taper lock in the stack as is known in the art and may be made by providing a continuous annular groove or a plurality of discrete groove segments on the forming contour of a die if so desired as discussed below in connection with FIGS. 29B and 29C. The nodules typically have a height 2-5 times the height of the rest of the spacer rings and are located at pleats where more material is available.

Figure 28B:
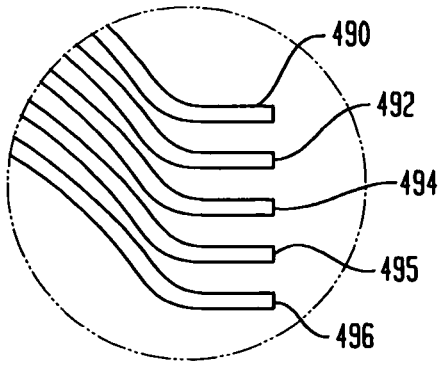

It is seen in FIG. 28A, which is an enlarged detail of FIG. 28, that the spacer ring nodules are sized so that they engage an adjacent plate in the stack; however it is seen in FIG. 28B that the plates are not engaged at their evert portions around the outside of the container. This has been found to allow substantial listing or tilting of stacks of plates; 30 degrees or more leaning from vertical readily occurring depending on the number of plates in a stack. The stacks are thus unstable, making accumulation of plates in a stack and packaging difficult. To abate the stack stability problem, stabilizer rings with nodules are added as is shown in FIGS. 29 and 29A.

Figure 29:
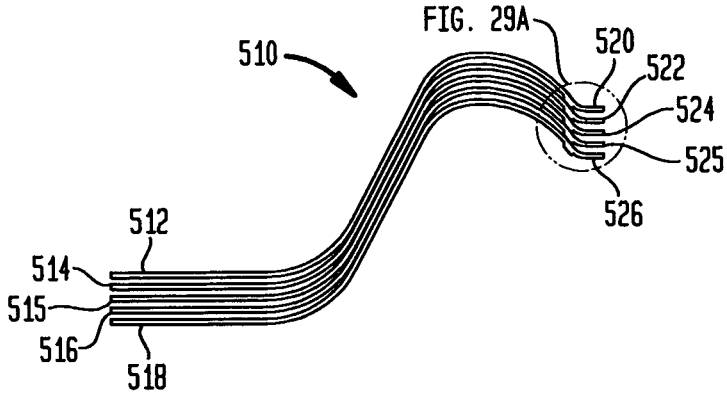
FIGS. 29 and 29A are schematic diagrams illustrating still yet another nested stack of plates of the invention provided with stabilizing rings having nodules along the pleats.
Figure 29A:
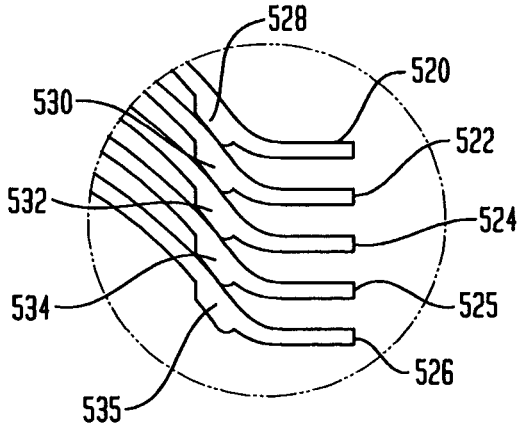

In FIGS. 29 and 29A there is shown another stack 510 including plates 512, 514, 515, 516 and 518 with brim portions 520, 522, 524, 525 and 526 each of which is provided with a stabilizing ring nodules 528, 530, 532, 534 and 535 located on the underside of the container illustrated as projections on the downwardly sloping portion of the brim. FIG. 29A is an enlarged schematic detail of stack 510 as seen along the pleats of containers. It is seen in FIG. 29A that the stabilizing ring nodules are sized to engage an adjacent plate in stack 510, thereby reducing the ability of a stack to list away from vertical alignment. The stabilizing rings are also formed by providing a continuous annular groove or a plurality of discrete annular groove segments in the forming die so that "nodules" or raised portions of the ring are along the pleats as shown in FIG. 29A; while the remainder of the stabilizing rings, between the pleats are much less pronounced because there is not as much material available in other areas of the plate. Typically the nodules have a height or projection away from the container 2-5 times that of adjacent portions of the ring. On the pleats as shown in FIGS. 29 and 29A, the rings form nodules projecting from the adjacent area of the plate substantially as much as the depth of a groove in the forming contour which forms the stabilizing ring. For example, a 5 mil deep annular groove in the forming contour will form 5 mil nodules at the pleats. On other parts of the ring formed by the groove, i.e. between pleats, the ring is much less pronounced, projecting from the adjacent surface a distance corresponding to less than the groove depth as noted above.

Figure 29B:
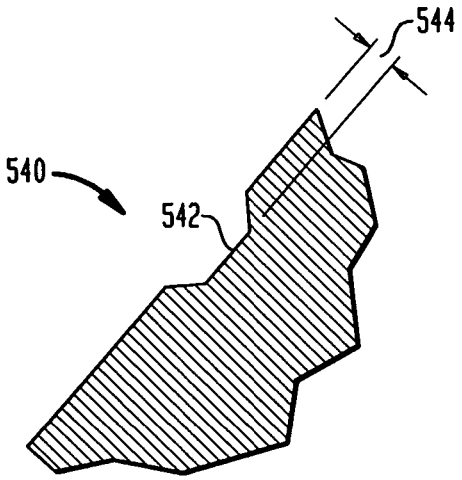
FIGS. 29B and 29C are schematic diagrams illustrating portions of grooved die profiles useful for forming spacer and stabilizing rings with nodules.

FIG. 29B is an enlarged schematic detail of a portion 540 of a forming contour of a die having an annular groove 542 corresponding to the location of spacer ring nodules such as ring nodules 498, 500 and so forth. The groove may have a depth 544 of 3-10 mils and extends around the sidewall forming area of the die to produce the spacer rings as noted above. The spacer rings on the product are also more prominent along a pleat because of the additional available paperboard, resulting in better mold filling at these locations.

Figure 29C:
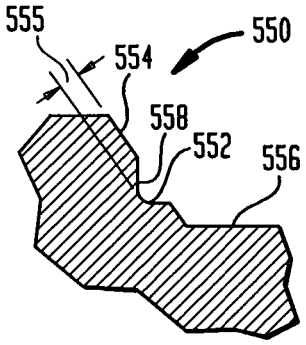

Referring to FIG. 29C, there is shown a portion 550 of the forming contour of a die provided with an annular groove 552 of depth 555 useful for forming stack stabilizing rings such as rings 528, 530, 532, 534 and 535. Portion 550 has an inner portion 554 corresponding to the downwardly sloping portion of the brim where stabilizer rings are positioned and an outer portion 556 corresponding to the location of the annular evert portion of a pressed container. Groove 552 is typically located on inner portion 554 and has a vertical inner sidewall 558. Inner sidewall 558 of the groove is vertical or slopes outwardly, undercuts being generally undesirable in the forming surface because they make product stripping difficult. When product is formed, groove 552 forms a stabilizing ring with nodules on the product on the downwardly sloping portion of the brim near the transition to the evert; this stabilizing ring being most prominent in the areas of the pleats because of the availability of board as noted above. The height variation of the stabilizing ring defines a plurality of circumferentially spaced nodules corresponding to the number of pleats in the product which operate to stabilize the stack by engaging adjacent plates at their outer portions as is perhaps best appreciated from FIG. 29A. The groove may have a depth 555 of 3-10 mils and extends around the brim forming area of the die to produce the spacer rings as noted above.

Figure 30:
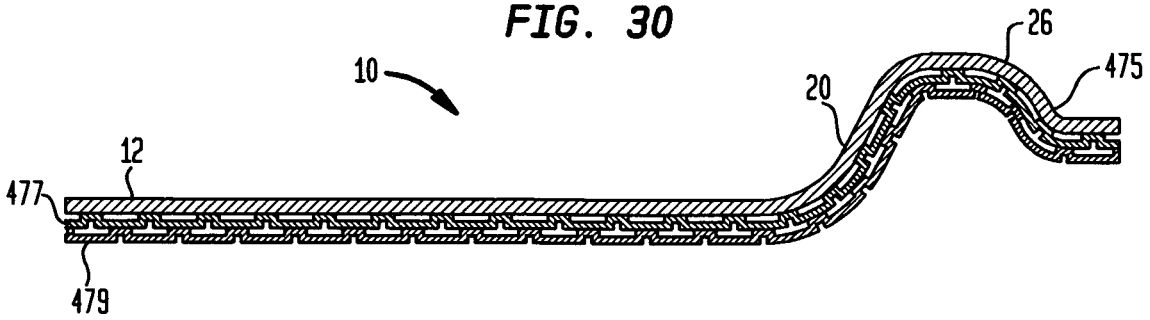
FIG. 30 is a schematic view showing a container of the invention prepared as a paperboard laminate.

Referring now to FIG. 30, there is shown schematically a container 10 of the invention formed from a composite paperboard material wherein the containers are formed by laminating separate layers 475, 477 and 479 to one another in the form of the container having the shape shown in FIG. 1A. The particular manipulative steps of forming the plate of FIG. 30 are discussed in greater detail in U.S. Pat. Nos. 6,039,682, 6,186,394 and 6,287,247, the disclosures of which are incorporated herein by reference.

Figure 31:
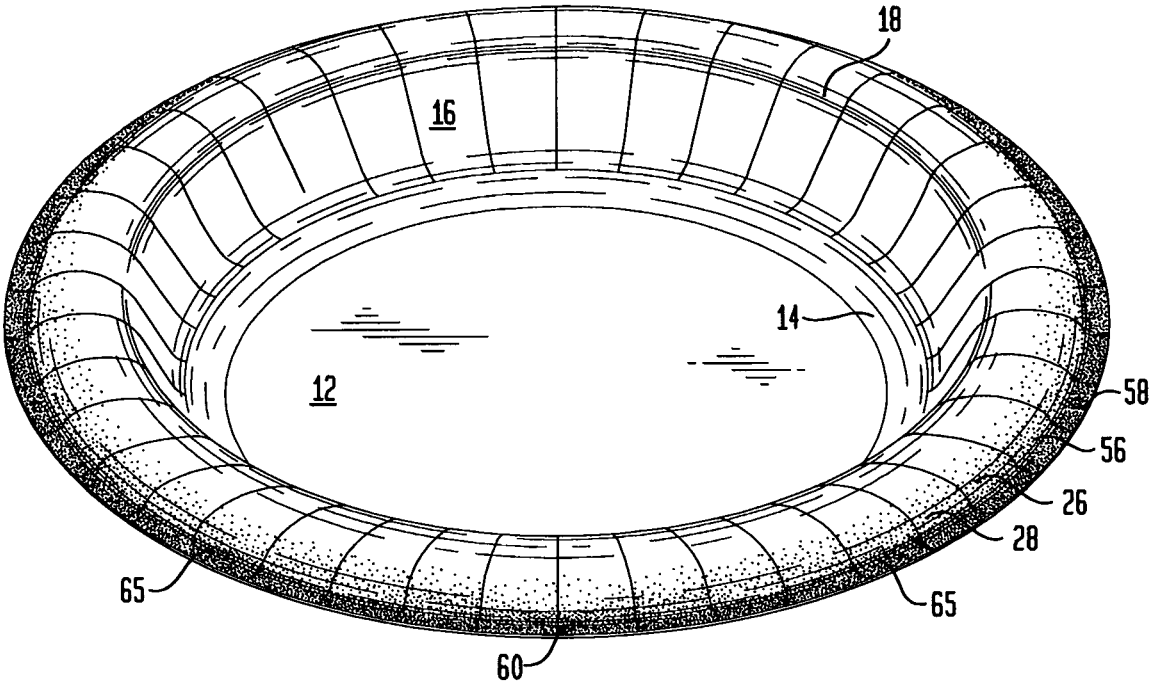
FIG. 31 is a view in perspective of still yet another plate of the invention wherein the outer rim is provided with shading to mask brim features.

In some cases it is desirable to mask the outer brim features of containers of the invention so that they are not as visually prominent such that the container appears more like conventional ones; especially where consumer acceptance requires a product resembling a product the consumer is already familiar with. It has been found that the inventive brim features can be visually blended with the rest of the container by the use of color variation, which has the added advantage of masking variations in dimensions that may occur due to stretch or off-center forming. To this end, the brim transition portion and at least a part of the downwardly sloping brim portion is provided with shading operative to cloak the geometry of the brim transition portion and the outwardly extending annular evert such that these features visually blend with the downwardly sloping brim portion of the container. There is shown in FIG. 31 a disposable container in accordance with the present invention having the shape designated herein as Invention Profile 1 in the form of a plate 10 which has planar bottom portion 12, a first annular transition portion 14 and a sidewall portion 16. A second transition annular portion 18 extends between sidewall portion 16 and an arcuate outer flange 26. Outer arcuate flange portion 26 has a convex upper surface 28 which transitions to downwardly sloping brim portion 56 with a brim transition portion 58 at its bottom, extending annularly as shown. The transition portion defines a profile direction change and is attached to an outwardly extending annular evert portion 60 as shown. There is provided shading at 65 which, as can be appreciated from the diagram, operates to cloak the outermost features of the container and blend its geometry with that of downwardly sloping portion 56. In this respect, note that shading is applied to all of the evert and transition and part of downwardly sloping brim portion 56. Shading at 65 is conveniently printed on the paperboard blank prior to press-forming and may be any suitable shading, including red, blue, green, indigo, violet, gray, or black; colors may be applied in patterns, in various color densities and so forth. Any suitable color or pattern change with respect to the rest of the container may be employed.

Containers of the invention thus provide for increases in Rigidity, Rim Stiffness, ability to support a load and ease of separation from a nested stack. Modifications to the specific embodiments described above, within the spirit and scope of the present invention as is set forth in the appended claims, will be readily apparent to those of skill in the art.

What is claimed is:

1. A disposable servingware container press-formed from a generally planar paperboard blank, the container having a characteristic diameter, D, as well as an overall height and comprising:

a generally planar bottom portion;

a first annular transition portion extending upwardly and outwardly from said generally planar bottom portion;

a sidewall portion extending upwardly and outwardly from said first annular transition portion;

a second annular transition portion extending outwardly from said sidewall portion;

said sidewall portion defining a generally linear, inclined sidewall profile over a length between said first annular transition portion and said second annular transition portion, the profile defining an angle of inclination with respect to the vertical from said generally planar bottom portion;

an arcuate brim portion having a convex upper surface extending outwardly with respect to said second annular transition portion, the radius of curvature of said arcuate brim portion being from about 0.005 to about 0.1 times the characteristic diameter of said disposable servingware container, the arcuate brim portion extending downwardly at its outer part to define at its terminus a declivity angle $\alpha$ with respect to a horizontal substantially parallel to the bottom portion;

an inner flange portion extending between said second annular transition portion and said arcuate brim portion having a ratio of radial span to the characteristic diameter of from about 0 to about 0.1;

a brim transition portion at the lower edge of the downwardly sloping arcuate brim portion, there being thus defined a brim vertical drop which is the difference between the overall height of the container and a height at which the downwardly sloping brim portion transitions to the brim transition portion, wherein the ratio of the brim vertical drop to the characteristic diameter of the container is greater than about 0.01, the brim transition portion, in turn, transitions to an annular evert portion extending outwardly with respect to the downwardly sloping arcuate brim portion at an eversion angle $\beta$ of at least about 25 degrees, the height of any upward extension of the evert portion above the brim transition portion being no more than about 75% of the brim vertical drop, and wherein the arcuate brim portion has a plurality of circumferentially spaced pleats.

2. The disposable servingware container according to claim 1, wherein said inclined sidewall profile has an angle of inclination with respect to the vertical from said generally planar bottom portion of from about 10° to about 50°.

3. The disposable servingware container according to claim 1, wherein said inclined sidewall profile has an angle of inclination with respect to the vertical from said generally planar bottom portion of from about 20° to about 30°.

4. The disposable servingware container according to claim 1, wherein the ratio of the flange outer vertical drop to the characteristic diameter of the container is greater than about 0.013.

5. The disposable servingware container according to claim 1, wherein the ratio of the flange outer vertical drop to the characteristic diameter of the container is greater than about 0.015.

6. The disposable servingware container according to claim 1, wherein the ratio of the radius of curvature of said arcuate outer brim portion to the characteristic diameter of said disposable servingware container is from about 0.0175 to about 0.1.

7. The disposable servingware container according to claim 1, wherein the ratio of the radius of curvature of said arcuate outer brim portion to the characteristic diameter of said servingware container is greater than about 0.025.

8. The disposable servingware container according to claim 1, wherein the ratio of the radius of curvature of said arcuate outer brim portion to the characteristic diameter of said disposable servingware container is from about 0.035 to about 0.07.

9. The disposable servingware container according to claim 1, wherein the ratio of the length of the generally linear inclined sidewall profile to the characteristic diameter of the disposable servingware container is greater than about 0.025.

10. The disposable servingware container according to claim 1, wherein the ratio of the length of the generally linear inclined sidewall profile to the characteristic diameter of the disposable servingware container is greater than about 0.03.

11. The disposable servingware container according to claim 1, wherein said arcuate outer flange portion is characterized by having a single radius of curvature.

12. The disposable servingware container according to claim 1, wherein the ratio of the radius of curvature of said arcuate outer flange portion to the characteristic diameter of said disposable servingware container is from about 0.035 to about 0.06.

13. The disposable servingware container according to claim 1, wherein said convex upper surface of the arcuate outer flange portion is configured so that it defines its radius of curvature over an included angle of from about 30° to about 80°.

14. The disposable servingware container according to claim 1, wherein said servingware container is a bowl and wherein the ratio of the length of the generally linear inclined sidewall profile to the characteristic diameter of the bowl is from about 0.1 to about 0.3.

15. The disposable bowl according to claim 1, wherein the ratio of the length of the generally linear inclined sidewall profile to the characteristic diameter of the servingware container is from about 0.15 to about 0.25.

16. The disposable servingware container according to claim 1, including an inner flange portion extending between said second annular transition portion and said arcuate outer brim portion over a radial span, wherein the ratio of said radial span to the characteristic diameter of said servingware container is from about 0.01 to about 0.09.

17. A disposable food serving plate press-formed from a paperboard blank, the plate having a substantially planar center section as well as an overall height;

a first rim portion extending outward from and joined to said substantially planar center section, said first rim portion defining an upwardly facing first arc A12, having a radius of curvature of R12;

a second rim portion outward from and joined to said first rim portion, said second rim portion defining a downwardly facing second arc A22, having a radius of curvature of R22;

a third rim portion outward from and joined to said second rim portion, said third rim portion defining a downwardly facing third arc A32, having a radius of curvature of R32, and having a tangent at its outer edge which is substantially parallel to the plane of said substantially planar center section;

a fourth rim portion outward from and joined to said third rim portion, said fourth rim portion defining a downwardly facing fourth arc A42, having a radius of curvature of R42; wherein the length of the arc S2 of said second rim portion is substantially less than the length of the arc S4 of said fourth rim portion which in turn is less than the length of arc S1 of said first rim portion and wherein the radius of curvature R42 of said fourth rim portion is less than the radius of curvature R32 of said third rim portion which is less than the radius of curvature R22 of said second rim portion; and wherein the included angle defined by arc A12 exceeds 55 degrees and the included angle defined by arc A32 exceeds 45 degrees, the fourth rim portion also including an outer portion sloping downwardly at its terminus defining a declivity angle $\alpha$ with respect to a horizontal generally parallel to the center section;

a brim transition portion joined to the fourth rim portion, a brim height being thereby defined as the difference between the overall height of the container and a height at which the downwardly sloping fourth brim portion transitions to the brim transition portion, which brim transition portion transitions to an annular evert portion extending outwardly with respect to the downwardly sloping fourth rim outer portion at an eversion angle i of at least about 25 degrees;

the height of any upward extension of the evert portion above the brim transition portion being no more than about 75% of the brim height, wherein said container includes a plurality of circumferentially spaced pleats.

18. The disposable food serving plate according to claim 17, wherein the angle of arc A42 is less than about 75 degrees.

19. The disposable food serving plate according to claim 17, wherein the length of said first arc is substantially equivalent to the length of said third arc and said first radius of curvature of said first arc is substantially equivalent to said third radius of curvature of said third arc.

20. The disposable food serving plate according to claim 17, wherein the height of the center of curvature of said first rim portion above the plane of said center section is substantially less than the distance by which the center of curvature of said second rim portion is below the plane of said center section.

21. The disposable food serving plate according to claim 17, wherein the horizontal displacement of the center of curvature of said second rim portion from the center of curvature of said first rim portion is at least about twice said first radius of curvature of said first rim portion.

22. The disposable food serving plate according to claim 17, wherein said height of the center of curvature of said third rim portion above the plane of said center section is less than the height of the center of curvature of said fourth rim portion above the plane of said center section.

23. The disposable food serving plate according to claim 17, wherein the center of curvature of said second rim portion is located outwardly from the center of curvature of both said third and fourth rim portions.

24. The disposable food serving plate according to claim 17, wherein the height of the center of curvature of said third rim portion above the plane of said center section is less than about 0.3 times the radius of curvature of said fourth rim portion and the height of the center of curvature of said fourth rim portion above the plane of said center section is at least about 0.4 times said first radius of curvature of said first rim portion.

25. The disposable food serving plate according to claim 17, wherein the ratio of the length of said fourth radius of curvature to the diameter of said plate is at least about 0.03.

26. The disposable food serving plate according to claim 17, wherein the ratio of the length of said third radius of curvature to the diameter of said plate is at least about 0.050.

27. The disposable food serving plate according to claim 17, wherein the ratio of the length of said second radius of curvature to the diameter of said plate is at least about 0.2.

28. The disposable food serving plate according to claim 17, wherein the ratio of the length of said first radius of curvature to the diameter of said plate is at least about 0.045.

29. The disposable food serving plate according to claim 17, wherein the length of said first arc is substantially equivalent to the length of said third arc.

30. A disposable servingware container press-formed from a generally planar paperboard blank, the container having a characteristic diameter, D, as well as an overall height and comprising:

a generally planar bottom portion;

a first annular transition portion extending upwardly and outwardly from the generally planar bottom portion;

an optional sidewall portion extending upwardly and outwardly from the first annular transition portion;

a second annular transition portion flaring outwardly with respect to the first annular transition portion;

an outer flange portion extending outwardly with respect to the second annular transition portion, the outer flange portion having:

(i) a downwardly sloping brim portion defining a declivity angle, a, at its terminus with respect to a horizontal substantially parallel to the bottom portion and wherein the downwardly sloping brim portion transitions to (ii) a brim transition portion, a brim height being thereby defined as the difference between the overall height of the container and a height at which the downwardly sloping brim portion transitions to the brim transition portion, which, in turn, transitions to (iii) an annular evert portion extending outwardly with respect to the downwardly sloping brim portion at an eversion angle β of at least about 25 degrees;

(iv) the height of any upward extension of the evert portion above the brim transition portion being no more than about 75% of the brim height, (v) provided further that the evert portion, the brim transition portion and at least a part of the downwardly sloping brim portion is provided with shading operative to cloak the geometry of the brim transition portion and the outwardly extending annular evert such that these features visually blend with the downwardly sloping brim portion of the container, and wherein the outer flange portion has a plurality of circumferentially spaced pleats.

31. A disposable servingware container press-formed from a generally planar paperboard blank, the container having a characteristic diameter, D, as well as an overall height and comprising:

a generally planar bottom portion;

a first annular transition portion extending upwardly and outwardly from the generally planar bottom portion;

an optional sidewall portion extending upwardly and outwardly from the first annular transition portion;

a second annular transition portion flaring outwardly with respect to the first annular transition portion;

an outer flange portion extending outwardly with respect to the second annular transition portion, the outer flange portion having:

(i) a downwardly sloping brim portion defining a declivity angle α at its terminus with respect to a horizontal substantially parallel to the bottom portion and wherein the downwardly sloping brim portion transitions to (ii) a brim transition portion, a brim height being thereby defined as the difference between the overall height of the container and a height at which the downwardly sloping brim portion transitions to the brim transition portion, which, in turn, transitions to (iii) an annular evert portion extending outwardly with respect to the downwardly sloping brim portion at an eversion angle β of at least about 25 degrees;

(iv) a flange stabilizing projection disposed on the downwardly sloping brim portion sized to engage an adjacent container in a stack of like containers to promote stack stability;

(v) the height of any upward extension of the evert portion above the brim transition portion being no more than about 75% of the brim height, and wherein the outer flange portion has a plurality of circumferentially spaced pleats.

32. The container according to claim 31, wherein the stabilizing projection includes a plurality of stabilizing nodules formed by way of a forming contour provided with an annular groove.

33. The container according to claim 32, wherein the groove has a depth of from about 3 to about 10 mils.

34. The container according to claim 32, wherein the plurality of stabilizing nodules are formed on pleats of the container.

35. The container according to claim 32, having from about 25 to about 80 circumferentially spaced stabilizing nodules.

36. The container according to claim 32, having from about 30 to about 60 circumferentially spaced stabilizing nodules.

37. The container according to claim 32, having from about 35 to about 50 circumferentially spaced stabilizing nodules.

38. The container according to claim 32, wherein the groove is in a die forming contour and has an inner wall which is substantially vertical or slopes outwardly.

39. The container according to claim 31, wherein the stabilizing projection is formed on the underside of the container.

40. The container according to claim 31, wherein there is provided a spacer projection between the first and second annular transition portions sized to engage an adjacent like container in a stack so as to abate taper lock.

41. A disposable servingware container press-formed from a generally planar paperboard blank, the container having a characteristic diameter, D, as well as an overall height and comprising:

a generally planar bottom portion;

a first annular transition portion extending upwardly and outwardly from said generally planar bottom portion;

a sidewall portion extending upwardly and outwardly from said first annular transition portion;

a second annular transition portion extending outwardly from said sidewall portion;

an arcuate brim portion having a convex upper surface extending outwardly with respect to said second annular transition portion, the radius of curvature of said arcuate brim portion being from about 0.005 to about 0.1 times the characteristic diameter of said disposable servingware container, the arcuate brim portion extending downwardly at its outer part to define at its terminus a declivity angle α with respect to a horizontal substantially parallel to the bottom portion;

an inner flange portion extending between said second annular transition portion and said arcuate brim portion having a ratio of radial span to the characteristic diameter of from about 0 to about 0.1;

a brim transition portion at the lower edge of the downwardly sloping arcuate brim portion, there being thus defined a brim vertical drop which is the difference between the overall height of the container and a height at which the downwardly sloping brim portion transitions to the brim transition portion, wherein the ratio of the brim vertical drop to the characteristic diameter of the container is greater than about 0.01, the brim transition portion, in turn, transitions to an annular evert portion extending outwardly with respect to the downwardly sloping arcuate brim portion at an eversion angle β of at least about 25 degrees, the height of any upward extension of the evert portion above the brim transition portion being no more than about 75% of the brim vertical drop, and wherein the arcuate brim portion has a plurality of circumferentially spaced pleats.

* * * * *